US006824968B2

(12) United States Patent
Maeno et al.

(10) Patent No.: US 6,824,968 B2
(45) Date of Patent: Nov. 30, 2004

(54) SILVER HALIDE COLOR REVERSAL PHOTOGRAPHIC LIGHT-SENSITIVE MATERIAL

(75) Inventors: Yutaka Maeno, Minami-Ashigara (JP); Sadanobu Shuto, Minami-Ashigara (JP); Akihiro Kakinuma, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/682,525

(22) Filed: Oct. 10, 2003

(65) Prior Publication Data

US 2004/0081927 A1 Apr. 29, 2004

(30) Foreign Application Priority Data

Oct. 11, 2002 (JP) ..... 2002-299509

(51) Int. Cl.[7] ..... G03C 1/46; G03C 1/08

(52) U.S. Cl. ..... 430/505; 430/502; 430/503; 430/504; 430/508; 430/379

(58) Field of Search ..... 430/502, 503, 430/504, 505, 508, 379

(56) References Cited

U.S. PATENT DOCUMENTS 5,378,590 A 1/1995 Ford et al.
6,048,673 A 4/2000 Kuramitsu et al.
6,346,372 B1 * 2/2002 Yoshikawa et al. ..... 430/567
6,645,680 B2 * 11/2003 Abe et al. ..... 430/379

* cited by examiner

*Primary Examiner*—Geraldine Letscher
(74) *Attorney, Agent, or Firm*—Sughrue Mion, PLLC

(57) ABSTRACT

A silver halide color reversal photographic light-sensitive material comprising at least one interimage effect imparting layer (a) defined below and at least one interimage effect imparting layer (b) defined below, wherein, when the photographic light-sensitive material is exposed to light of a "skin color" having the spectral distribution of Table 1 described in the specification and is then subjected to development, a ratio of the chroma $C^*_{70}$ at a brightness $L^*=70$ represented by CIE Lab color system to the chroma $C^*_{50}$ at a brightness $L^*=50$, $C^*_{70}/C^*_{50}$, is 0.7 or more.

(a) an interimage effect imparting layer containing a short-wavelength green-sensitive silver halide emulsion having a weight-averaged wavelength of a spectral sensitivity distribution of 500 to 560 nm;

(b) an interimage effect imparting layer containing a red-sensitive silver halide emulsion having a weight-averaged wavelength of a spectral sensitivity distribution of 580 to 700 nm.

16 Claims, 2 Drawing Sheets

SILVER HALIDE COLOR REVERSAL PHOTOGRAPHIC LIGHT-SENSITIVE MATERIAL

CROSS-REFERENCE TO RELATED APPLICATIONS

This application is based upon and claims the benefit of priority from the prior Japanese Patent Application No. 2002-299509, filed Oct. 11, 2002, the entire contents of which are incorporated herein by reference.

BACKGROUND OF THE INVENTION

1. Field of the Invention

The present invention relates to a color reversal photographic light-sensitive material having an improved color reproduction, and particularly to a color reversal photographic light-sensitive material which is superior in skin color reproduction and in faithful color reproduction and which shows a slight change with respect to light and shade of an object and to variation in exposure. Moreover, the present invention relates to a color reversal-photographic light-sensitive material improved in adaptability for various light sources and in color temperature dependency of light source.

2. Description of the Related Art

For color reversal photographic light-sensitive materials, the color reproduction is an important feature. Heretofore, there have been made many attempts to improve the color reproduction, such as correction of side absorption of coloring materials by means of masking and utilization of an interimage effect.

In particular, the reproduction of "skin color" is important in the field of fashion portrait photographing and it has been required to be improved.

However, in the reproduction of the color of the human skin, there is some difference between the real skin color and a skin color favorable to be reproduced. For example, although a normal skin color is desired to have a chroma higher than the real tone, it is preferable that no defects such as pimples be noticeable. It, therefore, is not necessarily proper to reproduce the real tone of the skin faithfully. Moreover, the human eyes are very sensitive to skin color and can recognize a slight color difference in skin color, which difference would not be noticed in case of a normal color. Accordingly, the reproduction of skin color has some difficulty due to the necessity for an extremely precise control of color reproduction.

As a technology for improving the reproduction of skin color, disclosed is a color reversal photographic element comprising interimage effect controlling means, which element can reproduce a red tint of high relative chroma and a yellow-red tint (skin color) of substantially low relative chroma (see, for example, U.S. Pat. No. 5,378,590). However, the color reversal photographic element of this invention defines the relative chroma of a yellow-red tint (skin color) only. There is no reference to the hue of skin color.

On the other hand, a color reversal photographic light-sensitive material comprising interimage effect controlling means, wherein chroma and hue are defined with respect to "skin color" and "red-tint skin color" (see, or example, U.S. Pat. No. 6,048,673). However, this invention also provides no definition relating to a chroma ratio between skin colors different in brightness and, therefore, is not satisfactory with respect to improvement in skin color. This invention includes a description that there may be arranged an interimage effect imparting layer having a spectral sensitivity distribution different than that of a main blue-, green- and red-sensitive layers. However, it does not disclose any specific approach. Moreover, there is no description to teach the usefulness of the two kinds of interimage effect imparting layers.

BRIEF SUMMARY OF THE INVENTION

An object of the present invention is to provide a silver halide color reversal photographic light-sensitive material having an improved color reproduction and particularly to provide a color reversal photographic light-sensitive material which is superior in skin color reproduction and in faithful color reproduction and which shows a slight change with respect to light and shade of an object and to variation in exposure. Moreover, another object of the present invention is to provide a color reversal photographic light-sensitive material improved in adaptability for various light sources and in color temperature dependency of light source.

The objects of the invention have been attained by the following approaches.

(1) A silver halide color reversal photographic light-sensitive material having on a transparent support at least one blue-sensitive silver halide emulsion layer containing a yellow-coloring coupler, at least one green-sensitive silver halide emulsion layer containing a magenta-coloring coupler and at least one red-sensitive silver halide emulsion layer containing a cyan-coloring coupler, wherein the photographic light-sensitive material comprising at least one interimage effect imparting layer (a) defined below and at least one interimage effect imparting layer (b) defined below in addition to the blue-, green- and red-sensitive silver halide emulsion layers, wherein, when the photographic light-sensitive material is exposed to light of a "skin color" having the spectral distribution of Table 1 and is then subjected to development, a ratio of the chroma $C^*_{70}$ at a brightness $L^*=70$ represented by CIE Lab color system to the chroma $C^*_{50}$ at a brightness $L^*=50$, $C^*_{70}/C^*_{50}$, is 0.7 or more.

(a) an interimage effect imparting layer containing a short-wavelength green-sensitive silver halide emulsion having a weight-averaged wavelength of a spectral sensitivity distribution in the range of 500 nm to 560 nm;

(b) an interimage effect imparting layer containing a red-sensitive silver halide emulsion having a weight-averaged wavelength of a spectral sensitivity distribution in the range of 580 nm to 700 nm.

TABLE 1

Spectral reflectance distribution of skin color

| Wave-length (nm) | Spectral reflectance of skin color |
|---|---|
| 400 | 0.1687 |
| 405 | 0.1621 |
| 410 | 0.1611 |
| 415 | 0.1577 |
| 420 | 0.1560 |
| 425 | 0.1570 |
| 430 | 0.1605 |
| 435 | 0.1675 |
| 440 | 0.1809 |
| 445 | 0.1937 |
| 450 | 0.2044 |

TABLE 1-continued

| Spectral reflectance distribution of skin color | |
|---|---|
| Wave-length (nm) | Spectral reflectance of skin color |
| 455 | 0.2105 |
| 460 | 0.2184 |
| 465 | 0.2223 |
| 470 | 0.2279 |
| 475 | 0.2337 |
| 480 | 0.2397 |
| 485 | 0.2439 |
| 490 | 0.2490 |
| 495 | 0.2546 |
| 500 | 0.2625 |
| 505 | 0.2685 |
| 510 | 0.2802 |
| 515 | 0.2853 |
| 520 | 0.2893 |
| 525 | 0.2931 |
| 530 | 0.2932 |
| 535 | 0.2967 |
| 540 | 0.2993 |
| 545 | 0.2994 |
| 550 | 0.2999 |
| 555 | 0.3022 |
| 560 | 0.3041 |
| 565 | 0.3056 |
| 570 | 0.3103 |
| 575 | 0.3095 |
| 580 | 0.3136 |
| 585 | 0.3272 |
| 590 | 0.3450 |
| 595 | 0.3630 |
| 600 | 0.3841 |
| 605 | 0.3970 |
| 610 | 0.4106 |
| 615 | 0.4187 |
| 620 | 0.4273 |
| 625 | 0.4398 |
| 630 | 0.4458 |
| 635 | 0.4548 |
| 640 | 0.4615 |
| 645 | 0.4755 |
| 650 | 0.4796 |
| 655 | 0.4858 |
| 660 | 0.4913 |
| 665 | 0.4988 |
| 670 | 0.5041 |
| 675 | 0.5034 |
| 680 | 0.4991 |
| 685 | 0.5043 |
| 690 | 0.5072 |
| 695 | 0.5163 |
| 700 | 0.5189 |

(2) The silver halide color reversal photographic light-sensitive material described in item (1) above, wherein a ratio of the chroma $C^*_{20}$ at a brightness L*=20 to the chroma $C^*_{50}$ at a brightness L*=50, $C^*_{20}/C^*_{50}$, is 0.7 or more.

(3) The silver halide color reversal photographic light-sensitive material described in items (1) or (2) above, wherein the standard deviation of the hue angle in the CIE Lab color system of a "skin color" image that is reproduced by the photographic light-sensitive material is within 1.0 in the range of brightness L*=20 to 70.

(4) The silver halide color reversal photographic light-sensitive material described in any one of items (1) to (3) above, wherein when the photographic light-sensitive material is exposed to light having a "gray" spectral reflectance distribution shown in Table 2 and is then subjected to development, the chroma C* value represented in the CIE Lab color system of a "gray" image that is reproduced by the photographic light-sensitive material, is 0 or more, but 10 or less, in the range of L*=20 to 70.

TABLE 2

| Spectral reflectance distribution of gray | |
|---|---|
| Wave-length (nm) | Spectral reflectance of gray |
| 400 | 0.1719 |
| 405 | 0.1824 |
| 410 | 0.1868 |
| 415 | 0.1887 |
| 420 | 0.1896 |
| 425 | 0.1906 |
| 430 | 0.1914 |
| 435 | 0.1927 |
| 440 | 0.1937 |
| 445 | 0.1948 |
| 450 | 0.1949 |
| 455 | 0.1948 |
| 460 | 0.1948 |
| 465 | 0.1943 |
| 470 | 0.1944 |
| 475 | 0.1943 |
| 480 | 0.1940 |
| 485 | 0.1938 |
| 490 | 0.1940 |
| 495 | 0.1941 |
| 500 | 0.1946 |
| 505 | 0.1947 |
| 510 | 0.1949 |
| 515 | 0.1950 |
| 520 | 0.1954 |
| 525 | 0.1958 |
| 530 | 0.1959 |
| 535 | 0.1961 |
| 540 | 0.1964 |
| 545 | 0.1965 |
| 550 | 0.1964 |
| 555 | 0.1966 |
| 560 | 0.1967 |
| 565 | 0.1970 |
| 570 | 0.1973 |
| 575 | 0.1977 |
| 580 | 0.1982 |
| 585 | 0.1984 |
| 590 | 0.1983 |
| 595 | 0.1983 |
| 600 | 0.1979 |
| 605 | 0.1974 |
| 610 | 0.1970 |
| 615 | 0.1965 |
| 620 | 0.1961 |
| 625 | 0.1953 |
| 630 | 0.1949 |
| 635 | 0.1943 |
| 640 | 0.1937 |
| 645 | 0.1929 |
| 650 | 0.1924 |
| 655 | 0.1919 |
| 660 | 0.1914 |
| 665 | 0.1908 |
| 670 | 0.1904 |
| 675 | 0.1898 |
| 680 | 0.1893 |
| 685 | 0.1886 |
| 690 | 0.1882 |
| 695 | 0.1878 |
| 700 | 0.1874 |

(5) The silver halide color reversal photographic light-sensitive material described in any one of items (1) to (4) above, wherein the weight-averaged wavelength of the spectral sensitivity distribution of the red-sensitive silver halide emulsion layer is 580 nm or more and 630 nm or less and the weight-averaged wavelength of the spectral sensitivity distribution of the green-sensitive silver halide emulsion layer is 520 nm or more and 560 nm or less.

DETAILED DESCRIPTION OF THE INVENTION

Figure 1:
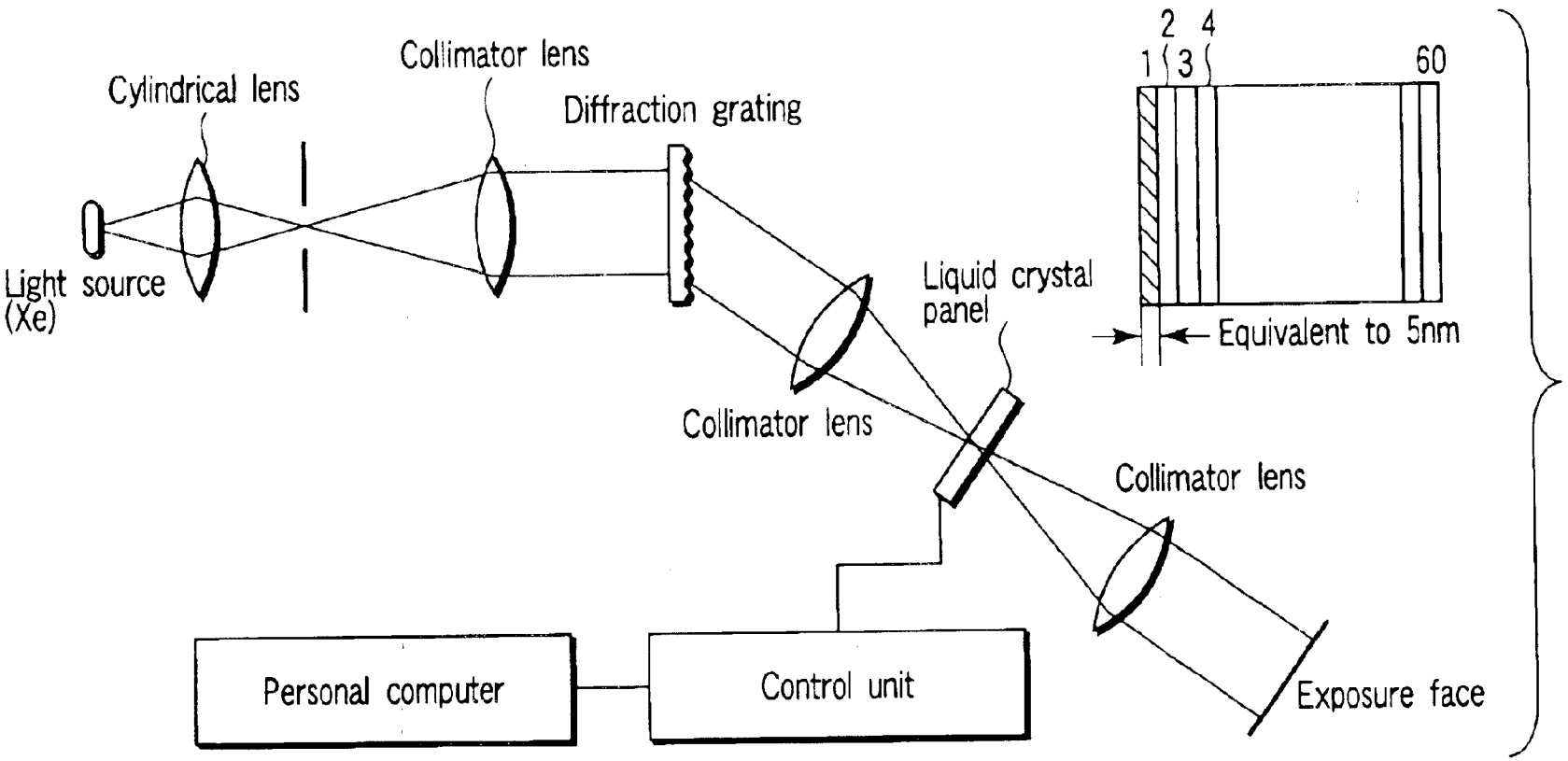
FIG. 1 is an explanatory diagram of a spectro-sensitometer device.

A silver halide color reversal light-sensitive material of the present invention is described in more detail below. The color reversal light-sensitive material of the present invention has on a support at least one yellow color-forming coupler-containing blue-sensitive silver halide emulsion layer, at least one magenta color-forming coupler-containing green-sensitive silver halide emulsion layer and at least one cyan color-forming coupler-containing red-sensitive silver halide emulsion layer and also has at least one interimage effect imparting layer defined by (a) below and at least one interimage effect imparting layer defined by (b) below:

(a) an interimage effect imparting layer containing a short-wavelength green-sensitive silver halide emulsion having a weight-averaged wavelength of a spectral sensitivity distribution of 500 nm or more and 560 nm or less;

(b) an interimage effect imparting layer containing a red-sensitive silver halide emulsion having a weight-averaged wavelength of a spectral sensitivity distribution of 580 nm or more and 700 nm or less.

In the present invention, weight-averaged wavelengths of the spectral sensitivity distribution of a red-sensitive emulsion layer, green-sensitive emulsion layer, interimage effect imparting layer containing a short wave green-sensitive silver halide emulsion of the present invention (hereinafter referred to as "short-wavelength green-sensitive interimage effect imparting layer") and interimage effect imparting layer containing a red-sensitive silver halide emulsion of the present invention (hereinafter referred to as "red-sensitive interimage effect imparting layer"), λr, λg, λic and λir, are determined, respectively, according to the following equations:

$$\lambda r = \int_{550}^{650} \lambda \cdot Sr(\lambda)\,d\lambda \Big/ \int_{550}^{650} Sr(\lambda)\,d\lambda$$

$$\lambda g = \int_{500}^{600} \lambda \cdot Sg(\lambda)\,d\lambda \Big/ \int_{500}^{600} Sg(\lambda)\,d\lambda$$

$$\lambda ic = \int_{400}^{600} \lambda \cdot Sic(\lambda)\,d\lambda \Big/ \int_{400}^{600} Sic(\lambda)\,d\lambda$$

$$\lambda ir = \int_{400}^{700} \lambda \cdot Sir(\lambda)\,d\lambda \Big/ \int_{400}^{700} Sir(\lambda)\,d\lambda$$

In the equations, Sn(λ) is the spectral sensitivity distribution of each color-sensitive layer at its color density of 1.0. However, when the color-sensitive emulsion layer does not assume color, Sn(λ), can be determined from a result of the spectral response imparting the blackened silver concentration of 0.2 by silver-developing a sample on which a single layer is coated using the emulsion. In many cases, the weight-averaged wavelength of a spectral sensitivity distribution corresponds to an absorption wavelength of a J-aggregation of a light-sensitization dye adsorbed to the emulsion and often agrees with a maximum value of the spectral sensitivity distribution.

The light-sensitive material of the present invention is subjected to a color reversal treatment. A concrete treating method may typically be Process CR-56 provided by Fuji Photo Film Co., Ltd. and "Developing Treatment A" disclosed below.

(Developing Treatment A)

For evaluation, commercially available reversal films are used at a ratio of unexposed one to completely exposed one of 1:1 after running processing was carried out until replenishment amount becomes 4 times the tank volume.

(Hereinafter, liter and milliliter are indicated by "L" and "mL," respectively.)

| Processing Step | Time | Temperature | Tank volume | Replenishment rate |
|---|---|---|---|---|
| 1st development | 6 min | 38° C. | 12 L | 2,200 mL/m$^2$ |
| 1st washing | 2 min | 38° C. | 4 L | 7,500 mL/m$^2$ |
| Reversal | 2 min | 38° C. | 4 L | 1,100 mL/m$^2$ |
| Color development | 6 min | 38° C. | 12 L | 2,200 mL/m$^2$ |
| Pre-bleaching | 2 min | 38° C. | 4 L | 1,100 mL/m$^2$ |
| Bleaching | 6 min | 38° C. | 12 L | 220 mL/m$^2$ |
| Fixing | 4 min | 38° C. | 8 L | 1,100 mL/m$^2$ |
| 2nd washing | 4 min | 40° C. | 8 L | 7,500 mL/m$^2$ |
| Final rinsing | 1 min | 25° C. | 2 L | 1,100 mL/m$^2$ |

The compositions of the processing solutions were as follows.

| <1st developer> | <Tank solution> | <Replenisher> |
|---|---|---|
| Nitrilo-N,N,N-trimethylene phosphonic acid.pentasodium salt | 1.5 g | 1.5 g |
| Diethylenetriamine pentaacetic acid.pentasodium salt | 2.0 g | 2.0 g |
| Sodium sulfite | 30 g | 30 g |
| Hydroquinone.potassium monosulfonate | 20 g | 20 g |
| Potassium carbonate | 15 g | 20 g |
| Sodium bicarbonate | 12 g | 15 g |
| 1-phenyl-4-methyl-4-hydroxymethyl-3-pyrazolidone | 1.5 g | 2.0 g |
| Potassium bromide | 2.5 g | 1.4 g |
| Potassium thiocyanate | 1.2 g | 1.2 g |
| Potassium iodide | 2.0 mg | — |
| Diethyleneglycol | 13 g | 15 g |
| Water to make | 1,000 mL | 1,000 mL |
| pH | 9.65 | 9.65 |

The pH was adjusted by sulfuric acid or potassium hydroxide.

| <Reversal solution> | <Tank solution> | <Replenisher> |
|---|---|---|
| Nitrilo-N,N,N-trimethylene phosphonic acid.pentasodium salt | 3.0 g | the same as tank solution |
| Stannous chloride.dihydrate | 1.0 g | |
| Sodium hydroxide | 8 g | |
| Glacial acetic acid | 15 mL | |
| Water to make | 1,000 mL | |
| pH | 6.00 | |

The pH was adjusted by acetic acid or sodium hydroxide.

| <Color developer> | <Tank solution> | <Replenisher> |
|---|---|---|
| Nitrilo-N,N,N-trimethylene phosphonic acid.pentasodium salt | 2.0 g | 2.0 g |
| Sodium sulfite | 7.0 g | 7.0 g |
| Trisodium phosphate.dodecahydrate | 25 g | 25 g |
| Potassium bromide | 1.0 g | — |
| Potassium iodide | 50 mg | — |
| Sodium hydroxide | 10.0 g | 10.0 g |
| Citrazinic acid | 0.5 g | 0.5 g |
| N-ethyl-N-(β-methanesulfon amidoethyl)-3-methyl-4 aminoaniline.3/2 sulfuric acid.monohydrate | 9.0 g | 9.0 g |
| 3,6-dithiaoctane-1,8-diol | 0.6 g | 0.7 g |
| Water to make | 1,000 mL | 1,000 mL |
| pH | 11.85 | 12.00 |

The pH was adjusted by sulfuric acid or potassium hydroxide.

| <Pre-bleaching solution> | <Tank solution> | <Replenisher> |
|---|---|---|
| Ethylenediaminetetraacetic acid.disodium salt.dihydrate | 8.0 g | 8.0 g |
| Sodium sulfite | 6.0 g | 8.0 g |
| 1-thioglycerol | 0.4 g | 0.4 g |
| Formaldehyde sodium bisulfite adduct | 25 g | 25 g |
| Water to make | 1,000 mL | 1,000 mL |
| pH | 6.30 | 6.10 |

The pH was adjusted by acetic acid or sodium hydroxide.

| <Bleaching solution> | <Tank solution> | <Replenisher> |
|---|---|---|
| Ethylenediaminetetraacetic acid.disodium salt.dihydrate | 2.0 g | 4.0 g |
| Ethylenediaminetetraacetic acid.Fe(III).ammonium.dihydrate | 120 g | 240 g |
| Potassium bromide | 100 g | 200 g |
| Ammonium nitrate | 10 g | 20 g |
| Water to make | 1,000 mL | 1,000 mL |
| pH | 5.70 | 5.50 |

The pH was adjusted by nitric acid or sodium hydroxide.

| <Fixing solution> | <Tank solution> | <Replenisher> |
|---|---|---|
| Ammonium thiosulfate | 80 g | the same as tank solution |
| Sodium sulfite | 5.0 g | the same as tank solution |
| Sodium bisulfite | 5.0 g | the same as tank solution |
| Water to make | 1,000 mL | the same as tank solution |
| pH | 6.60 | |

The pH was adjusted by acetic acid or ammonia water.

| <Stabilizer> | <Tank solution> | <Replenisher> |
|---|---|---|
| 1,2-benzoisothiazoline-3-one | 0.02 g | 0.03 g |
| Polyoxyethylene-p-monononyl phenylether (average polymerization degree = 10) | 0.3 g | 0.3 g |

-continued

| <Stabilizer> | <Tank solution> | <Replenisher> |
|---|---|---|
| Polymaleic acid (average molecular weight = 2,000) | 0.1 g | 0.15 g |
| Water to make | 1,000 mL | 1,000 mL |
| pH | 7.0 | 7.0 |

It is noted that when the spectral sensitivity distribution of a layer containing no coupler is measured, evaluation is conducted by a black-and-white developing treatment composed only of the first development, the first rinsing, the fixing and the second rinsing of the procedure of "Developing Treatment A" described above.

In the color reversal photographic light-sensitive material of the present invention, the weight-averaged wavelength of the spectral sensitivity distribution represented by a cyan image, namely, the spectral sensitivity distribution of the red-sensitive silver halide emulsion layer containing a cyan-coloring coupler is preferably 580 nm or more and 630 nm or less, more preferably 590 nm or more and 620 nm or less. Moreover, the weight-averaged wavelength of the spectral sensitivity distribution represented by a magenta image, namely, the spectral sensitivity distribution of the green-sensitive silver halide emulsion layer containing a magenta-coloring coupler is preferably 520 nm or more and 560 nm or less, more preferably 530 nm or more and 550 nm or less.

The color reversal photographic light-sensitive material of the present invention preferably has, in addition to the aforementioned green-sensitive silver halide emulsion layer, at least one short-wavelength green-sensitive interimage effect imparting layer having a weight-averaged wavelength of the spectral sensitivity distribution of 500 nm or more and 560 nm or less, preferably 510 nm or more and 540 nm or less and containing a silver halide emulsion which can impart an interimage effect by containing silver iodide. In the color reversal photographic light-sensitive material of the present invention, it is preferable that the weight-averaged wavelength of the spectral sensitivity distribution of the green-sensitive layer and the weight-averaged wavelength of the spectral sensitivity distribution of the short-wavelength green-sensitive interimage effect imparting layer, respectively, meet the ranges described above and that the weight-averaged wavelength of the spectral sensitivity distribution of the green-sensitive layer be greater than the weight-averaged wavelength of the spectral sensitivity distribution of the short-wavelength green-sensitive interimage effect imparting layer. The silver halide emulsion contained in the short-wavelength green-sensitive interimage effect imparting layer may be light-sensitive or alternatively non-sensitive. The silver halide emulsion is preferably silver halide containing not less than 1 mol % of silver iodide, and more preferably silver halide containing not less than 5 mol % of silver iodide. The silver halide emulsion contained in the short-wavelength green-sensitive interimage effect imparting layer is not particularly restricted with respect to halogen composition other than silver iodide as long as the emulsion is silver halide containing not less than 1 mol % of silver iodide. However, the halogen composition other than silver iodide is preferably silver iodobromide containing not less than 5 mol % of silver iodide. The amount of silver applied in the short-wavelength green-sensitive interimage effect imparting layer is preferably 0.1 to 1.0 g/m$^2$, and more preferably 0.2 to 0.7 g/m$^2$.

It is preferable that the short-wavelength green-sensitive interimage effect imparting layer does not form a magenta image substantially. The short-wavelength green-sensitive interimage effect imparting layer may contain a magenta coupler, but in this case, it is preferable that ⅕ mol % or less, more preferably 1/10 mol % or less of the total amount of the magenta couplers contained in the green-sensitive silver halide emulsion layers.

The color reversal photographic light-sensitive material of the present invention has at least one red-sensitive interimage effect imparting layer having a weight-averaged wavelength of the spectral sensitivity distribution of 580 nm or more and 700 nm or less, preferably 590 nm or more and 670 nm or less and containing a silver halide emulsion which can impart an interimage effect by containing silver iodide. In the color reversal photographic light-sensitive material of the present invention, it is preferable that the weight-averaged wavelength of the spectral sensitivity distribution of the red-sensitive layer and the weight-averaged wavelength of the spectral sensitivity distribution of the red-sensitive interimage effect imparting layer, respectively, meet the ranges described above and that the weight-averaged wavelength of the spectral sensitivity distribution of the red-sensitive layer be smaller than the weight-averaged wavelength of the spectral sensitivity distribution of the red-sensitive interimage effect imparting layer. The silver halide emulsion contained in the red-sensitive interimage effect imparting layer may be light-sensitive or alternatively non-sensitive. The silver halide emulsion is preferably silver halide containing not less than 1 mol % of silver iodide, and more preferably silver halide containing not less than 5 mol % of silver iodide. The silver halide emulsion contained in the red-sensitive interimage effect imparting layer is not particularly restricted with respect to halogen composition other than silver iodide as long as the emulsion is silver halide containing not less than 1 mol % of silver iodide. However, the halogen composition other than silver iodide is preferably silver iodobromide containing not less than 5 mol % of silver iodide. The amount of silver applied in the red-sensitive interimage effect imparting layer is preferably 0.1 to 1.0 g/m$^2$, and more preferably 0.2 to 0.7 g/m$^2$.

It is preferable that the red-sensitive interimage effect imparting layer does not form a cyan image substantially. The red-sensitive interimage effect imparting layer may contain a cyan coupler, but in this case, it is preferable that ⅕ mol % or less, more preferably 1/10 mol % or less of the total amount of the cyan couplers contained in the red-sensitive silver halide emulsion layers.

The short-wavelength green-sensitive interimage effect imparting layer and the red-sensitive interimage effect imparting layer, although may be arranged at arbitrary positions, are preferably arranged close to a red-sensitive layer. In a layer arrangement wherein a blue-sensitive layer is disposed at the remotest position from a support and a red-sensitive layer is disposed at the closest position to the support with a green-sensitive layer disposed between the layers, as generally realized in the color reversal photographic light-sensitive material, the interimage effect imparting layers are preferably arranged at a position closer to the support than the blue-sensitive layer, more preferably at a position closer to the support than the green-sensitive layer, still more preferably between the red-sensitive layer and the support, and optimally in the order of the red-sensitive layer, the red-sensitive interimage effect imparting layer, the short-wavelength green-sensitive interimage effect imparting layer and the support. It is preferable that an undercoat layer and an antihalation layer be disposed between the short-wavelength green-sensitive interimage effect imparting layer and the support so that the undercoat layer may be located closer to the support.

Preferably, in an intermediate layer separating the short-wavelength green-sensitive interimage effect imparting layer and/or the red-sensitive interimage effect imparting layer from the other layer, a competing compound, i.e., a compound that competes with an image-forming coupler to react with an oxidized product of a color developing agent and forms no image, is also added. Examples of the competing compound include reducing compounds such as hydroquinones, catechols, hydrazines and sulfonamidophenols; and compounds that couple with an oxidized product of a color developing agent, but do not substantially form a color image (e.g., non-color-forming couplers as disclosed in German patent No. 1,155,675, British patent No. 861,138 and U.S. Pat. No. 3,876,428, and couplers that form dyes flowing out during processing processes). The amount of the competing compound is usually 0.01 g to 10 g, preferably 0.10 g to 5.0 g, per m$^2$ of light-sensitive material.

The spectral reflectances of "skin color" and "gray" referred to in the present invention are shown in the above Tables 1 and 2, respectively. As for the spectral reflectance of "gray," measured values of Munsell color chip N5 were used.

In the present invention, the spectral distribution under the standard illumination of each of the colors (relative spectral luminance) was calculated from the above-described spectral reflectance multiplied by the spectral distribution of an ISO sensito-metric daylight source (D55). The spectral distribution can be generated by a spectro-sensitometer device that is able to produce any of the spectral distributions by using an intensity modulating-type mask formed by arranging liquid crystal panels in the stripe form, and further by electrically controlling the transmittance of each of the liquid crystal segments. The spectro-sensitometer device that is able to generate the above-described spectral distribution can be prepared with reference to the reports presented by Enomoto et al. in the Annual Meeting of SPSTJ (Nihon Shashin Gakkai) '90. FIG. 1 shows a block diagram of the device mainly showing its optical system and a schematic diagram of the liquid crystal mask are disclosed in FIG. 1 of U.S. Pat. No. 6,048,673. A xenon arc lamp having a high luminance is used as a light source, and in addition, a cylindrical lens was used in the optical system, thereby obtaining a long slit light extended to the grating direction of a diffraction grating. A light separated by a transmission-type diffraction grating acts as a spectral face having a wavelength region of from 400 nm to 700 nm at the dispersion face. Onto this spectral face, are placed liquid crystal panels composed of 60 segments, in which 1 segment is 5 nm, and transmittance is controlled at intervals of 5 nm, thereby obtaining an objective spectral distribution. A color-mixed slit light is formed on the surface of exposure to light, and the exposure to light is performed by scanning a light-sensitive material, on which an optical wedge is placed, at an orthogonal angle to the slit light.

The measurement of "skin color" and "gray," each of which is reproduced by a light-sensitive material of the present invention, was carried out under the observational condition based on an isochromatic test in which twice sight (2-degree colorimetric observation) was adopted at the 1931 CIE (Commission International de I'Eclairage) Conference. Further, to calculate CIE Lab values, the CIE 976 (L*, a*, b*) isometric perceptive color space alculations were used. For a more detailed explanation of the above-mentioned calculations, reference can be made to, for example, New-Edition Color Science Handbook, edited by the publication party of Tokyo University (1980), Chapter 4.

In the present invention, for the evaluation of "skin color" and "gray" images, correction is necessary so that the C* value represented by the CIE Lab values of the "gray" image is 0.5 or less at L*=40. For example, the correction can be made using a commercially available color compensating filter. Alternatively, as the method described in U.S. Pat. No. 5,378,590, the CIE Lab values for the "skin color" and "gray" images can be also re-calculated and evaluated by resealing the tristimulus values X, Y and Z, with L* of the "gray" image being 40, as the reference white. Among these, correction at the time of exposure to light is preferred.

The ratio of the chroma $C^*_{70}$ at L*=70 represented by the CIE Lab values of a "skin color" image that is reproduced by the light-sensitive material of the present invention to the chroma $C^*_{50}$ at L*=50, $C^*_{70}/C^*_{50}$) is 0.7 or more, more preferably 0.75 or more, and still more preferably 0.8 or more. The larger this value, the higher the chroma of skin color of high brightness and, therefore, the more beautiful skin color is reproduced.

The ratio of the chroma $C^*_{20}$ at L*=20 represented by the CIE Lab values of a "skin color" image that is reproduced by the light-sensitive material of the present invention to the chroma $C^*_{50}$ at L*=50, $C^*_{20}/C^*_{50}$) is 0.7 or more, more preferably 0.75 or more, and still more preferably 0.8 or more. The larger this value, the smaller the reduction in chroma of skin color of low brightness and, therefore, the more beautiful skin color is reproduced.

The standard deviation of hue angle in the CIE Lab color system of a "skin color" image that is reproduced by the light-sensitive material of the present invention is preferably within 1.0, more preferably with 0.6, and still more preferably within 0.4, in the range of L*=20 to 70. The smaller this value, the smaller the change in hue of skin color over a range from low brightness to high brightness and, therefore, the less favorable it is.

The C* value represented by a CIE Lab value of a "skin color" image that is reproduced by the light-sensitive material of the present invention is preferably within 10 or more and 35 or less, and more preferably 15 or more and 30 or less, in the range of L*=20 to 70.

The hue angle value represented by a CIE Lab value of a "skin color" image that is reproduced by the light-sensitive material of the present invention is 20 degrees or more and 70 degrees or less, and more preferably 30 degrees or more and 60 degrees or less, in the range of L*=20 to 70.

The C* value represented by a CIE Lab value of a "gray" image that is reproduced by the light-sensitive material of the present invention is preferably within 0 or more and 10 or less, more preferably 0 or more and 7 or less, and still more preferably 0 or more and 5 or less, in the range of L*=20 to 70. The smaller this value, the better the reproduction of gray over the range from low brightness to high brightness and, therefore, the more favorable it is.

As is clear from the data of spectral reflectance distribution shown in Table 1, "skin color" is a yellowish red color. The "skin color" image which is reproduced when a photographic light-sensitive material is exposed to a "skin color" light and is then subjected to development is reproduced so that the sensitivity of a red-sensitive layer is reproduced relatively more highly than the sensitivity of a blue- and green-sensitive layer with respect to a "gray" image. This suggests that to control a two-way interimage effect between a blue and green-sensitive layer and a red-sensitive layer is important for achieving a good skin color reproduction. The present invention provides a technology to control a two-way interimage effect between a blue and green-sensitive layer and a red-sensitive layer by disposing two interimage effect imparting layers consisting of a short-wavelength green-sensitive (blue and green-sensitive) interimage effect imparting layer and a red-sensitive interimage effect imparting layer. The technology has enabled a realization of superior skin color reproduction.

The light-sensitive material of the present invention is required only to have on a support at least one blue-sensitive silver halide emulsion layer, at least one green-sensitive silver halide emulsion layer and at least one red-sensitive silver halide emulsion layer. It is preferred that these layers be provided by coating in this sequence from the remotest side from the support. However, the coating may be performed in a sequence different therefrom. In the present invention, it is preferred that the coating be performed in the sequence of, from the side close to the support, a red-sensitive silver halide emulsion layer, a green-sensitive silver halide emulsion layer and a blue-sensitive silver halide emulsion layer. Preferably, each of these color sensitive layers has a unit constitution including a plurality of light-sensitive emulsion layers with different photographic speeds. It is especially preferred that each of these color sensitive layers have a three-layer unit constitution composed of three light-sensitive emulsion layers consisting of a low-speed layer, an intermediate-speed layer and a high-speed layer arranged in this sequence from the side close to the support. These are described in, for example, Jpn. Pat. Appln. KOKOKU Publication No. (hereinafter referred to as JP-B-) 49-15495 and Jpn. Pat. Appln. KOKAI Publication No. (hereinafter referred to as JP-A-) 59-202464.

As one of the preferable mode of the present invention, there can be mentioned the light-sensitive element in which the respective layers are coated, on a support, in order of an undercoat layer/an antihalation layer/a first intermediate layer/a short-wavelength green-sensitive interimage effect imparting layer/a red-sensitive interimage effect imparting layer/a second intermediate layer/a red-sensitive emulsion layer unit (comprising three layers of a low-speed red-sensitive layer/a medium-speed red-sensitive layer/a high-speed red-sensitive layer from the side close to the support)/a third intermediate layer/a green-sensitive emulsion layer unit (comprising three layers of a low-speed green-sensitive layer/a medium-speed green-sensitive layer/a high-speed green-sensitive layer from the side close to the support)/a fourth intermediate layer/a yellow filter layer/a blue-sensitive emulsion layer unit (comprising three layers of a low-speed blue-sensitive layer/a medium-speed blue-sensitive layer/a high-speed blue-sensitive layer from the side close to the support)/a first protective layer/a second protective layer.

Each of the first, second, third and fourth intermediate layers may be a single layer or two or more layers. The second intermediate layer is preferably divided into two or more layers, and the layer directly adjacent to the red-sensitive layer preferably contains yellow colloidal silver. Likewise, the third intermediate layer preferably includes two or more layers, and the layer directly adjacent to the green-sensitive layer preferably contains yellow colloidal silver. In addition, a fifth intermediate layer is favorably formed between the yellow filter layer and the blue-sensitive emulsion layer unit.

In the intermediate layers, a coupler or a DIR compound such as those described in JP-A's-61-43748, 59-113438, 59-113440, 61-20037 and 61-20038 may be contained. A color mixing prevention agent may be contained, as is usually used.

It is also preferable that the protective layer have a three-layer structure of a first to third protective layers.

When the protective layer is in a two-layer or three-layer structure, silver halide fine grains having an average equivalent spherical diameter of 0.10 μm or less are preferably contained in the second protective layer. The silver halide is preferably silver bromide or silver iodobromide.

The average equivalent spherical diameter used herein is the average value of diameters of spheres each having a volume equal to that of each individual silver halide grain.

In the photographic light-sensitive material of the present invention, it is also possible to arrange a blue-sensitive interimage effect imparting layer, in addition to the aforementioned short-wavelength green-sensitive interimage effect imparting layer and the red-sensitive interimage effect imparting layer, adjacent to or close to the main blue-, green- and red-sensitive layers. The blue-sensitive interimage effect imparting layer is preferably arranged between the yellow filter layer and the blue-sensitive emulsion layer unit. The blue-sensitive interimage effect imparting layer is preferably a short-wavelength blue-sensitive layer such that the weight-averaged wavelength of the spectral sensitivity distribution of the main blue-sensitive layer is greater than the weight-averaged wavelength of the spectral sensitivity distribution of the blue-sensitive interimage effect imparting layer.

The light-sensitive material of the present invention usually contains an image-forming coupler. The image-forming coupler means a coupler which couples with the oxidized form of an aromatic primary amine color developing agent to form an image-forming dye. Generally, a yellow coupler, a magenta coupler and a cyan coupler are used in combination to form a color image.

The image-forming coupler used in the present invention is preferably added to a light-sensitive emulsion layer sensitive to a light which is in a complementary color relationship with the color which the coupler forms. Namely, a yellow coupler is added to a blue-sensitive emulsion layer, a magenta coupler is added to a green-sensitive emulsion layer, and a cyan coupler is added to a red-sensitive emulsion layer. Further, couplers which are not in such a complementary color relationship may be additionally used in order to improve, e.g., a shadow imaging power (for example, a cyan coupler is additionally used in a green-sensitive emulsion layer).

The preferable image-forming coupler used in the light-sensitive material of the present invention includes those shown below:

Yellow couplers: couplers represented by formulas (I) and (II) in EP No. 502,424A; couplers represented by formulas (1) and (2) in EP No. 513,496A (e.g. Y-28 on page 18); a coupler represented by formula (I) in claim 1 of EP No. 568,037A; a coupler represented by general formula (I) in column 1, lines 45 to 55, in U.S. Pat. No. 5,066,576; a coupler represented by general formula (I) in paragraph 0008 of JP-A-4-274425; couplers described in claim 1 on page 40 in EP No. 498,381A1 (e.g. D-35); couplers represented by formula (Y) on page 4 in EP No. 447,969A1 (e.g. Y-1 and Y-54); and couplers represented by formulas (II) to (IV) in column 7, lines 36 to 58, in U.S. Pat. No. 4,476,219, the disclosures of the above documents disclosing the yellow couplers are incorporated herein by reference.

Magenta couplers: couplers described in JP-A-3-39737 (e.g. L-57, L-68, and L-77); couplers described in EP No. 456,257A (e.g. A-4-63, -73 and -75); couplers described in EP No. 486,965A (e.g. M-4, -6 and -7); couplers described in EP No. 571,959A (e.g. M-45); couplers described in JP-A-5-204106 (e.g. M-1); couplers described in JP-A-4-362631 (e.g. M-22) and couplers described in JP-A-11-119393 (e.g. A-12, CA-15, -16, and -18), the disclosures of the above documents disclosing the magenta couplers are incorporated herein by reference.

Cyan couplers: couplers described in JP-A-4-204843 (e.g., CX-1, -3, -4, -5, -11, -12, -14, and -15); Cyan couplers: couplers described in JP-A-4-43345 (e.g., C-7 and -10, -34 and 35, and (I-1) and (I-17); couplers represented by general formulas (Ia) and (Ib) in claim 1 of JP-A-6-67385 (e.g., CB-1, -4, -5, -9, -34, -44, -49, and -51); and couplers represented by general formula (NC-1) of JP-A-11-119393 (e.g., CC-1 and -17), the disclosures of the above documents disclosing the cyan couplers are incorporated herein by reference.

These couplers can be introduced into a light-sensitive material by various known dispersing methods. Preferably, an oil-in-water dispersing method is used, in which the couplers are dissolved in a high-boiling organic solvent (if necessary, a low-boiling solvent is additionally used), and the solution is emulsified and dispersed in an aqueous gelatin solution, which is then added to a silver halide emulsion.

Examples of a high-boiling organic solvent to be used in an oil-in-water dispersion method are described in, e.g., U.S. Pat. No. 2,322,027. In addition, the steps and effects of a latex dispersion method, which is one of the polymer dispersion methods, and examples of an impregnating latex are described in, e.g., U.S. Pat. No. 4,199,363 and West German Patent Application (OLS) Nos. 2,541,274 and 2,541,230.

Examples of a high-boiling organic solvent to be used in the oil-in-water dispersion method are phthalic esters (e.g., dibutylphthalate, dioctylphthalate, dicyclohexylphthalate, bis(2-ethylhexyl)phthalate, decylphthalate, bis(2,4-di-tert-amylphenyl)isophthalate, and bis(1,1-diethylpropyl) phthalate); phosphates or phosphonates (e.g., diphenylphosphate, triphenylphosphate, tricresylphosphate, 2-ethylhexyldiphenylphosphate, dioctylbutylphosphate, tricyclohexylphosphate, tri-2-ethylhexylphosphate, tridodecylphosphate, and bis(2-ethylhexyl) phenylphosphonate); benzoates (e.g., 2-ethylhexylbenzoate, 2,4-dichlorobenzoate, dodecylbenzoate, and 2-ethylhexyl-p-hydroxybenzoate); amides (e.g., N,N-diethyldodecaneamide, N,N-diethyllaurylamide, and N,N,N,N-tetrakis(2-ethylhexyl)amide isophthalate; alcohols or phenols (e.g., isostearylalcohol and 2,4-di-tert-amylphenol); aliphatic esters (e.g., dibuthoxyethyl succinate, bis(2-ethylhexyl)succinate, 2-hexyldecyltetradecanoate, tributhyl citrate, diethylazelate, isostearyllactate, and trioctyltosylate); an aniline derivative (e.g., N,N-dibutyl-2-buthoxy-5-tert-octylaniline); chlorinated paraffins (e.g., paraffins having chlorine content of 10%–80%); trimesic esters (e.g., tributhyl trimesate); dodecylbenzene; diisopropylnaphthalene, phenols (e.g., 2,4-di-tert-amylphenol, 4-dodecyloxyphenol, 4-dodecyloxycarbonylphenol, and 4-(4-dodecyloxyphenylsulfonyl)phenol); carboxylic acids (e.g., 2-(2,4-di-tert-amylphenoxybutyric acid, and 2-ethoxyoctanedecanoic acid); and alkylphosphoric acids (e.g., bis(2-ethylhexyl)phosphoric acid, diphenylphosphoric acid) and so on. In addition to the above-mentioned high-boiling organic solvent, compounds described in, e.g., JP-A-6-258803 can be used.

The weight ratio of a high-boiling organic solvent to a coupler is preferably 0 to 2.0, more preferably, 0 to 1.0, and most preferably, 0 to 0.4.

An organic solvent having a boiling point of 30° C. or more and about 160° C. or less (e.g., ethyl acetate, butyl acetate, ethyl propionate, methylethyl ketone, cyclohexanone, 2-ethoxyethylacetate, and dimethylformamide) may be used together with the above-mentioned high-boiling organic solvent as an auxiliary solvent.

The content of each of yellow, magenta and cyan couplers in the light-sensitive material is preferably 0.01 to 10 g per $m^2$, more preferably 0.1 to 2 g per $m^2$. In one emulsion layer, a proper content of each of the couplers, per mol of silver halide contained in an emulsion layer(s) having sensitivity to the same color, is $1\times10^{-3}$ to 1 mol, and preferably $2\times10^{-3}$ to $3\times^{10-1}$ mol.

When the light-sensitive layer is composed of a unit structure having two or more light-sensitive emulsion layers different in speed, the content of the coupler is preferably $2\times10^{-3}$ to $2\times10^{-1}$ mol per mol of silver halide in a lowest sensitivity layer, and is preferably $3\times10^{-2}$ to $3\times10^{-1}$ mol per mol of silver halide in a high sensitivity layer.

The light-sensitive material of the present invention may also contain a competing compound (a compound which competes with an image forming coupler to react with an oxidized form of a color developing agent and which does not form any dye image). Examples of this competing compound are reducing compounds such as hydroquinones, catechols, hydrazines and sulfonamidophenols, and compounds which couple with an oxidized form of a color developing agent but do not substantially form a color image (e.g., non-dye-forming couplers disclosed in German Patent No. 1,155,675, British Patent No. 861,138, and U.S. Pat. No. 3,876,428 and U.S. Pat. No. 3,912,513, and couplers such as those disclosed in JP-A-6-83002 by which generated dyes flow out during processing steps).

In the light-sensitive material of the present invention, a light-sensitive unit having the same color-sensitivity may include a non-color-forming intermediate layer. The intermediate layer preferably contains a compound that may be selected as the above-mentioned competing compounds.

To prevent deterioration of the photographic properties caused by formaldehyde gas, the light-sensitive material of the present invention preferably contains compounds described in U.S. Pat. No. 4,411,987 and U.S. Pat. No. 4,435,503, which can react with and fix formaldehyde gas.

The emulsion used in the silver halide photographic light-sensitive material of the present invention preferably comprises the tabular silver halide grains having the aspect ratio of 1.5 to 100. A tabular silver halide grain (hereinafter referred to also as tabular grain) used in the present invention has one twin plane or two or more parallel twin planes. The twin plane is a (111) plane on the two sides of which ions at all lattice points have a mirror image relationship. The tabular grain has two parallel principal planes and side faces connecting these principal planes, as outer surfaces. When viewed in a direction perpendicular to its principal planes, the tabular grain has a triangular shape, a hexagonal shape, or a rounded triangular or hexagonal shape. Each of these shapes has parallel outer surfaces.

In the present invention, the aspect ratio of a tabular grain means a value obtained by dividing the equivalent-circle diameter of each silver halide grain by its thickness. In the measuring the thickness of tabular grains, a transmission electron micrograph (TEM) thereof is taken according to the replica method, and the thickness of each individual grain are measured. In this method, the thickness of tabular grains is calculated from the length of shadow of the replica.

The term "equivalent-circle diameter" indicates the diameter of a circle having an area equal to the projected area of parallel principal planes of a grain.

The projected area of a grain can be obtained by measuring the area of the grain on electron micrographs and correcting the magnification. The equivalent-circle diameter of a tabular grain is preferably 0.3 to 5.0 $\mu$m. Also, the thickness of a tabular grain is 0.05 to 0.5 $\mu$m.

In the tabular grains used in the present invention, the sum of their projected areas preferably occupies 50% or more, more preferably 80% or more of the sum of the projected areas of the total silver halide grains in the emulsion. Further, the aspect ratio of the tabular grains which occupy these areas is preferably 1.5 or more and less than 100, more preferably 2 or more and less than 20, and further preferably 2 or more and less than 8.

In some cases, it is preferred that tabular grains used in the present invention are monodisperse. Although the structure and the method of manufacturing monodisperse tabular grains are described in, e.g., JP-A-63-151618, the shape of the grains will be briefly described below. That is, 70% or more of the total projected area of silver halide grains are accounted for by tabular grains having a hexagonal shape, in which the ratio of an edge having the maximum length with respect to the length of an edge having the minimum length is 2 or less, and having two parallel surfaces as outer surfaces. In addition, the grains have monodispersibility; that is, the variation coefficient of the grain diameter distribution of these hexagonal tabular grains (i.e., the value obtained by dividing the variation (standard deviation) of grain diameters, which are represented by the equivalent-circle diameters of the projected areas of the grains, by their average grain size) is 20% or less.

Tabular silver halide grains of the present invention favorably have dislocation lines.

Dislocation lines in tabular grains can be observed by a direct method using a transmission electron microscope at a low temperature described in, for example, J. F. Hamilton, Phot. Sci. Eng., 11, 57, (1967) or T. Shiozawa, J. Soc. Phot. Sci. Japan, 35, 213, (1972).

That is, silver halide grains, extracted carefully from an emulsion so as not to apply a pressure by which dislocations are produced in the grains, are placed on a mesh for electron microscopic observation. Observation is performed by a transmission method while the sample is cooled to prevent damage (e.g., print out) due to electron rays. In this case, as the thickness of a grain is increased, it becomes more difficult to transmit electron rays through it. Therefore, grains can be observed more clearly by using an electron microscope of a high voltage type (200 kV or more for a grain having a thickness of 0.25 $\mu$m). Note that dislocation lines can or cannot be seen depending on the angle of inclination of a sample with respect to electron rays. Therefore, in order to observe dislocation lines, it is necessary to obtain the positions of dislocation lines by observing photographs of the same grain taken at as many sample inclination angles as possible. From photographs of grains obtained by the above method, it is possible to obtain the positions of dislocation lines in each grain viewed in the direction perpendicular to the principal planes of the grain.

Dislocation lines in each grain extend from a position corresponding to x% of the distance from the center of tabular grains to the side to the periphery in the long axis direction. In this instance, the value of x is preferably $10\leqq x<100$, more preferably $30\leqq x<98$, and most preferably $50\leqq x<95$. In this instance, the figure created by binding the positions from which the dislocation lines start is nearly similar to the configuration of the grain. The created figure may be one which is not a complete similar figure but deviated. The dislocation lines extend in the direction of the side. However, the dislocation lines often meander and may also cross each other.

In an emulsion of the present invention, tabular grains containing 10 or more dislocation lines per grain account for preferably 50% or more (number), more preferably, 80% or more. It is extremely preferred that tabular grains containing 20 or more dislocation lines per grain account for 80% or more (number).

The process of preparing the tabular grain used in the present invention is described next. The tabular grains used in the present invention can be prepared by improving methods described in, e.g., "Cleave, Photography Theory and Practice (1930), page 13", "Gutuff, Photographic Science and Engineering Vol. 14, pages 248–257 (1970)", and specifications of U.S. Pat. Nos. 4,434,226, 4,414,310, 4,433,048 and 4,439,520, and GB 2,112,157.

Any of the silver halides such as silver bromide, silver iodobromide, silver iodochlorobromide and silver chlorobromide may be used for the tabular silver halide grains used in the present invention. The preferable silver halide is silver iodobromide or silver iodochlorobromide, containing 30 mol % or less of silver iodide.

The silver halide grains used in the present invention may have a multilayer structure, for example, a quintuple layer structure, concerning the silver halide distribution within a grain. The structure here refers to a structure concerning the silver iodide distribution, and it is indicated that the difference in silver iodide content between structures is of 1 mol % or more, and preferably 2 mol % or more. This structure concerning the silver iodide distribution can be determined by calculations from the prescribed values in the grain preparation step. In the interface between layers of the structure, the silver iodide content may change either abruptly or moderately. The EPMA (Electron Probe Micro Analyzer) method is usually effective to confirm this structure, although the measurement accuracy of analysis must be taken into consideration. By preparing a sample in which emulsion grains are dispersed so as not to contact each other and analyzing the X-rays radiated upon radiating an electron beam, elements in a micro region irradiated with the electron beam can be analyzed. The measurement is preferably performed while cooling at low temperatures in order to prevent damage to the sample from the electron beam. By this method, the silver iodide distribution within a tabular grain can be analyzed when the grain is viewed in a direction perpendicular to its principal planes. Additionally, when a specimen obtained by hardening a sample and cutting the sample into ultra thin slices using microtome is used, the silver iodide distribution within a grain in the section of a tabular grain can also be analyzed.

In the step of nucleation of grain formation, it is extremely advantageous to employ a gelatin of low methionine content as described in U.S. Pat. Nos. 4,713,320 and 4,942,120; to carry out nucleation at high pBr as described in U.S. Pat. No. 4,914,014; and to carry out nucleation within a short period of time as described in JP-A-2-222940. In addition, in the step of ripening, it may be advantageous to effect ripening in the presence of low-concentration base as described in U.S. Pat. No. 5,254,453, and to carry out ripening at high pH as described in U.S. Pat. No. 5,013,641.

It is preferable to add, at the step of ripening or subsequent growth, polyalkylene oxide compounds as described in U.S. Pat. Nos. 5,147,771, 5,147,772, 5,147,773, 5,171,659, 5,210,013 and 5,252,453.

To obtain high-aspect-ratio, monodisperse tabular grains, gelatin is sometimes added during grain formation. As this gelatin, chemically modified gelatin described in JP-A's-10-148897 and 11-143002 or a gelatin having low content of metionin described in U.S. Pat. Nos. 4,713,320, and 4,942,120 is preferably used. This chemically modified gelatin is characterized in that two or more carboxyl groups are introduced when an amino group in the gelatin is chemically modified. Although the use of trimellitated gelatin is preferred, succinated gelatin is also favorably used. This gelatin is added preferably before the growth step, and more preferably, immediately after nucleation. The addition amount is preferably 50% or more, and more preferably 70% or more with respect to the weight of all dispersing media in grain formation.

Examples of silver halide solvents which can be used in the present invention include organic thioethers (a) described in U.S. Pat. Nos. 3,271,157, 3,531,286 and 3,574,628 and JP-A's-54-1019 and 54-158917, thiourea derivatives (b) described in JP-A's-53-82408, 55-77737 and 55-2982, silver halide solvents having a thiocarbonyl group interposed between an oxygen or sulfur atom and a nitrogen atom (c) described in JP-A-53-144319, imidazoles (d) described in JP-A-54-100717, sulfites (e), ammonia (f) and thiocyanates (g).

Especially preferred solvents are thiocyanates, ammonia and tetramethylthiourea. Although the amount of added solvent depends on the type thereof, in the case of, for example, a thiocyanate, the preferred amount is in the range of $1\times10^{-4}$ to $1\times10^{-2}$ mol per mol of silver halides. Basically, when a washing step is provided after the first shell formation as described previously, the solvent can be removed regardless of the kind of a solvent used.

The dislocation line of the tabular grain used in the present invention is introduced by providing a high-iodide phase to the inside of the grain.

The high silver iodide phase is a silver halide solid solution containing iodine, and in this case, silver iodide, silver iodobromide and silver chloroiodobromide are preferable as the silver halide, silver iodide or silver iodobromide is preferable, and silver iodide is preferable in particular.

The amount of silver halide which forms the high silver iodide phase, in terms of silver amount, is preferably 30 mol % or less, and more preferably 10 mol % or less of the total silver amount of the grain. A phase grown at the outer side of the high silver iodide phase is required to have a silver iodide content lower than that in the high silver iodide phase, and its preferable silver iodide content is 0 to 12 mol %, further preferably 0 to 6 mol %, and most preferably 0 to 3 mol %

As the preferable method of forming the high silver iodide phase, there is a method wherein an emulsion containing silver iodobromide or silver iodide fine grains (hereinafter referred to also as silver iodide fine grain emulsion) is added to form the high-iodide phase. Fine grains preliminarily prepared can be used as these fine grains, and the fine grains immediately after preparation can be more preferably used.

A case of using the fine grains preliminarily prepared is firstly illustrated. In this case, there is a method wherein the fine grains preliminarily prepared are added, ripened and dissolved. As a more preferable method, there is a method wherein the silver iodide fine grain emulsion is added, and then an aqueous silver nitrate solution is added, or an aqueous silver nitrate solution and an aqueous halogen solution are added. In this case, the dissolution of the fine grains contained in a silver iodide fine grain emulsion is accelerated by the addition of the aqueous silver nitrate solution. It is preferred that the silver iodide fine grain emulsion be added abruptly.

The amount of the silver iodide fine grain emulsion to be added is preferably from 0.5 to 10.0%, and particularly preferably from 1.0 to 2.5% per molar amount of the whole silver nitrate.

The abrupt addition of the silver iodide fine grain emulsion means that the silver iodide fine grain emulsion is preferably added within 10 minutes. More preferably, it means the addition within 7 minutes. The condition can be varied depending on the temperature, pBr and pH of the system added, the kind and concentration of protective colloid agents such as gelatin and the like, the presence and absence, kind and concentration of the silver halide solvent and the like, but the shorter the more preferable as described above. At addition, it is preferable that the addition of an aqueous silver salt solution such as silver nitrate and the like is not substantially carried out. It is preferable that the temperature of the system at addition is 40° C. or more and 90° C. or less, and 50° C. or more and 80° C. or less is preferable in particular.

The composition of a fine grain contained in the silver iodide fine grain emulsion may be substantially silver iodide, and silver bromide and/or silver chloride may be contained so far as it becomes a mixed crystal. 100% Silver iodide is preferable. Silver iodide can be β form, γ form, and α form or a structure similar to the α-from as described in U.S. Pat. No. 4,672,026. In the present invention, the crystalline structure is not specifically limited, but a mixture of β form and γ form and further preferably β form are used. The silver iodide fine grain emulsion treated with a usual washing step is preferably used. The silver iodide fine grain emulsion can be easily prepared by methods as described in U.S. Pat. No. 4,672,026 and the like. The method of adding an aqueous solution of silver salt and an aqueous solution of silver iodide by the double jet process, wherein the grain formation is carried out at a fixed pI value, is preferred. The terminology "pI" is the logarithm of inverse of $I^-$ ion concentration of the system. Although there is no particular limitation with respect to the temperature, pI, pH, the kind and concentration of protective colloid agents such as gelatin and the like, the presence and absence, kind and concentration of the silver halide solvent and the like, but it is advantageous in the present invention that the grain size is 0.1 μm or less, and more preferably 0.07 μm or less. Although the grain configuration cannot be fully specified because of the fine grains, it is preferred that the variation coefficient of the grain size distribution is 25% or less. When it is 20% or less in particular, the effect of the present invention is striking. The size and size distribution of fine grains are determined by placing the fine grains on a mesh for electron microscope observation and, not through the carbon replica method, directly making an observation according to the transmission technique. The reason is that, because the grain size is small, the observation by the carbon replica method causes a large measuring error. The grain size is defined as the diameter of a circle having the same projected area as that of the origin. With respect to the size distribution as well, it is determined by the use of the above diameter of a circle having the same projected area. In the present invention, the most effective fine grains have a grain size of 0.02 μm or more and 0.06 μm or less and exhibit a variation coefficient of grain size distribution of 18% or less.

After the above-mentioned grain formation, the silver iodide fine grain emulsion is preferably formed by subjecting to the usual washing described in U.S. Pat. No. 2,614,929 and the like, and the regulation of pH, pI, the concentration of protective colloid agents such as gelatin and the like, and the concentration of silver iodide contained is carried out. It is preferably that pH is 5 or more and 7 or less. The pI value is preferably set at one minimizing the solubility of silver iodide or one higher than the same. Common gelatin having an average molecular weight of about 100 thousand is preferably used as the protective colloid agent. Also, low-molecular-weight gelatin having an average molecular weight of about 20 thousand or less is preferably used. Further, there are occasions in which the use of a mixture of such gelatins having different average molecular weights is advantageous. The gelatin amount per kg of the emulsion is preferably 10 g or more and 100 g or less, and more preferably 20 g or more and 80 g or less. The silver amount based on Ag atom per kg of the emulsion is preferably 10 g or more and 100 g or less, and more preferably 20 g or more and 80 g or less. As the gelatin amount and/or silver amount, a value suitable for abruptly adding the silver iodide fine grain emulsion is preferably selected.

The silver iodide fine grain emulsion is usually dissolved before its addition, and the stirring efficiency of the system at the addition must be adequately enhanced. The rotational rate of stirring is preferably set higher than usual. The addition of a defoaming agent is effective for preventing the generation of foam upon stirring. Specifically, a defoaming agent described in, e.g., Examples of U.S. Pat. No. 5,275,929 can be used. When the fine grains immediately after preparation is used, details concerning a mixer for forming the silver halide fine grains can be referred to in the description of JP-A-10-43570.

The variation coefficient of the silver iodide content distribution of silver halide grains of the present invention is preferably 20% or less, more preferably, 15% or less, and most preferably, 10% or less. If the variation coefficient is larger than 20%, a reduction of the sensitivity upon application of a pressure increases.

The silver iodide content of each grain can be measured by analyzing the composition of the grain by using an X-ray microanalyzer. The variation coefficient of an inter-grain iodide distribution is a value defined by $$(\text{standard deviation}/\text{average silver iodide content})\times 100=\text{variation coefficient}\ (\%)$$

by using the standard deviation of silver iodide contents and the average silver iodide content when the silver iodide contents of at least 100, more preferably, 200, and most preferably, 300 emulsion grains are measured. The measurement of the silver iodide content of each individual grain is described in, e.g., European Patent 147,868. A silver iodide content Yi [mol %] and an equivalent-sphere diameter Xi [μm] of each grain sometimes have a correlation and sometimes do not. However, Yi and Xi desirably have no correlation.

The silver halide emulsion of the present invention is preferably provided with a positive hole-capturing zone in at least a portion of the inside of the silver halide grains. The positive hole-capturing zone referred to in the present invention indicates a region having a function of capturing a positive hole generated in a pair with photo-electron generated by, for example, photo-excitation. Such a positive hole-capturing zone is defined in the present invention as a zone provided by an intentional reduction sensitization.

The intentional reduction sensitization referred to in the present invention means an operation of introducing a positive hole-capturing silver nuclei into a portion or all of the inside of the silver halide grains by adding a reduction sensitizer. The positive hole-capturing silver nuclei means a small silver nuclei having a little development activity, and the recombination loss in a photosensitization process is prevented by the silver nuclei and the sensitivity can be enhanced.

Known examples of reduction sensitizers are stannous salt, ascorbic acid and its derivative, amines and polyamines, a hydrazine derivative, formamidinesulfinic acid, a silane compound, and a borane compound. In reduction sensitization of the present invention, it is possible to selectively use these known reduction sensitizers or to use two or more types of compounds together. Preferred compounds as reduction sensitizers are stannous chloride, thiourea dioxide, dimethylamineborane, and ascorbic acid and its derivative. Although the addition amount of reduction sensitizers must be so selected as to meet the emulsion producing conditions, a preferable amount is $10^{-7}$ to $10^{-3}$ mol per mol of a silver halide.

Reduction sensitizers are dissolved in water or an organic solvent such as alcohols, glycols, ketones, esters, or amides, and the resultant solution is added during grain growth.

In the present invention, the positive hole-capturing silver nuclei is preferably formed by adding a reduction sensitizer after the completion the nucleation and the physical ripening and immediately before the initiation of grain formation. However, the positive hole-capturing silver nuclei can also be introduced on the grain surface by adding a reduction sensitizer on and after the completion of the grain formation.

When a reduction sensitizer is added during grain formation, some silver nuclei formed can stay inside the grain, but some ooze out to form silver nuclei on the grain surface. In the present invention, these oozing silver nuclei can also be utilized as positive hole-capturing silver nuclei.

In the present invention, the intentional reduction sensitization performed during a step in the midst of the grain growth to form the positive hole-capturing nuclei inside the silver halide grain is preferably carried out in the presence of a compound represented by general formula (I-1) or general formula (I-2) described below.

It should be noted that the step in the midst of the grain growth does not include the step after the final desalting is performed. For example, a step of chemical sensitization in which silver halide grains grow as a result of the addition of a silver salt solution and fine grain silver halide, is not included.

General formula (I-1)

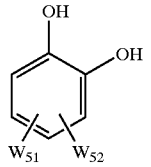

General formula (I-2)

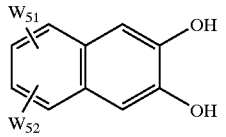

In formulas (I-1) and (I-2), each of $W_{51}$ and $W_{52}$ represents a sulfo group or a hydrogen atom. Provided that at least one of $W_{51}$ and $W_{52}$ represents a sulfo group. A sulfo group is generally an alkali metal salt such as sodium or potassium, or a water-soluble salt such as ammonium salt. Practical examples of preferable compounds are 3,5-disulfocatecholdisodium salt, 4-sulfocatecholammonium salt, 2,3-dihydroxy-7-sulfonaphthalenesodium salt, and 2,3-dihydroxy-6,7-disulfonaphthalenepotassium salt. A preferable addition amount can change in accordance with the temperature, pBr, and pH of a system to which this compound is added, the type and concentration of a protective colloid agent such as gelatin, and the presence/absence, type, and concentration of a silver halide solvent. However, the addition amount is generally 0.005 to 0.5 mol, and more preferably, 0.003 to 0.02 mol, per mol silver halide.

An oxidizer may be used during the process of producing the emulsion of the present invention. The oxidizer is a compound having an effect of acting on metallic silver to thereby convert the same to silver ion. A particularly effective compound is one that converts very fine silver grains, formed as a by-product in the step of forming silver halide grains and the step of chemical sensitization, into silver ions. Each silver ion produced may form a silver salt sparingly soluble in water, such as a silver halide, silver sulfide or silver selenide, or may form a silver salt easily soluble in water, such as silver nitrate. The oxidizer may be either an inorganic or an organic substance. Examples of suitable inorganic oxidizers include ozone, hydrogen peroxide and its adducts (e.g., $NaBO_2.H_2O_2.3H_2O$, $2NaCO_3.3H_2O_2$, $Na_4P_2O_7.2H_2O_2$ and $2Na_2SO_4.H_2O_2.2H_2O$), peroxy acid salts (e.g., $K_2S_2O_8$, $K_2C_2O_6$ and $K_2P_2O_8$), peroxy complex compounds (e.g., $K_2[Ti(O_2)C_2O_4].3H_2O$, $4K_2SO_4.Ti(O_2)OH.SO_4.2H_2O$ and $Na_3[VO(O_2)(C_2H_4)_2].6H_2O$), permanganates (e.g., $KMnO_4$), chromates (e.g., $K_2Cr_2O_7$) and other oxyacid salts, halogen elements such as iodine and bromine, perhalogenates (e.g., potassium periodate), salts of high-valence metals (e.g., potassium hexacyanoferrate (II)) and thiosulfonates.

Examples of suitable organic oxidizers include quinones such as p-quinone, organic peroxides such as peracetic acid and perbenzoic acid and active halogen releasing compounds (e.g., N-bromosuccinimide, chloramine T and chloramine B).

Oxidizers preferred in the present invention are inorganic oxidizers selected from among ozone, hydrogen peroxide and its adducts, halogen elements and thiosulfonates and organic oxidizers selected from among quinones. Thiosulfonates described in, for example, JP-A-2-191938 are most preferable.

The addition of the oxidizer to silver may be performed either before the initiation of the intentional reduction sensitization, or during reduction sensitization, or immediately before the termination of reduction sensitization, or immediately after the termination of reduction sensitization. The addition of the oxidizer to silver may be performed several times separately. The addition amount varies depending on the kind of the oxidizer, it is preferably in the range of $1\times10^{-7}$ to $1\times10^{-3}$ mol per mol of silver halide.

It is advantageous to use gelatin as a protective colloid for use in the preparation of emulsions of the present invention or as a binder for other hydrophilic colloid layers. However, another hydrophilic colloid can also be used in place of gelatin.

Examples of the hydrophilic colloid are protein such as a gelatin derivative, a graft polymer of gelatin and another high polymer, albumin, and casein; cellulose derivatives such as hydroxyethylcellulose, carboxymethylcellulose, and cellulose sulfates; sugar derivatives such as soda alginate and a starch derivative; and a variety of synthetic hydrophilic high polymers such as homopolymers or copolymers, e.g., polyvinyl alcohol, polyvinyl alcohol partial acetal, poly-N-vinylpyrrolidone, polyacrylic acid, polymethacrylic acid, polyacrylamide, polyvinylimidazole, and polyvinyl pyrazole.

Examples of gelatin are lime-processed gelatin, oxidated gelatin, and enzyme-processed gelatin described in Bull. Soc. Sci. Photo. Japan. No. 16, p. 30 (1966). In addition, a hydrolyzed product or an enzyme-decomposed product of gelatin can also be used.

It is preferable to wash an emulsion of the present invention to desalt, and disperse into a newly prepared protective colloid. Although the temperature of washing can be selected in accordance with the intended use, it is preferably 5° C. to 50° C. Although the pH of washing can also be selected in accordance with the intended use, it is preferably 2 to 10, and more preferably, 3 to 8. The pAg of washing is preferably 5 to 10, though it can also be selected in accordance with the intended use. The washing method can be selected from noodle washing, dialysis using a semipermeable membrane, centrifugal separation, coagulation precipitation, and ion exchange. The coagulation precipitation can be selected from a method using sulfate, a method using an organic solvent, a method using a water-soluble polymer, and a method using a gelatin derivative.

In the preparation of the emulsion of the present invention, it is preferable to make salt of metal ion exist, for example, during grain formation, desalting, or chemical sensitization, or before coating in accordance with the intended use. The metal ion salt is preferably added during grain formation when doped into grains, and after grain formation and before completion of chemical sensitization when used to decorate the grain surface or used as a chemical sensitizer. The salt can be doped in any of an overall grain, only the core, the shell, or the epitaxial portion of a grain, and only a substrate grain. Examples of the dopant are Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi. These metals can be added as long as they are in the form of salt that can be dissolved during grain formation, such as ammonium salt, acetate, nitrate, sulfate, phosphate, hydroxide, 6-coordinated complex salt, or 4-coordinated complex salt. Examples are $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$. The ligand of a coordination compound can be selected from halo, aquo, cyano, cyanate, thiocyanate, nitrosyl, thionitrosyl, oxo, and carbonyl. These metal compounds can be used either singly or in the form of a combination of two or more types of them.

The metal compounds are preferably dissolved in an appropriate solvent, such as water, methanol or acetone, and added in the form of a solution. To stabilize the solution, an aqueous hydrogen halogenide solution (e.g., HCl or HBr) or an alkali halide (e.g., KCl, NaCl, KBr, or NaBr) can be added. It is also possible to add acid or alkali if necessary. The metal compounds can be added to a reactor vessel either before or during grain formation. Alternatively, the metal compounds can be added to a water-soluble silver salt (e.g., $AgNO_3$) or an aqueous alkali halide solution (e.g., NaCl, KBr, or KI) and added in the form of a solution continuously during formation of silver halide grains. Furthermore, a solution of the metal compounds can be prepared independently of a water-soluble salt or an alkali halide and added continuously at a proper timing during grain formation. It is also possible to combine several different addition methods.

It is sometimes useful to perform a method of adding a chalcogen compound during preparation of an emulsion, such as described in U.S. Pat. No. 3,772,031. In addition to S, Se and Te, cyanate, thiocyanate, selenocyanate, carbonate, phosphate, or acetate may be present.

In the formation of silver halide grains of the present invention, at least one of chalcogen sensitization including sulfur sensitization and selenium sensitization, noble metal sensitization including gold sensitization and palladium sensitization, and reduction sensitization can be performed at any point during the process of manufacturing a silver halide emulsion. The use of two or more different sensitizing methods is preferable.

Several different types of emulsions can be prepared by changing the timing at which the chemical sensitization is performed. The emulsion types are classified into: a type in which a chemical sensitization nucleus is embedded inside a grain, a type in which it is embedded in a shallow position from the surface of a grain, and a type in which it is formed on the surface of a grain. In emulsions of the present invention, the position of a chemical sensitization speck can be selected in accordance with the intended use.

One chemical sensitization which can be preferably performed in the present invention is chalcogen sensitization, noble metal sensitization, or a combination of these. The sensitization can be performed by using active gelatin as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at pAg 5 to 10, pH 5 to 8, and a temperature of 30° C. to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent 1,315,755.

In the noble metal sensitization, salts of noble metals, such as gold, platinum, palladium, and iridium, can be used. In particular, gold sensitization, palladium sensitization, or a combination of the both is preferred. In the gold sensitization, it is possible to use known compounds, such as chloroauric acid, potassium chloroaurate, potassium aurithiocyanate, gold sulfide, and gold selenide. A palladium compound means a divalent or tetravalent salt of palladium. A preferable palladium compound is represented by $R_2PdX_6$ or $R_2PdX_4$ wherein R represents a hydrogen atom, an alkali metal atom, or an ammonium group and X represents a halogen atom, e.g., a chlorine, bromine, or iodine atom.

More specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that the gold compound and the palladium compound be used in combination with thiocyanate or selenocyanate.

In the present invention, an amount of a gold sensitizer is preferably $1\times10^{-4}$ to $1\times10^{-7}$ mol, and more preferably, $1\times10^{-5}$ to $5\times10^{-7}$ mol per mol of a silver halide. A preferable amount of a palladium compound is $1\times10^{-3}$ to $5\times10^{-7}$ mol per mol of a silver halide. A preferable amount of a thiocyan compound or a selenocyan compound is $5\times10^{-2}$ to $1\times10^{-6}$ mol per mol of a silver halide.

Examples of a sulfur sensitizer are hypo, a thiourea-based compound, a rhodanine-based compound, and sulfur-containing compounds described in U.S. Pat. Nos. 3,857,711, 4,266,018, and 4,054,457. The chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of the chemical sensitization aid and the modifier are described in U.S. Pat. Nos. 2,131,038, 3,411,914, and 3,554,757, JP-A-58-126526, and G. F. Duffin, Photographic Emulsion Chemistry, pages 138 to 143.

In the present invention, an amount of a sulfur sensitizer is preferably $1\times10^{-4}$ to $1\times10^{-7}$ mol, and more preferably, $1\times10^{-5}$ to $5\times10^{-7}$ mol per mol of a silver halide.

Silver halide emulsions of the present invention are preferably subjected to selenium sensitization.

As selenium sensitizers usable in the present invention, selenium compounds disclosed in conventionally known patents can be used. Usually, a labile selenium compound and/or a non-labile selenium compound is used by adding it to an emulsion and stirring the emulsion at a high temperature, preferably 40° C. or more for a predetermined period of time. As non-labile selenium compounds, it is preferable to use compounds described in, e.g., JP-B-44-15748, JP-B-43-13489, and JP-A's-4-25832 and 4-109240, the disclosures of which are incorporated herein by reference.

Practical examples of a labile selenium sensitizer are isoselenocyanates (e.g., aliphatic isoselenocyanates such as allylisoselenocyanate), selenoureas, selenoketones, selenoamides, selenocarboxylic acids (e.g., 2-selenopropionic acid and 2-selenobutyric acid), selenoesters, diacylselenides (e.g., bis(3-chloro-2,6-dimethoxybenzoyl)selenide), selenophosphates, phosphineselenides, and colloidal metal selenium.

Although preferred examples of a labile selenium compound are described above, the present invention is not limited to these examples. It is generally agreed by those skilled in the art that the structure of a labile selenium compound used as a sensitizer for a photographic emulsion is not so important as long as selenium is labile, and that the organic part of a molecule of a selenium sensitizer has no important role except the role of carrying selenium and keeping it in a labile state in an emulsion. In the present invention, therefore, labile selenium compounds in this extensive concept are advantageously used.

Examples of a non-labile selenium compound usable in the present invention are compounds described in JP-B's-46-4553, 52-34491, and 52-34492, the disclosures of which are incorporated herein by reference. Practical examples of a non-labile selenium compound are selenious acid, potassium selenocyanide, selenazoles, quaternary ammonium salts of selenazoles, diarylselenide, diaryldiselenide, dialkylselenide, dialkyldiselenide, 2-selenazolidinedione, 2-selenoxazolidinethione, and derivatives of these compounds.

These selenium sensitizers are dissolved in water, an organic solvent such as methanol or ethanol, or a solvent mixture of such organic solvents, and the resultant solution is added during chemical sensitization, preferably before the start of chemical sensitization. A selenium sensitizer to be used is not limited to one type, but two or more types of the selenium sensitizers described above can be used together. Combining a labile selenium compound and a non-labile selenium compound is preferred.

The addition amount of selenium sensitizers usable in the present invention changes in accordance with the activity of each selenium sensitizer used, the type or grain size of a silver halide, and the temperature and time of ripening. The addition amount, however, is preferably $1\times10^{-8}$ mol or more, more preferably $1\times10^{-7}$ to $5\times10^{-5}$ mol per mol of a silver halide. When selenium sensitizers are used, the temperature of chemical sensitization is preferably 40° C. to 80° C. The pAg and pH can take given values. For example, the effect of the present invention can be obtained in a wide pH range of 4 to 9.

In the present invention, it is preferable to perform the selenium sensitization in combination with one or both of the sulfur sensitization and the noble metal sensitization. Further, it is preferred that thiocyanate is preferably added to the silver halide emulsion at the time of chemical sensitization. As the thiocyanate, potassium thiocyanate, sodium thiocyanate, ammonium thiocyanate and so on are used. Usually, thiocyanate is added as an aqueous solution or by dissolving it to water-soluble solvent. The addition amount thereof is in the range of $1\times10^{-5}$ mol to $1\times10^{-2}$ mol, preferably, in the range of $5\times10^{-5}$ mol to $5\times10^{-3}$ mol, per mol of silver halide.

It is preferred that the silver halide emulsion used in the present invention contains an appropriate amount of calcium ions and/or magnesium ions. Thereby, the graininess, the quality of an image, and the preservation properties are all improved. The appropriate amount noted above is 400 to 2500 ppm for calcium and/or 50 to 2500 ppm for magnesium, and calcium is more preferably 500 to 2000 ppm and magnesium is more preferably 200 to 2000 ppm. It should be noted that 400 to 2500 ppm for calcium and/or 50 to 2500 ppm for magnesium means that at least one of calcium and magnesium is at a concentration within the range mentioned above. When the content of calcium or magnesium is higher than the above range, the calcium salt, magnesium salt, and the organic salt which the gelatin has tend to precipitate, causing a trouble during manufacture of the light-sensitive material. It should be noted that the content of calcium or magnesium corresponds to the weight in terms of calcium or magnesium atom for all calcium- or magnesium-containing containing compounds such as calcium ions, magnesium ions, a calcium salt and a magnesium salt, and expressed in concentration per unit weight emulsion.

The adjustment of the calcium content in the silver halide tabular emulsion used in the present invention is preferably carried out by adding a calcium salt at the time of chemical sensitization. The gelatin generally used for manufacturing an emulsion already contains 100 to 4000 ppm of calcium as a solid gelatin, but the amount of calcium may be increased by adding a calcium salt to the gelatin. Further, if necessary, after carrying out the desalting (removal of calcium) from the gelatin according to a known method such as a water washing or an ion exchange method, the content can be adjusted by the addition of a calcium salt. Preferable calcium salts are calcium nitrate and calcium chloride, with calcium nitrate being most preferable. Similarly, the adjustment of the magnesium content can be carried out by adding a magnesium salt. Preferable magnesium salts are magnesium nitrate, magnesium sulfate and magnesium chloride, with magnesium nitrate being most preferable. For the quantitative determination of calcium or magnesium, an ICP emission spectral analysis method may be used. Calcium and magnesium may be used singly or in combination. It is more preferable that calcium be used. The addition of calcium or magnesium can be carried out at the arbitrary period during manufacture of the silver halide emulsion, but is preferably carried out at the period of after the grain formation and immediately after completion of the spectral sensitization and chemical sensitization, and more preferably carried out after addition of a sensitizing dye. Further, it is most preferably carried out after the addition of a sensitizing dye and before carrying out the chemical sensitization.

As an example of a particularly useful compound for reducing the fog of the silver halide emulsion and suppressing the increase of the fog during preservation, a mercaptotetrazol compound having a water-soluble group described in JP-A-4-16838 is provided. Further, in the JP-A document, it is disclosed that the preservation property is enhanced by using the mercaptotetrazol compound and a mercaptothiadiazol compound in combination.

The surface or an arbitrary position from the surface of the grain contained in the emulsion used in the present invention may be chemically sensitized, but it is preferable to chemically sensitize the surface. When the inside portion of the grain is chemically sensitized, a method described in JP-A-63-264740 can be referred to.

Various compounds can be contained in the photographic emulsion used in the present invention in order to prevent fog in the step of manufacturing a lightsensitive material, during preservation, or during photographic processing, or to stabilize photographic performance. Namely, various compounds which were known as an antifoggant or a stabilizer, such as thiazoles (e.g., benzothiazolium salt); nitroimidazoles; nitrobenzimidazoles; chlorobenzimidazoles; bromobenzimidazoles; mercaptothiazoles; mercaptobenzothiazoles; mercaptobenzimidazoles; mercaptothisdiazoles; aminotriazoles; benzotriazoles; nitrobenzotriazoles; mercaptotetrazoles (particularly 1-phenyl-5-mercaptotetrazole); mercaptopyrimidines; mercaptotriazines; a thioketo compound such as oxadolinethione; azaindenes, for example, triazaindenes, tetrazaindenes (particularly hydroxy-substituted(1,3,3a,7)tetrazaindenes), and pentazaindenes can be added.

For example, compounds described in U.S. Pat. Nos. 3,954,474 and 3,982,947, and JP-B-52-28660 can be used. One preferable compound is described in JP-A-63-212932. Antifoggants and stabilizers can be added at any of several different timings such as before, during and after grain formation, during washing with water, during dispersion after washing, before, during and after chemical sensitization, and before coating, in accordance with the intended application. The antifoggants and stabilizers can be added during preparation of an emulsion to achieve their original fog preventing effect and stabilizing effect, and in addition, can be used for various purposes of controlling crystal habit, decreasing a grain size, decreasing the solubility of grains, controlling chemical sensitization, controlling the arrangement of dyes, and the like.

Photographic emulsions used in the present invention can achieve high color saturation when spectrally sensitized by preferably methine dyes and the like. Usable dyes involve a cyanine dye, merocyanine dye, composite cyanine dye, composite merocyanine dye, holopolar cyanine dye, hemicyanine dye, styryl dye, and hemioxonole dye. Most useful dyes are those belonging to a cyanine dye, merocyanine dye, and composite merocyanine dye. These dyes can contain any nucleus commonly used as a basic heterocyclic nucleus in cyanine dyes. Examples are a pyrroline nucleus, oxazoline nucleus, thiazoline nucleus, pyrrole nucleus, oxazole nucleus, thiazole nucleus, selenazole nucleus, imidazole nucleus, tetrazole nucleus, and pyridine nucleus; a nucleus in which an aliphatic hydrocarbon ring is fused to any of the above nuclei; and a nucleus in which an aromatic hydrocarbon ring is fused to any of the above nuclei, e.g., an indolenine nucleus, benzindolenine nucleus, indole nucleus, benzoxadole nucleus, naphthoxazole nucleus, benzthiazole nucleus, naphthothiazole nucleus, benzoselenazole nucleus, benzimidazole nucleus, and quinoline nucleus. These nuclei can be substituted on a carbon atom.

It is possible to apply to a merocyanine dye or a composite merocyanine dye a 5- or 6-membered heterocyclic nucleus as a nucleus having a ketomethylene structure. Examples are a pyrazoline-5-one nucleus, thiohydantoin nucleus, 2-thiooxazolidine-2,4-dione nucleus, thiazolidine-2,4-dione nucleus, rhodanine nucleus, and thiobarbituric acid nucleus.

Although these sensitizing dyes can be used singly, they can also be combined. The combination of sensitizing dyes is often used for a supersensitization purpose. Representative examples of the combination are described in U.S. Pat. Nos. 2,688,545, 2,977,229, 3,397,060, 3,522,0523, 3,527,641, 3,617,293, 3,628,964, 3,666,480, 3,672,898, 3,679,4283, 3,703,377, 3,769,301, 3,814,609, 3,837,862, and 4,026,707, British Patents 1,344,281 and 1,507,803, JP-B's-43-4936 and 53-12375, and JP-A's-52-110618 and 52-109925, the disclosures of which are incorporated herein by reference.

In addition to sensitizing dyes, emulsions can contain dyes having no spectral sensitizing effect or substances not substantially absorbing visible light and presenting supersensitization.

Sensitizing dyes can be added to an emulsion at any point conventionally known to be useful during the preparation of an emulsion. Most ordinarily, sensitizing dyes are added after the completion of chemical sensitization and before coating. However, it is possible to perform the addition simultaneously with the addition of chemical sensitizing dyes to thereby perform spectral sensitization and chemical sensitization at the same time, as described in U.S. Pat. Nos. 3,628,969 and 4,225,666, the disclosures of which are incorporated herein by reference. It is also possible to perform the addition prior to chemical sensitization, as described in JP-A-58-113928, the disclosure of which is incorporated herein by reference, or before the completion of the formation of a silver halide grain precipitate to thereby start spectral sensitization. Alternatively, as disclosed in U.S. Pat. No. 4,225,666, these sensitizing dyes can be added separately; a portion of the sensitizing dyes is added prior to chemical sensitization, and the rest is added after that. That is, sensitizing dyes can be added at any timing during the formation of silver halide grains, including the method disclosed in U.S. Pat. No. 4,183,756, the disclosure of which is incorporated herein by reference.

The addition amount thereof can be in the range of $4\times10^{-6}$ to $8\times10^{-3}$ mol per mol of silver halides.

The silver halide grains other than the tabular grains used in the lightsensitive material of the present invention will be described below.

Preferred silver halide grain composition contained in photographic emulsion layers of the photographic material of the present invention is a silver iodobromide, silver iodochloride or silver iodochlorobromide containing about 30 mol % or less of silver iodide. Especially preferred silver halide grain composition is a silver iodobromide or silver iodochlorobromide containing about 1 to about 10 mol % of silver iodide.

Silver halide grains contained in each photographic emulsion may be those having regular crystals such as cubic, octahedral or tetradecahedral crystals, those having regular crystal form such as spherical or tabular crystal form, those having crystal defects such as twin faces, or composite forms thereof.

The silver halide grains may consist of fine grains having an equivalent-circle diameter of about 0.2 $\mu$m or less, or large grains having a projected area diameter of up to about 10 $\mu$m. The emulsion may be a polydisperse or monodisperse emulsion.

The silver halide photographic emulsion which can be used in the present invention can be prepared by methods described in, e.g., Research Disclosure (RD) No. 17643 (December, 1978), pp. 22 and 23, "I. Emulsion preparation and types"; RD No. 18716 (November, 1979), page 648; RD No. 307105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

It is also preferred to use monodisperse emulsions described in U.S. Pat. Nos. 3,574,628 and 3,655,394 and GB No. 1,413,748.

The crystal structure can be uniform, can have halogen compositions which are different between the inner part and the outer part thereof, or can be a layered structure. Alternatively, by an epitaxial junction, each silver halide grain can be bonded with a silver halide having a different composition, or can be bonded with a compound other than silver halide such as silver rhodanide or lead oxide. A mixture of grains having various crystal forms can also be used.

The above emulsion may be any of the surface latent image type in which latent images are mainly formed in the surface, the internal latent image type in which latent images are formed in the internal portion of grains and the type in which latent images exist in both the surface and the internal portion of grains. However, it is requisite that the emulsion be a negative type. The emulsion of the internal latent image type may specifically be, for example, a core/shell internal-latent-image type emulsion described in JP-A-63-264740. The process for producing the core/shell internal-latent-image type emulsion is described in JP-A-59-133542. The thickness of the shell of this emulsion, although varied depending on development processing, etc., is preferably in the range of 3 to 40 nm, more preferably 5 to 20 nm.

Silver halide grains having a grain surface fogged as described in U.S. Pat. No. 4,082,553, silver halide grains having a grain internal portion fogged as described in U.S. Pat. No. 4,626,498 and JP-A-59-214852 and colloidal silver can preferably be used in lightsensitive silver halide emulsion layers and/or substantially nonlightsensitive hydrophilic colloid layers. The expression "silver halide grains having a grain surface or grain internal portion fogged" refers to silver halide grains which can be developed uniformly (nonimagewise) irrespective of the nonexposed or exposed zone of lightsensitive material. The process for producing the silver halide grains having a grain surface or grain internal portion fogged is described in U.S. Pat. No. 4,626,498 and JP-A-59-214852.

The silver halides constituting internal nuclei of core/shell silver halide grains having a grain internal portion fogged may have identical halogen composition or different halogen compositions. Any of silver chloride, silver chlorobromide, silver iodobromide and silver chloroiodobromide can be used as the composition of silver halide grains having a grain surface or grain internal portion fogged. Although the grain size of these fogged silver halide grains is not particularly limited, it is preferred that the equivalent sphere diameter thereof be in the range of 0.01 to 0.75 $\mu$m, especially 0.05 to 0.6 $\mu$m. With respect to grain configuration, although there is no particular limitation and both regular grains and a polydisperse emulsion can be used, monodispersity (at least 95% of the weight or number of silver halide grains have grain sizes falling within ±40% of the average grain size) is preferred.

In the lightsensitive material of the present invention, a mixture of a plurality of lightsensitive silver halide emulsions which are different from each other in at least one of the properties including grain size, grain size distribution, halide composition, grain configuration and sensitivity can be used in forming any single layer.

In the preparation of the photographic light-sensitive material of the present invention, a photographically useful substance is usually added to a photographic coating solution, i.e., a hydrophilic colloidal solution. In the silver halide photographic emulsion of the present invention and the silver halide photographic light-sensitive material using such an emulsion, it is generally possible to use various techniques and inorganic and organic materials described in Research Disclosure Nos. 308119 (1989), 37038 (1995), and 40145 (1997).

In addition, techniques and inorganic and organic materials usable in color photographic light-sensitive materials to which silver halide photographic emulsions of the present invention can be applied are described in portions of EP436, 938A2 and patents cited below, the disclosures of which are herein incorporated by reference.

| Items | Corresponding portions |
|---|---|
| 1) Layer configurations | page 146, line 34 to page 147, line 25 |
| 2) Silver halide emulsions usable together | page 147, line 26 to page 148 line 12 |
| 3) Yellow couplers usable together | page 137, line 35 to page 146, line 33, and page 149, lines 21 to 23 |
| 4) Magenta couplers usable together | page 149, lines 24 to 28; EP421, 453A1, page 3, line 5 to page 25, line 55 |
| 5) Cyan couplers usable together | page 149, lines 29 to 33; EP432, 804A2, page 3, line 28 to page 40, line 2 |
| 6) Polymer couplers | page 149, lines 34 to 38; EP435, 334A2, page 113, line 39 to page 123, line 37 |
| 7) Colored couplers | page 53, line 42 to page 137, line 34, and page 149, lines 39 to 45 |
| 8) Functional couplers usable together | page 7, line 1 to page 53, line 41, and page 149, line 46 to page 150, line 3; EP435, 334A2, page 3, line 1 to page 29, line 50 |
| 9) Antiseptic and mildewproofing agents | page 150, lines 25 to 28 |
| 10) Formalin scavengers | page 149, lines 15 to 17 |
| 11) Other additives usable together | page 153, lines 38 to 47; EP421, 453A1, page 75, line 21 to page 84, line 56, and page 27, line 40 to page 37, line 40 |
| 12) Dispersion methods | page 150, lines 4 to 24 |
| 13) Supports | page 150, lines 32 to 34 |
| 14) Film thickness · film physical properties | page 150, lines 35 to 49 |
| 15) Color development step | page 150, line 50 to page 151, line 47 |
| 16) Desilvering step | page 151, line 48 to page 152, line 53 |
| 17) Automatic processor | page 152, line 54 to page 153, line 2 |
| 18) Washing · stabilizing step | page 153, lines 3 to 37 |

The light-sensitive material of the present invention can be applied also for a light-sensitive material having a transparent magnetic recording layer. A transparent magnetic recording layer and material technologies coming therewith as well as a light-sensitive material used in Advanced Photo System, its treatment method and its practical applications after the treatment are described in detail in U.S. Pat. No. 6,220,744, col. 18, line 39 to col. 23, line 45.

The silver halide color photographic light-sensitive material of the present invention is a color reversal photographic light-sensitive material which is designed to be subjected to a color reversal treatment including black-and-white development, followed by reversal treatment and color development.

The following is a general explanation about the color reversal treatment of the present invention. Firstly, the black-and-white development bath (1st development) which is the first step will be described.

A developing agent which has heretofore been known may be used for the preparation of a black-and-white developer. As the developing agent there may be used dihydroxybenzene (e.g., hydroquinone, hydroquinone monosulfonate), 3-pyrazolidone (e.g., 1-phenyl-3-pyrazolidone, 1-phenyl-4-methyl-4-hydroxymethyl-3pyrazolidone), aminophenol (e.g., N-methyl-paminophenol, N-methyl-3-methyl-p-aminophenol), ascorbic acid and isomer or derivative thereof, singly or in combination. A preferred developing agent is potassium hydroquinonemonosulfonate or sodium hydroquinonemonosulfonate. The amount of such a developing agent to be added is about from $1\times10^{-5}$ to 2 mol per liter of the developer.

The black-and-white developer may comprise a preservative incorporated therein as necessary. As such a preservative there may be normally used a sulfite or bisulfite. The amount of such a preservative to be added is from 0.01 to 1 mol/L, preferably from 0.1 to 0.5 mol/L. Ascorbic acid is also a useful preservative. A preferred amount of ascorbic acid to be added is from 0.01 mol/L to 0.5 mol/L. Besides these preservatives, hydroxylamines, saccharides, o-hydroxyketones and hydrazines represented by general formula (I) described in JP-A-3-144446, etc. may be used. The amount of such a preservative to be added is not greater than 0.1 mol/L.

The pH value of the black-and-white developer is preferably from 8 to 12, and optimally from 9 to 11. The black-and-white developer may comprise various buffers incorporated therein to maintain a desired pH value. Preferred examples of the buffer include carbonate, phosphate, borate, 5-sulfosalicylate, hydroxybenzoate, glycine salt, N,N-dimethylglycine salt, leucine salt, norleucine salt, guanine salt, 3,4-dihydroxyphenylalanine salt, alanine salt, aminobutyrate, valine salt, lysine salt, etc. In particular, the use of carbonate, borate or 5-sulfosalicylate is desirable because the foregoing pH range can be kept and these preservatives are inexpensive. These buffers may be used singly or in combination of two or more thereof. In order to obtain a desired pH value, the black-and-white developer may comprise an acid and/or alkali incorporated therein.

As such an acid there may be used an inorganic or organic water-soluble acid, examples of which include sulfuric acid, nitric acid, hydrochloric acid, acetic acid, propionic acid, ascorbic acid, etc. As the alkali there may be used any hydroxide or ammonium salt, examples of which include potassium hydroxide, sodium hydroxide, aqueous ammonia, triethanolamine, diethanolamine, etc.

Further, the black-and-white developer used in the present invention preferably comprises as a development accelerator a silver halide solvent incorporated therein. Preferred examples of such a silver halide solvent include thiocyanate, sulfite, thiosulfate, 2-methylimidazole, thioether-based compound described in JP-A-57-63580. The amount of such a compound to be added is preferably from about 0.005 to 0.5 mol/L.

Other examples of the development accelerator include various quaternary amines, polyethylene oxides, 1-phenyl-3-pyrazolidones, primary amines, N,N,N',N'-tetramethyl-p-phenylenediamine, etc.

Moreover, the black-and-white developer used in the present invention may comprise as a dissolution aid diethylene glycol, propylene glycol, polyethylene glycols or amines such as diethanolamine and triethanolamine. The black-and-white developer may comprise as a sensitizer a quaternary ammonium salt. The black-and-white developer may comprise various surface active agents or hardeners.

The black-and-white development bath may comprise various fog inhibitors incorporated therein for the purpose of inhibiting development fog. Preferred examples of the fog inhibitor include halide of alkaline metal such as sodium chloride, potassium chloride, potassium bromide, sodium bromide and potassium iodide, and organic fog inhibitor. Examples of the organic fog inhibitor employable herein include nitrogen-containing heterocyclic compound such as benzotriazole, 6-nitrobenzimidazole, 5-nitrosoindazole, 5-methylbenzotriazole, 5-nitrobenzotriazole, 5-chlorobenzotriazole, 2-thiazolyl-benzimidazole, 2-thiazolylbenzimidazole and hydroxyazaindolizine, mercaptosubstituted heterocyclic compound such as 1-phenyl-5-mercaptotetrazole, 2-mercaptobenzoimidazole and 2-mercaptobenzothiazole, and mercapto-substituted aromatic compound such as thiosalicylic acid. These fog inhibitors may include those which are eluted from the color reversal light-sensitive material during processing and accumulated in the developer.

Among these fog inhibitors, iodide is added in an amount of from about $5\times10^{-6}$ to $5\times10^{-4}$ mol/L. A bromide is preferably used to inhibit fog. The bromide is added preferably in a concentration of from about 0.001 mol/L to 0.1 mol/L, particularly from about 0.01 mol/L to 0.05 mol/L.

Further, the black-and-white developer of the present invention may comprise a swelling inhibitor (e.g., inorganic salt such as sodium sulfate and potassium sulfate) or water softener. As such a water softener there may be used a compound having any structure such as aminopolycarboxylic acid, aminopolyphosphonic acid, phosphonocarboxylic acid, organic phosphonic acid and inorganic phosphonic acid. These water softeners are specifically exemplified by, but are not limited to, those listed below.

Ethylenediaminetetraacetic acid, nitrilotriacetic acid, hydroxyethyliminodiacetic acid, propylenediaminetetraacetic acid, diethylenetriaminepentaacetic acid, triethylenetetraminehexaacetic acid, nitrilo-N,N,N-trimethylenephosphonic acid, ethylenediamine-N,N,N',N'-tetr-amethylenephosphonic acid, and 1-hydroxyethylidene-1,1-diphosphonic acid. Two or more of these water softeners may be used in combination. The preferred amount of such a water softener to be used is preferably from 0.1 g to 20 g/L, and more particularly from 0.5 g to 10 g/L.

The standard processing time of the black-and-white development is 6 minutes. By properly changing the processing time, sensitization or desensitization can be effected. In general, the processing time is varied from 2 to 18 minutes. The processing temperature is from 20° C. to 50° C., and preferably from 33° C. to 45° C. The black-and-white developer to be replenished is from about 100 mL to 5000 mL, and preferably from about 200 mL to 2500 mL per $m^2$ of color reversal film.

In the treatment of the present invention, the black-and-white development is optionally followed by water washing which is optionally further followed by rinsing. Thereafter, the material is processed at the reversal processing step followed by color development. The water washing or rinsing bath may consist of one bath but may employ a multistage countercurrent process involving two or more baths for the purpose of lowering the replenished amount. The water washing process involves replenishment with a relatively large amount of water while the rinsing process involves replenishment in an amount reduced to the level of other processing baths. The replenishment rate of washing water is preferably from about 3 L to 20 L per $m^2$ of photographic light-sensitive material. The replenishment rate of rinsing bath is preferably from about 50 mL to 2 L, more preferably from about 100 mL to 500 mL which means that the amount of water to be used can be drastically reduced as compared with the water washing step. The rinsing bath may comprise an oxidizing agent, a chelating agent, a buffer, a germicide, a fluorescent brightening agent, etc. incorporated therein as necessary.

Subsequently, the photographic light-sensitive material is passed to the reversal bath or optical fogging step. The reversal bath may comprise as a chemical fogging agent a known fogging agent, i.e., stannous ion complex salt such as stannous ion-organic phosphoric acid complex salt (U.S. Pat. No. 3,617,282), stannous ion-organic phosphonocarboxylic acid complex salt (JP-B-56-32616) and stannous ion-aminopolycarboxylic acid complex salt (U.S. Pat. No. 1,209,050), stannous ion complex of chelating agent of the general formula (II) or (III) described in JP-A-11-109573, boron compound such as hydrogenated boron compound (U.S. Pat. No. 2,984,567) and heterocyclic amine borane compound (British Patent No. 1,011,000). The pH value of the reversal bath ranges widely from acidity to alkalinity depending on the kind of the fogging agent used. The pH value of the reversal bath is from 2 to 12, generally from 2.5 to 10, particularly from 3 to 9.

The concentration of stannous ion (II) in the reversal bath is from $1\times10^{-3}$ mol/L to $5\times10^{-2}$ mol/L, preferably from $2\times10^{-3}$ mol/L to $1.5\times10^{-2}$ mol/L. Moreover, the reversal bath preferably comprises propionic acid, acetic acid or an alkylenedicarboxylic acid compound described in the general formula (I) in JP-A-11-109572 incorporated therein to enhance the solubility of tin (II) chelate. Further, the reversal bath preferably comprises as a germicide a sorbitate or quaternary ammonium compound described in U.S. Pat. No. 5,811,225 incorporated therein.

The reversal time is from 10 seconds to 3 minutes, preferably from 20 seconds to 2 minutes, more preferably from 30 seconds to 90 seconds. The reversal bath temperature is equal to or within the temperature of any of the 1st development bath, subsequent rinsing or water washing bath and color development bath, i.e., normally from 20° C. to 50° C., preferably from 33 to 45° C. The replenishment rate at the reversal bath is from 10 to 2000 mL, preferably from 200 to 1500 mL per $m^2$ of light-sensitive material.

Since the tin (II) chelate in the reversal bath exerts its effect over a wide pH range, it is not particularly necessary that a pH buffer be added to the reversal bath. However, this doesn't prevent an acid, alkali or salt for providing pH buffer capacity such as organic acid (e.g., citric acid and malic acid), inorganic acid (e.g., boric acid, sulfuric acid, hydrochloric acid), carbonic acid alkali, caustic alkali, borax and potassium metaborate from being added to the reversal bath. Further, if necessary, the reversal bath may comprise a water softener such as aminopolycarboxylic acid, a swelling inhibitor such as sodium sulfate or an oxidation inhibitor such as p-aminophenol incorporated therein.

Following the treatment in the reversal bath, a color development step is conducted. The color developer used in the color development treatment of the present invention is an alkaline aqueous solution comprising an aromatic primary amine-based color developing agent incorporated therein as a main component. As such a color developing agent, a p-phenylenediamine-based compound is preferably used. Representative examples of the p-phenylenediamine-based compound include 3-methyl-4-amino-N,N-diethylaniline, 3-methyl-4-amino-N-ethyl-N-β-hydroxyethylaniline, 3-methyl-4-amino-N-ethyl-N-β-methanesulfonamideethylaniline, 3-methyl-4-amino-N-ethyl-N-N-β-methoxyethylaniline, sulfate, hydrochloride and phosphate thereof, p-toluenesulfonate, tetraphenylborate, p-(t-octyl)benzenesulfonate, etc. Two or more of these developing agents may be used in combination as necessary. The amount of the developing agent to be added is from about 0.005 mol/L to 0.1 mol/L, and preferably from about 0.01 mol/L to 0.05 mol/L.

The pH value of the color developer of the present invention is preferably from 8 to 13, most preferably from 10.0 to 12.5, and particularly preferably from 11.5 to 12.3. In order to maintain this pH range, various buffers may be used.

Examples of the buffer having a buffering capacity at pH of not lower than 8.0 include carbonate, phosphate, borate, 5-sulfosalicylate, leucine salt, norleucine salt, guanine salt, 3,4-dihydroxyphenylalanine salt, alanine salt, aminobutyrate, 2-amino-2-methyl-1,3-propanediol salt, valine salt, proline salt, trishydroxyaminomethane salt, lysine salt, etc. In particular, carbonate, phosphate and 5-sulfosalicylate are advantageous in that they are excellent in solubility and buffering capacity in a pH range as high as not lower than 10.0, have no adverse effects (e.g., stain) on the photographic properties even when added to the color developer and are inexpensive. Thus, these buffers are preferably used in particular.

Specific examples of these buffers include sodium carbonate, potassium carbonate, sodium bicarbonate, potassium bicarbonate, trisodium phosphate, tripotassium phosphate, disodium phosphate, dipotassium phosphate, dipotassium 5-sulfosalicylate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), potassium 5-sulfo-2-hydroxybenzoate (potassium 5-sulfosalicylate), etc. Preferred among these buffers are trisodium phosphate, tripotassium phosphate, disodium phosphate, disodium phosphate, dipotassium 5-sulfosalicylate, and disodium 5-sulfosalicylate. These buffers may be added to the color developer, singly or in combination of two or more thereof. The color developer can be adjusted to a desired pH range with an alkaline agent or acid.

The amount of the buffer to be added to the color developer (in total when a plurality of buffers are used in combination) is preferably not smaller than 0.1 mol/L, particularly from 0.1 mol/L to 0.4 mol/L.

The color developer may be used in combination with various development accelerators as necessary. Examples of the development accelerator employable herein include various pyridinium compounds as described in U.S. Pat. No. 2,648,604, JP-B-44-9503 and U.S. Pat. No. 3,171,247, other cationic compounds, cationic dyes such as phenosafranine, natural salts such as thallium nitrate and potassium nitrate, polyethylene glycol and derivatives thereof as described in JP-B-44-9304, U.S. Pat. No. 2,533,990, 2,531,832, 2,950,970 and 2,577,127, nonionic compounds such as polythioethers, and thioether-based compounds as described in U.S. Pat. No. 3,201,242.

If necessary, the color developer may comprise benzyl alcohol or its solvent such as diethylene glycol, triethanolamine and diethanolamine incorporated therein. Taking into account the environmental burden, solubility thereof, production of tar, etc., however, the use of these solvents is preferably minimized.

The color developer may comprise the same silver halide solvent as used in the black-and-white developer. Examples of the silver halide solvent employable herein include thiocyanate, 2-methylimidazole, thioether-based compounds as described in JP-A-57-63580, etc. Particularly preferred among these silver halide solvents is 3,6-dithiaoctane-1,8-diol.

The color developer does not need to have an effect of inhibiting development fog. However, in the case where the color film is running with replenishment, the color developer may comprise various fog inhibitors incorporated therein for the purpose of maintaining the invariability of the formulation and properties thereof. Preferred examples of the fog inhibitor to be used at these development steps include halide of alkaline metal such as potassium chloride, sodium chloride, potassium bromide, sodium bromide and potassium iodide, and organic fog inhibitor. Examples of the organic fog inhibitor employable herein include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolyl-benzimidazole, 2-thiazolylbenzimidazole and hydroxyazaindolizine, mercapto-substituted heterocyclic compounds such as 1-phenyl-5-mercaptotetrazole, 2-mercaptobenzimidazole and 2-mercaptobenzothiazole, and mercapto-substituted aromatic compounds such as thiosalicylic acid. These fog inhibitors may include those which are eluted from the color reversal light-sensitive material during processing and accumulated in the developer.

The color developer according to the present invention may comprise various preservatives. Representative examples of the preservative employable herein include hydroxylamines and sulfites. Preferred among these preservatives are sulfites. The amount of the preservative to be added is from about 0 to 0.1 mol/L.

The color developer to be used in the present invention may occasionally comprise an organic preservative instead of the foregoing hydroxylamines or sulfites. The term "organic preservative" as used herein generically means an organic compound which reduces the deterioration rate of the aromatic primary amine color developing agent when added to the processing solution for color photographic light-sensitive material. In other words, an organic compound capable of inhibiting the oxidation of color developing agent by air or the like may be used. In particular, hydroxylamine derivatives (excluding hydroxylamine), hydroxamic acids, hydrazines, hydrazides, phenols, α-hydroxyketones, α-aminoketones, saccharides, monoamines, diamines, polyamines, quaternary ammonium salts, nitroxyradcials, alcohols, oxims, diamide compounds, condensed ring type amines, etc. are useful organic preservatives. These organic preservatives are disclosed in JP-B-48-30496, JP-A's-52-143020, 63-4235, 63-30845, 63-21647, 63-44655, 63-53551, 63-43140, 63-56654, 63-58346, 63-43138, 63-146041, 63-44657, and 63-44656, U.S. Pat. No. 3,615,503 and 2,494,903, JP-A's-1-97953, 1-186939, 1-186940, 1-187557 and 2-306244, etc. As other preservatives there may be used various metals as described in JP-A's-57-44148 and 57-53749, salicylic acids as described in JP-A-59-180588, amines as described in JP-A's-63-239447, 63-128340, 1-186939 and 1-187557, alkanolamines as described in JP-A-54-3532, polyethyleneimines as described in JP-A-56-94349, aromatic polyhydroxy compounds as described in U.S. Pat. No. 3,746,544, etc. as necessary. In particular, alkanolamines such as triethanolamine, dialkylhydroxylamines such as N,N-diethylhydroxylamine and N,N-di(sulfoethyl) hydroxylamine, hydrazine derivatives (excluding hydrazine) such as N,N-bis(carboxymethyl)hydrazine or aromatic polyhydroxy compounds such as sodium catechol-3,5-disulfonate are preferably added.

The amount of such an organic preservative to be added is preferably from about 0.02 mol/L to 0.5 mol/L, more preferably from about 0.05 mol/L to 0.2 mol/L. If necessary, two or more of these organic preservatives may be used in combination.

The color developer according to the present invention may further comprise other ingredients incorporated therein such as organic solvent (e.g., diethylene glycol, triethylene glycol), competing coupler (e.g., dye-forming coupler, citrazinic acid, J acid, H acid), nucleator (e.g., sodium boron hydride), auxiliary developing agent (e.g., 1-phenyl-3-pyrazolidone), thickening agent and chelating agent (e.g., aminopolycarboxylic acid such as ethylenediaminetetraacetic acid, nitrilotriacetic acid, cyclohexanediaminetetraacetic acid, hydroxyethyliminodiacetic acid, iminodiacetic acid, N-hydroxymethylethylenediaminetriacetic acid, diethylenetriaminepentaacetic acid, triethylenetetraminehexaacetic acid and compound described in Japanese Patent Laid-Open No. 1983-195845, aminophosphonic acid such as 1-hydroxyethylidene-1,1'-diphosphonic acid, organic phosphonic acid described in Research Disclosure No. 18170 (May 1979), aminotris(methylenephosphonic acid), ethylenediamine-N,N,N',N'-tetramethy-lenephosphonic acid, phosphonocarboxylic acid described in JP-A's-52-102726, 53-42730, 54-121127, 55-4024, 55-4025, 55-126241, 55-65955, 55-65956, and Research Disclosure No. 18170 (May 1979)). The amount of the chelating agent to be added is from about 0.05 g/L to 20 g/L, preferably from about 0.1 g/L to 5 g/L. If necessary, two or more of these chelating agents may be used in combination. The color developer may comprise various surface active agents such as alkylsulfonic acid, arylsulfonic acid, aliphatic carboxylic acid and aromatic carboxylic acid polyalkyleneimine incorporated therein as necessary.

The processing temperature with the color developer applicable to the present invention is from 20 to 50° C., preferably from 33 to 45° C. The processing time is from 20 seconds to 10 minutes, preferably from 2 minutes to 6 minutes. The replenishment rate at the color development step is preferably minimized so far as the desired activity can be maintained. In practice, however, the replenishment rate is preferably from 100 mL to 3000 mL, more preferably from 400 mL to 2200 mL per $m^2$ of light-sensitive material.

The color reversal light-sensitive material which has been subjected to color development is then subjected to desilvering. Desilvering is normally effected in any of the following processes.

1. (Color development) - Compensating - Bleaching - Fixing
2. (Color development) - Washing - Bleaching - Fixing
3. (Color development) - Bleaching - Fixing
4. (Color development) - Washing - Bleaching - Washing Fixing
5. (Color development) - Bleaching - Washing - Fixing
6. (Color development) - Washing - Bleach-fix
7. (Color development) - Compensating - Bleach-fix
8. (Color development) - Bleach-fix
9. (Color development) - Washing - Bleaching - Bleach-fix
10. (Color development) - Bleaching - Bleach-fix
11. (Color development) - Washing - Bleaching - Bleach-fix - Fixing Above all, 1, 2, 3, and 7 are preferred.

The replenishment in the foregoing processing steps may be carried out by replenishing the various processing baths with the respective replenishers. Alternatively, in the steps 9 and 10, the overflow solution from the bleach bath may be introduced into the blix (bleach-fix) bath which is replenished with the fixing solution composition alone. Alternatively, in the step 11, the overflow solution from the bleach bath may be introduced into the blix bath into which the overflow solution from the fixing bath is introduced in a countercurrent process so that both the two processing solutions overflow from the blix bath.

As the bleaching agent to be used in the bleach bath or blix bath there is most normally used an aminopolycarboxylic acid-iron (III) complex salt. Representative examples of such an aminopolycaroxylic acid and salt thereof include the following compounds.

| | |
|---|---|
| A-1 | Ethylenediaminetetraacetic acid |
| A-2 | Ethylenediamine-N,N,N',N'-tetraacetic acid disodium salt |
| A-3 | Ethylenediamine-N,N,N',N'-tetraacetic acid diammonium salt |
| A-4 | Diethylenetriamine-N,N,N',N",N"-pentaacetic acid |
| A-5 | Cyclohexanediaminetetraacetic acid |
| A-6 | Cyclohexanediaminetetraacetic acid disodium salt |
| A-7 | Iminodiacetic acid |
| A-8 | 1,3-diaminopropanetetraacetic acid |
| A-9 | Methyliminodiacetic acid |
| A-10 | Hydroxyethyliminodiacetic acid |
| A-11 | Glycol ether diaminetetraacetic acid |
| A-12 | Ethylenediaminetetrapropionic acid |
| A-13 | N-(2-carboxyethyl)-iminodiacetic acid |
| A-14 | ethylenediaminedipropionic acid |
| A-15 | β-alaninediacetic acid |
| A-16 | Ethylenediaminedimalonic acid |
| A-17 | Ethylenediaminedisuccinic acid |
| A-18 | Propylenediaminedisuccinic acid |

The ferric complex salt of aminopolycarboxylic acid may be used in the form of complex salt. Alternatively, a ferric salt and an aminopolycarboxylic acid may together form a ferric ion complex salt in the solution. Further, one or more aminopolycarboxylic acids may be used. In any case, an aminopolycarboxylic acid may be used in an amount of greater than required to form a ferric ion complex salt.

The bleach solution or blix solution containing the foregoing ferric ion complex may comprise a complex salt of metal such as cobalt and copper other than iron incorporated therein.

The amount of such a bleaching agent to be added is preferably from 0.02 mol to 0.5 mol, and more preferably from 0.05 mol to 0.3 mol per liter of the bath having a bleaching capability.

The bleach bath or blix bath of the present invention may comprise various blix accelerators incorporated therein. Examples of such a blix accelerator include various mercapto compounds as described in U.S. Pat. No. 3,893,858, British Patent No. 1,138,842, and JP-A-53-141623, compounds having disulfide bond as described in JP-A-53-95630, thiazolidine derivatives as described in JP-A-53-9854, isothiourea derivatives as described in JP-A-53-94927, thiourea derivatives as described in JP-A-45-8506 and JP-B-49-26586, thioamide compounds as described in JP-A-49-42349, dithiocarbaminates as described in JP-A-55-26506, etc. Further examples of the bleach accelerator include alkylmercapto compounds which may be unsubstituted or substituted by hydroxyl group, carboxyl group, sulfonic acid group, amino group (which may have substituents such as alkyl group and acetoxyalkyl group) or the like. Examples of these alkylmercapto compounds include trithioglycerin, α,α'-thiodipropionic acid, δ-mercaptobutyric acid, etc. Moreover, compounds as described in U.S. Pat. No. 4,552,834 may be used.

The amount of the compound having mercapto group or disulfide bond in its molecule, thiazoline derivative or isothiourea derivative to be incorporated in the adjusting solution or bleach solution depends on the kind of the photographic material to be processed, the processing temperature, the time required for desired processing, etc. In practice, however, it is preferably from $1\times10^{-5}$ to $10^{-1}$ mol, more preferably from $1\times10^{-4}$ to $5\times10^{-2}$ mol per liter of the processing solution.

The bleach bath used in the present invention may comprise a rehalogenating agent such as bromide (e.g., potassium bromide, sodium bromide, ammonium bromide) and chloride (e.g., potassium chloride, sodium chloride, ammonium chloride) incorporated therein besides bleaching agent and the foregoing compounds. The bleach bath may further comprise additives which are known to be normally used in the bleach solution, such as nitrate (e.g., sodium nitrate, ammonium nitrate), one or more inorganic or organic acids or salt thereof having a pH buffering capacity (e.g., boric acid, borax, sodium metaborate, acetic acid, sodium acetate, sodium carbonate, potassium carbonate, phosphorous acid, phosphoric acid, sodium phosphate, citric acid, sodium citrate, tartaric acid). The pH value of the solution having a bleaching capability is preferably from 4.0 to 8.0, particularly from 5.0 to 7.0 during use.

The blix bath may comprise as a fixing agent one or more of thiosulfates such as sodium thiosulfate and ammonium thiosulfate, thiocyanates such as sodium thiocyanate, ammonium thiocyanate and potassium thiocyanate, thioether compounds such as ethylene bisthioglycolic acid and 3,6-dithia-1,8-octanediol and water-soluble silver halide solubilizing agent such as thiourea incorporated therein in admixture. Further, the blix bath may comprise a special blix solution made of fixing agent and a large amount of a halide such as potassium iodide described in JP-A-55-155354 incorporated therein. The amount of such a fixing agent to be added is from 0.1 mol to 3 mol, preferably from 0.2 mol to 2 mol per liter of the bath having a fixing capability.

When a fixing agent is used in the present invention, there may be used one or more of known fixing agents such as thiosulfate (e.g., sodium thiosulfate, ammonium thiosulfate), thiocyanate (e.g., sodium thiocyanate, ammonium thiocyanate, potassium thiocyanate), thioether compound (e.g., ethylenebisthioglycolic acid, 3,6-dithia-1,8-octanediol) and water-soluble silver halide solubilizing solvent (e.g., thiourea) in admixture. The concentration of the fixing agent is from 0.1 mol to 3 mol, preferably from 0.2 mol to 2 mol per liter of the fixing solution.

The solution having a fixing capability may comprise as a preservative a sulfite (e.g., sodium sulfite, potassium sulfite, ammonium sulfite), bisulfite, hydroxylamine, hydrazine, bisulfite adduct of aldehyde compound (e.g., sodium acetaldehydebusulfite) or the like incorporated therein besides the foregoing additives. Sulfinic acids (e.g., benzenesulfinic acid) or ascorbic acid, too, are useful preservatives. Further, the fixing bath may comprise various fluorescent brightening agents, antifoaming agents, surface active agents, polyvinylpyrrolidone, anti-bacterial agents, mildewproofing agents, and organic solvents such as methanol incorporated therein.

The replenishment rate of bleach solution, fixing solution, blix solution, etc. may be arbitrarily predetermined so far as the desired function of the respective processing baths can be satisfied. Preferably, it is preferably from 30 mL to 2000 mL, more preferably from 50 mL to 1000 mL per $m^2$ of the light-sensitive material. The processing temperature is preferably from 20° C. to 50° C., more preferably from 33° C. to 45° C. The processing time is from 10 seconds to 10 minutes, preferably from 20 seconds to 6 minutes.

The desilvering such as fixing and blix is normally followed by water washing and/or stabilization. A stabilizing solution normally comprises an image stabilizer incorporated therein, but may not contain an image stabilizer. The stabilizing solution free of image stabilizer is occasionally referred to as "rinsing solution (washing solution)", which is distringuished from the stabilizing solution.

The amount of water used in the washing step can be arbitrarily determined over a broad range in accordance with the properties (e.g., a property determined by a material used such as a coupler) of the light-sensitive material, the application of the material, the temperature of the water, the number of water tanks (the number of stages), a replenishing method such as a counter or forward current, and other diverse conditions. The relationship between the amount of water and the number of water tanks in a multi-stage counter-current method can be obtained by a method described in "Journal of the Society of Motion Picture and Television Engineering", Vol. 64, pp. 248–253 (May, 1955). The number or stages in a multi-stage counter-current method is preferably 2 to 15, more preferably 2 to 10.

According to the above-described multi-stage counter-current method, the amount of water used for washing can be greatly decreased. Since washing water stays in the tanks for a long period of time, however, bacteria multiply and floating substances stick to a light-sensitive material. In order to solve this problem in the processing of a color light-sensitive material of the present invention, a method of decreasing calcium and magnesium ions described in JP-A-62-288838 can be very effectively used. It is also possible to use an isothiazolone compound and a cyabendazoles described in JP-A-57-8542, a chlorine-based germicide such as chlorinated sodium isocyanurate described in JP-A-61-120145, benzotriazole and copper ion described in JP-A-61-267761, and other germicides described in Hiroshi Horiguchi et al., "Chemistry of Antibacterial and Antifungal Agents", (1986), Sankyo Shuppan, Eiseigijutsu-Kai ed., "Sterilization, Antibacterial, and Antifungal Techniques for Microorganisms", (1982), Kogyogijutsu-Kai, and Nippon Bokin Bokabi Gakkai ed., "Dictionary of Antibacterial and Antifungal Agents", (1986).

Further, the washing water, stabilizing solution or rinsing solution may comprise a surface active agent as a dehydrating agent or a chelating agent typified by EDTA as a water softener incorporated therein. Examples of such a surface active agent include polyethylene glycol type nonionic surface active agents, polyvalent alcohol type nonionic surface active agents, alkylbenzenesulfonate type anionic surface active agents, higher alcohol sulfuric acid ester salt type anionic surface active agents, alkylnaphthalenesuolfonate type anionic surface active agents, quaternary ammonium salt type cationic surface active agents, amine salt type cationic surface active agents, amino salt amphoteric surface active agents, and betaine type amphoteric surface active agents. Two or more of these surface active agents may be used in combination. Further, fluorine-based surface active agents or siloxane-based surface active agents as described in U.S. Pat. No. 5,716,765 may be used.

Preferred among these nonionic surface active agents are alkylpolyethylene oxides, alkylphenoxypolyethylene oxides, and alkylphenoxypolyhydroxypropylene oxides. Particularly preferred among these nonionic surface active agents are alkyl-polyethylene oxide (5-12) alcohols having from 8 to 15 carbon atoms.

In order to enhance the solubility of the surface active agent, the washing water, stabilizing solution or rinsing solution preferably comprises a solubilizing agent such as amine (e.g., diethanolamine, triethanolamine) and glycol (e.g., diethylene glycol, propylene glycol) incorporated therein.

The stabilizing solution or rinsing solution preferably comprises a chelating agent for collecting heavy metal incorporated therein for the purpose of improving the stability thereof and minimizing the production of stain. As such a chelating agent there may be used the same compound as incorporated in the foregoing developer and bleach solution.

The stabilizing solution or rinsing solution of the present invention preferably comprises an antibacterial and antifungal agents incorporated therein for the purpose of inhibiting the proliferation of bacteria or fungi. As such antibacterial and antifungal agents there may be used commercially available products. The stabilizing solution or rinsing solution may further comprise a surface active agent, a fluorescent brightening agent and a hardener incorporated therein.

The pH value of the stabilizing solution or rinsing solution and washing water is from 4 to 9, preferably from 5 to 8. The processing temperature and processing time can be arbitrarily predetermined according to the properties, purpose, etc. of the light-sensitive material. In practice, however, the processing is effected at a temperature of from 15 to 45° C. for 20 seconds to 10 minutes, preferably at a temperature of from 25 to 40° C. for 30 seconds to 4 minutes. Further, the stabilizing solution or rinsing solution of the present invention exerts a remarkable effect of inhibiting stain in the case where the light-sensitive material which has been desilvered is immediately processed with the stabilizing solution or rinsing solution free from water washing.

The replenishment rate of the stabilizing solution or rinsing solution is preferably from 200 mL to 2000 mL per $m^2$ of the light-sensitive material. The overflow solution produced by the replenishment of the foregoing washing water and/or stabilizing solution can be re-used at other steps such as desilvering step.

In order to reduce the amount of washing water to be used, ion exchange or ultrafiltration may be used, preferably ultrafiltration in particular. The various processing solutions in the present invention are used at a temperature of from 10° C. to 50° C. In general, a temperature of from 33° C. to 38° C. is standard. However, the processing temperature may be raised to accelerate processing and hence reduce the processing time. On the contrary, the processing temperature may be lowered to realize the improvement of image quality or the improvement of stability of the processing solutions.

In the case where the processing of the color reversal film involves stabilization free from water washing step, any of known methods described in JP-A's-57-8543, 58-14834, 60-220345, etc. may be employed.

Other preferred embodiments include the use of a chelating agent such as 1-hydroxyethylidene-1,1-diphosphonic acid and ethylenediaminetetramethylenephosphonic acid or a magnesium or bismuth compound.

The water washing and/or stabilizing step is immediately followed by drying. From the standpoint of reduction of amount of water content to be carried over into the image film, the color reversal film which has come out of the water washing bath may be immediately wiped dry with a squeeze roller or cloth so that water is absorbed to speed drying. Referring to improvement for the part of the drying machine, it is a matter of course that the drying temperature can be raised or the shape of nozzle can be modified to strengthen drying air, speeding drying. Alternatively, as proposed in JP-A-3-157650, the angle of drying air blowing onto the light-sensitive can be properly adjusted or the drying air which has been used can be properly removed to speed drying.

EXAMPLE-1

The present invention will be described in more detail below by way of its examples. However, the present invention is not limited to these examples. Formation of sample 101 (Present Invention)

(i) Formation of Triacetyl Cellulose Films

Triacetyl cellulose was dissolved (13% as a mass) in dichloromethane/methanol=92/8 (mass ratio) by normal solvent casting, and triphenyl phosphate and biphenyldiphenyl phosphate as plasticizers were added at a mass ratio of 2:1 such that the total amount was 14% with respect to the triacetyl cellulose, thereby forming a film by a band method. The thickness of the support after drying was 97 μm.

(ii) Contents of Undercoat Layer

Two surfaces of each of the above triacetyl cellulose films were coated with an undercoat solution having the following composition. Each number represents a mass contained per liter (to be referred to as L hereinafter) of the undercoat solution.

| | |
|---|---|
| Gelatin | 10.0 g |
| Salicylic acid | 0.5 g |
| Glycerin | 4.0 g |
| Acetone | 700 mL |
| Methanol | 200 mL |
| Dichloromethane | 80 mL |
| Formaldehyde | 0.1 mg |
| Water to make | 1.0 L |

(iii) Application of Back Layer by Coating:

One surface of the undercoated support was coated with back layers described below.

| | |
|---|---|
| 1st layer Binder: acid-processed gelatin (isoelectric point 9.0) | 1.00 g |
| Polymer latex: P-2 (average grain size 0.1 μm) | 0.13 g |
| Polymer latex: P-3 (average grain size 0.2 μm) | 0.23 g |
| Ultraviolet absorbent U-1 | 0.030 g |
| Ultraviolet absorbent U-2 | 0.010 g |
| Ultraviolet absorbent U-3 | 0.010 g |
| Ultraviolet absorbent U-4 | 0.020 g |
| High-boiling organic solvent Oil-2 | 0.030 g |
| Surfactant W-2 | 0.010 g |
| Surfactant W-4 | 3.0 mg |
| 2nd layer Binder: acid-processed gelatin (isoelectric point 9.0) | 3.10 g |
| Polymer latex: P-3 (average grain size 0.2 μm) | 0.11 g |
| Ultraviolet absorbent U-1 | 0.030 g |
| Ultraviolet absorbent U-3 | 0.010 g |
| Ultraviolet absorbent U-4 | 0.020 g |
| High-boiling organic solvent Oil-2 | 0.030 g |
| Surfactant W-2 | 0.010 g |
| Surfactant W-4 | 3.0 mg |
| Dye D-2 | 0.10 g |
| Dye D-10 | 0.12 g |
| Potassium sulfate | 0.25 g |
| Calcium chloride | 0.5 mg |

-continued

| | |
|---|---|
| Sodium hydroxide | 0.03 g |
| 3rd layer Binder: acid-processed gelatin (isoelectric point 9.0) | 3.30 g |
| Surfactant W-3 | 0.020 g |
| Potassium sulfate | 0.30 g |
| Sodium hydroxide | 0.03 g |
| 4th layer Binder: lime-processed gelatin (isoelectric point 5.4) | 1.15 g |
| 1:9 copolymer of methacrylic acid and methylmethacrylate (average grain size 2.0 μm) | 0.040 g |
| 6:4 copolymer of methacrylic acid and methylmethacrylate (average grain size 2.0 μm) | 0.030 g |
| Surfactant W-3 | 0.060 g |
| Surfactant W-2 | 7.0 mg |
| Hardener H-1 | 0.23 g |

(iv) Application of Lightsensitive Emulsion Layer by Coating:

The following lightsensitive emulsion layers were applied to the side opposite to that coated with the back layer, thereby obtaining sample 101. The figures given below indicate the addition amount per $m^2$. The effects of added compounds are not limited to the described usage.

The molecular mass (weight-average molecular weight) of gelatins described below is 100,000 to 200,000. The content of principal metal ion is 2,500 to 3,000 ppm for calcium, 1 to 7 ppm for iron, and 1,500 to 3,000 ppm for sodium.

In addition to the above-mentioned gelatin, a gelatin having calcium content of 1000 ppm or less were used.

For preparation of individual layers, organic compounds to incorporate were prepared in the form of emulsified dispersions containing gelatin (W-2, W-3 and W-4 were used as surfactants). Light-sensitive emulsions and yellow colloidal silver were also prepared in the form of gelatin dispersions. Coating liquids were prepared by mixing those emulsions and dispersions so that the addition amounts described below could be obtained. The resulting liquids were used for coating. Cpd-H, O, P, Q, dye D-1, 2, 3, 5, 6, 8, 9, 10, H-1, P-3 and F-1 to 9 were dissolved in water or an appropriate organic solvent miscible with water such as methanol, dimethylformamide, ethanol and dimethylacetamide, and then were added to the coating liquids of individual layers.

The gelatin concentrations of the individual layers prepared above ranged from 2.5% to 15.0%. The pH values of the coating liquids ranged from 5.0 to 8.5. The coating liquids of the layers containing silver halide emulsions had a pH of 6.0 and their pAg values ranged from 7.0 to 9.5 when the temperature was adjusted to 40° C.

After the application, a sample was obtained by drying through a multi-stage drying process in which the temperature was held within the range of 10° C. to 45° C.

| 1st layer: Antihalation layer | |
|---|---|
| Black colloidal silver | 0.20 g |
| Gelatin | 2.40 g |
| Compound Cpd-B | 0.010 g |
| Ultraviolet absorbent U-1 | 0.15 g |
| Ultraviolet absorbent U-3 | 0.15 g |
| Ultraviolet absorbent U-4 | 0.10 g |

-continued

| | | |
|---|---|---|
| Ultraviolet absorbent U-5 | | 0.10 g |
| Ultraviolet absorbent U-2 | | 0.070 g |
| Compound Cpd-F | | 0.20 g |
| Compound Cpd-R | | 0.020 g |
| Compound Cpd-S | | 0.020 g |
| High-boiling organic solvent Oil-2 | | 0.020 g |
| High-boiling organic solvent Oil-6 | | 0.020 g |
| High-boiling organic solvent Oil-8 | | 0.020 g |
| Dye D-4 | | 1.0 mg |
| Dye D-8 | | 1.0 mg |
| Fine-crystal solid dispersion of dye E-1 | | 0.05 g |
| 2nd layer: Interlayer | | |
| Gelatin | | 0.4 g |
| Compound Cpd-F | | 0.050 g |
| High-boiling organic solvent Oil-6 | | 0.010 g |
| 3th layer: short-wavelength green-sensitive interimage effect imparting layer | | |
| Emulsion R | silver | 0.03 g |
| Emulsion S | silver | 0.05 g |
| Emulsion T | silver | 0.24 g |
| Silver iodide fine grain emulsion (average equivalent-sphere diameter 0.05 μm) | silver | 0.005 g |
| Gelatin | | 0.5 g |
| Compound Cpd-M | | 0.030 g |
| High-boiling organic solvent Oil-6 | | 0.030 g |
| High-boiling organic solvent Oil-7 | | 5.0 mg |
| Dye D-7 | | 4.0 mg |
| 4th layer: Red-sensitive interimage effects imparting layer) | | |
| Emulsion U | silver | 0.14 g |
| Gelatin | | 0.25 g |
| Compound Cpd-M | | 0.010 g |
| High-boiling organic solvent Oil-6 | | 0.010 g |
| High-boiling organic solvent Oil-7 | | 1.7 mg |
| 5th layer: Interlayer | | |
| Gelatin | | 1.50 g |
| Compound Cpd-M | | 0.10 g |
| Compound Cpd-F | | 0.030 g |
| Compound Cpd-D | | 0.010 g |
| Compound Cpd-K | | 3.0 mg |
| Ultraviolet absorbent U-6 | | 0.10 g |
| High-boiling organic solvent Oil-6 | | 0.10 g |
| High-boiling organic solvent Oil-3 | | 0.010 g |
| High-boiling organic solvent Oil-4 | | 0.010 g |
| 6th layer: Low-speed red-sensitive emulsion layer | | |
| Emulsion A | silver | 0.05 g |
| Emulsion B | silver | 0.40 g |
| Emulsion C | silver | 0.15 g |
| Yellow colloidal silver | silver | 0.1 mg |
| Gelatin | | 0.60 g |
| Coupler C-1 | | 0.11 g |
| Coupler C-2 | | 7.0 mg |
| Ultraviolet absorbent U-2 | | 3.0 mg |
| Compound Cpd-D | | 1.0 mg |
| Compound Cpd-J | | 2.0 mg |
| High-boiling organic solvent Oil-5 | | 0.050 g |
| High-boiling organic solvent Oil-10 | | 0.010 g |
| 7th layer: Medium-speed red-sensitive emulsion layer | | |
| Emulsion C | silver | 0.12 g |
| Emulsion D | silver | 0.12 g |
| Silver bromide emulsion, internal thereof are fogged. (cubic, average equivalent-sphere diameter 0.11 μm) | silver | 0.01 g |
| Gelatin | | 0.60 g |
| Coupler C-1 | | 0.16 g |
| Coupler C-2 | | 7.0 mg |
| Compound Cpd-D | | 1.5 mg |
| High-boiling organic solvent Oil-5 | | 0.050 g |
| High-boiling organic solvent Oil-10 | | 0.010 g |
| Compound Cpd-T | | 2.0 mg |

-continued

| | | |
|---|---|---|
| 8th layer: High-speed red-sensitive emulsion layer | | |
| Emulsion E | silver | 0.32 g |
| Emulsion F | silver | 0.14 g |
| Silver iodobromide fine grain emulsion (silver iodide content 0.1 mol %, average equivalent-sphere diameter 0.05 μm) | | |
| Gelatin | | 1.50 g |
| Coupler C-1 | | 0.75 g |
| Coupler C-2 | | 0.025 g |
| Coupler C-3 | | 0.020 g |
| Ultraviolet absorbent U-1 | | 0.010 g |
| High-boiling organic solvent Oil-5 | | 0.025 g |
| High-boiling organic solvent Oil-9 | | 0.005 g |
| High-boiling organic solvent Oil-10 | | 0.10 g |
| Compound Cpd-D | | 5.0 mg |
| Compound Cpd-L | | 1.0 mg |
| Compound Cpd-T | | 0.020 g |
| Additive P-1 | | 0.010 g |
| Additive P-3 | | 0.030 g |
| 9th layer: Interlayer | | |
| Gelatin | | 0.50 g |
| Additive P-2 | | 0.10 g |
| Dye D-5 | | 0.020 g |
| Dye D-9 | | 6.0 mg |
| Compound Cpd-I | | 0.020 g |
| Compound Cpd-O | | 3.0 mg |
| Compound Cpd-P | | 5.0 mg |
| High-boiling organic solvent Oil-6 | | 0.050 g |
| 10th layer: Interlayer | | |
| Yellow colloidal silver | silver | 3.0 mg |
| Gelatin | | 1.00 g |
| Additive P-2 | | 0.05 g |
| Compound Cpd-A | | 0.050 g |
| Compound Cpd-D | | 0.030 g |
| Compound Cpd-M | | 0.10 g |
| High-boiling organic solvent Oil-3 | | 0.010 g |
| High-boiling organic solvent Oil-6 | | 0.10 g |
| 11th layer: Low-speed green-sensitive emulsion layer | | |
| Emulsion G | silver | 0.07 g |
| Emulsion H | silver | 0.31 g |
| Emulsion I | silver | 0.31 g |
| Gelatin | | 1.00 g |
| Coupler C-4 | | 0.013 g |
| Coupler C-5 | | 0.080 g |
| Coupler C-10 | | 0.020 g |
| Compound Cpd-B | | 0.012 g |
| Compound Cpd-G | | 3.0 mg |
| Compound Cpd-K | | 2.4 mg |
| High-boiling organic solvent Oil-2 | | 0.024 g |
| High-boiling organic solvent Oil-5 | | 0.024 g |
| Additive P-1 | | 5.0 mg |
| 12th layer: Medium-speed green-sensitive emulsion layer | | |
| Emulsion I | silver | 0.15 g |
| Emulsion J | silver | 0.28 g |
| Gelatin | | 0.70 g |
| Coupler C-4 | | 0.20 g |
| Coupler C-5 | | 0.10 g |
| Coupler C-6 | | 0.010 g |
| Coupler C-10 | | 0.010 g |
| Compound Cpd-B | | 0.030 g |
| Compound Cpd-U | | 9.0 mg |
| High-boiling organic solvent Oil-2 | | 0.015 g |
| High-boiling organic solvent Oil-5 | | 0.030 g |
| Additive P-1 | | 0.010 g |
| 13th layer: High-speed green-sensitive emulsion layer | | |
| Emulsion K | silver | 0.30 g |
| Internally fogged silver bromide emulsion (cubic, average equivalent-sphere diameter 0.11 μm) | silver | 3.0 mg |
| Gelatin | | 1.20 g |
| Coupler C-4 | | 0.33 g |
| Coupler C-5 | | 0.20 g |
| Coupler C-7 | | 0.10 g |

-continued

| | | | |
|---|---|---|---|
| Compound Cpd-B | | 0.030 | g |
| Compound Cpd-U | | 0.030 | g |
| Additive P-1 | | 0.10 | g |
| 14th layer: Yellow filter layer | | | |
| Yellow colloidal silver | silver | 2.0 | mg |
| Gelatin | | 1.0 | g |
| Compound Cpd-C | | 0.010 | g |
| Compound Cpd-M | | 0.020 | g |
| High-boiling organic solvent Oil-1 | | 0.020 | g |
| High-boiling organic solvent Oil-6 | | 0.020 | g |
| Fine-crystal solid dispersion of dye E-2 | | 0.25 | g |
| 15th layer: Low-speed blue-sensitive emulsion layer | | | |
| Emulsion L | silver | 0.07 | g |
| Emulsion M | silver | 0.05 | g |
| Emulsion N | silver | 0.09 | g |
| Gelatin | | 0.80 | g |
| Coupler C-8 | | 0.050 | g |
| Coupler C-10 | | 0.50 | g |
| Compound Cpd-B | | 0.020 | g |
| Compound Cpd-I | | 8.0 | mg |
| Compound Cpd-K | | 1.0 | mg |
| Ultraviolet absorbent U-5 | | 0.010 | g |
| Additive P-1 | | 0.10 | g |
| 16th layer: Medium-speed blue-sensitive emulsion layer | | | |
| Emulsion N | silver | 0.08 | g |
| Emulsion O | silver | 0.08 | g |
| Gelatin | | 0.65 | g |
| Coupler C-8 | | 0.050 | g |
| Coupler C-10 | | 0.30 | g |
| Compound Cpd-B | | 0.010 | g |
| Compound Cpd-E | | 0.020 | g |
| Compound Cpd-N | | 2.0 | mg |
| Ultraviolet absorbent U-5 | | 0.015 | g |
| Additive P-1 | | 0.020 | g |
| 17th layer: High-speed blue-sensitive emulsion layer | | | |
| Emulsion P | silver | 0.20 | g |
| Emulsion Q | silver | 0.19 | g |
| Gelatin | | 2.00 | g |
| Coupler C-8 | | 0.10 | g |
| Coupler C-10 | | 1.10 | g |
| Coupler C-3 | | 0.010 | g |
| High-boiling organic solvent Oil-5 | | 0.020 | g |
| Compound Cpd-B | | 0.060 | g |
| Compound Cpd-D | | 3.0 | mg |
| Compound Cpd-E | | 0.020 | g |
| Compound Cpd-F | | 0.020 | g |
| Compound Cpd-N | | 5.0 | mg |

-continued

| | | | |
|---|---|---|---|
| Ultraviolet absorbent U-5 | | 0.060 | g |
| Additive P-1 | | 0.010 | g |
| 18th layer: 1st protective layer | | | |
| Gelatin | | 1.00 | g |
| Ultraviolet absorbent U-1 | | 0.15 | g |
| Ultraviolet absorbent U-5 | | 0.050 | g |
| Ultraviolet absorbent U-2 | | 0.20 | g |
| Compound Cpd-B | | 5.0 | mg |
| Compound Cpd-O | | 0.030 | g |
| Compound Cpd-A | | 0.030 | g |
| Compound Cpd-H | | 0.20 | g |
| Dye D-1 | | 8.0 | mg |
| Dye D-2 | | 0.010 | g |
| Dye D-3 | | 0.010 | g |
| High-boiling organic solvent Oil-3 | | 0.10 | g |
| 19th layer: 2nd protective layer | | | |
| Colloidal silver | silver | 2.5 | mg |
| Silver iodobromide fine grain emulsion (average equivalent-sphere diameter 0.06 μm, silver iodide content 1 mol %) | silver | 0.10 | g |
| Gelatin | | 0.80 | g |
| Ultraviolet absorbent U-2 | | 0.030 | g |
| Ultraviolet absorbent U-5 | | 0.030 | g |
| High-boiling organic solvent Oil-3 | | 0.010 | g |
| 20th layer: 3rd protective layer | | | |
| Gelatin | | 1.00 | g |
| Polymethylmethacrylate (average grain size 1.5 μm) | | 0.10 | g |
| 6:4 copolymer of methylmethacrylate and methacrylic acid (average grain size 1.5 μm) | | 0.15 | g |
| Silicone oil SO-1 | | 0.20 | g |
| Surfactant W-1 | | 0.020 | g |
| Surfactant W-2 | | 0.040 | g |

In addition to the above compositions, additives F-1 to F-9 were added to all emulsion layers. Also, a gelatin hardener H-1 and surfactants W-2, W-3, and W-4 for coating and emulsification were added to each layer.

As preservatives and antifungal agents there were added phenol, 1,2-benzisothiazoline-3-one, 2-phenoxyethanol, phenethyl alcohol, and butylester p-benzoate.

The sample 101 prepared in the manner described above has a coating film thickness at dry condition of 25.3 μm and a swelling rate of 1.88 times when swelled with distilled water at a temperature of 25° C.

TABLE 3

Silver bromoiodide emulsions used in Sample 101

| Emulsion | Characteristics | Equivalent-sphere average diameter (μm) | Variation coefficient (%) | Average silver iodide content (mol %) | Halogen composition structure of silver halide grain | Silver iodide content of grain surface (mol %) | Other characteristics ① | ② | ③ | ④ | ⑤ |
|---|---|---|---|---|---|---|---|---|---|---|---|
| A | Monodisperse tetradecahedral grain | 0.18 | 10 | 3.5 | Triple | 2.5 | ○ | ○ | | ○ | |
| B | Monodisperse (111) tabular grain Average aspect ratio 3.0 | 0.30 | 10 | 4.5 | Quadruple | 2.5 | | | ○ | | ○ |
| C | Monodisperse (111) tabular grain Average aspect ratio 3.0 | 0.32 | 11 | 4.6 | Quadruple | 2.5 | | ○ | | ○ | ○ |

TABLE 3-continued

Silver bromoiodide emulsions used in Sample 101

| Emulsion | Characteristics | Equivalent-sphere average diameter (μm) | Variation coefficient (%) | Average silver iodide content (mol %) | Halogen composition structure of silver halide grain | Silver iodide content of grain surface (mol %) | Other characteristics ① | ② | ③ | ④ | ⑤ |
|---|---|---|---|---|---|---|---|---|---|---|---|
| D | Monodisperse (111) tabular grain Average aspect ratio 6.0 | 0.40 | 21 | 2.0 | Triple | 2.0 | | ○ | | ○ | ○ |
| E | Monodisperse (111) tabular grain Average aspect ratio 6.0 | 0.48 | 12 | 2.0 | Triple | 1.3 | | ○ | | | |
| F | Monodisperse (111) tabular grain Average aspect ratio 8.0 | 0.60 | 12 | 1.6 | Triple | 0.6 | | ○ | ○ | | ○ |
| G | Monodisperse cubic grain | 0.14 | 9 | 4.5 | Quadruple | 0.3 | ○ | | ○ | ○ | |
| H | Monodisperse (111) tabular grain Average aspect ratio 4.0 | 0.03 | 12 | 3.5 | Quadruple | 1.5 | | | ○ | | ○ |
| I | Monodisperse (111) tabular grain Average aspect ratio 4.0 | 0.35 | 12 | 3.5 | Quadruple | 1.5 | ○ | ○ | | ○ | ○ |

TABLE 4

(continued from Table 3)
Silver bromoiodide emulsions used in Sample 101

| Emulsion | Characteristics | Equivalent-sphere average diameter (μm) | Variation coefficient (%) | Average silver iodide content (mol %) | Halogen composition structure of silver halide grain | Silver iodide content of grain surface (mol %) | Other characteristics ① | ② | ③ | ④ | ⑤ |
|---|---|---|---|---|---|---|---|---|---|---|---|
| J | Monodisperse (111) tabular grain Average aspect ratio 7.0 | 0.40 | 21 | 2.5 | Quadruple | 2.2 | ○ | ○ | | ○ | ○ |
| K | Monodisperse (111) tabular grain Average aspect ratio 8.5 | 0.55 | 13 | 1.7 | Triple | 1.3 | ○ | ○ | ○ | | ○ |
| L | Monodisperse tetradecahedral grain | 0.30 | 9 | 4.5 | Triple | 2.5 | | | ○ | | ○ |
| M | Monodisperse tetradecahedral grain | 0.30 | 9 | 4.5 | Triple | 2.5 | | ○ | | ○ | |
| N | Monodisperse (111) tabular grain Average aspect ratio 3.0 | 0.35 | 13 | 4.5 | Quintuple | 2.5 | ○ | ○ | ○ | | |
| O | Monodisperse (111) tabular grain Average aspect ratio 5.0 | 0.45 | 9 | 2.5 | Quadruple | 1.0 | | ○ | ○ | ○ | ○ |
| P | Monodisperse (111) tabular grain Average aspect ratio 9.0 | 0.70 | 21 | 2.8 | Triple | 0.5 | ○ | ○ | | | ○ |
| Q | Monodisperse (111) tabular grain Average aspect ratio 9.0 | 0.85 | 8 | 1.0 | Quadruple | 0.5 | ○ | ○ | | | ○ |
| R | Monodisperse (111) tabular grain Average aspect ratio 5.0 | 0.90 | 12 | 8.0 | Quadruple | 3.0 | ○ | ○ | | | ○ |
| S | Monodisperse (111) tabular grain Average aspect ratio 4.0 | 0.70 | 13 | 12.5 | Quadruple | 3.0 | | ○ | ○ | | ○ |

TABLE 5

(continued from Table 3)
Silver bromoiodide emulsions used in Sample 101

| Emulsion | Characteristics | Equivalent-sphere average diameter (μm) | Variation coefficient (%) | Average silver iodide content (mol %) | Halogen composition structure of silver halide grain | Silver iodide content of grain surface (mol %) | Other characteristics ① | ② | ③ | ④ | ⑤ |
|---|---|---|---|---|---|---|---|---|---|---|---|
| T | Monodisperse (111) tabular grain Average aspect ratio 4.0 | 0.50 | 13 | 12.0 | Quadruple | 3.2 | ○ | | ○ | | ○ |
| U | Monodisperse (111) tabular grain Average aspect ratio 3.0 | 0.36 | 15 | 12.0 | Quadruple | 3.5 | ○ | | ○ | | ○ |
| V | Monodisperse (111) tabular grain Average aspect ratio 4.0 | 0.45 | 13 | 10.5 | Quadruple | 2.8 | ○ | | | | ○ |

(Other characteristics)
① A reduction sensitizer was added during grain formation.
② A selenium sensitizer was used as an after-ripening chemical.
③ A rhodium salt was added during grain formation.
④ Subequently after-ripening, 10% silver nitrate based on silver molar ratio to the emulsion grain at that time and its equimolar potassium bromide were added and the shell formation was carried out.
⑤ It was observed by a transmission electron microscope that 10 or more of dislocation lines per one grain exist in average.
Further, all of the lightsensitive emulsions were post-ripened using sodium thiosulfate, potassium thiocyanate and sodium chloroaurate.
Further, an iridium salt was appropriately added during grain formation.
Further, a chemically modified gelatin in which a portion of the amino group of gelatin was converted to phthalic amide was added to the emulsion B, C, E, H, J, N, Q, R, S and T.
(notes:
Silver halide emulsions A' to F' used in Sample 105 are the same as Emulsions A to F above, respectively.

TABLE 6

Spectral sensitization of emulsions A to V, and A to F'

| Emulsion | Added sensitizing dye | Addition amount (g) per mol of silver halide | Addition timing of sensitizing dye |
|---|---|---|---|
| A | S-1 | 0.01 | Subsequently to after-ripening |
| | S-2 | 0.20 | Prior to after-ripening |
| | S-3 | 0.02 | Prior to after-ripening |
| | S-8 | 0.08 | Prior to after-ripening |
| | S-13 | 0.01 | Prior to after-ripening |
| B | S-2 | 0.20 | Prior to after-ripening |
| | S-8 | 0.08 | Prior to after-ripening |
| | S-13 | 0.05 | Prior to after-ripening |
| | S-14 | 0.01 | Prior to after-ripening |
| C | S-2 | 0.20 | Prior to after-ripening |
| | S-8 | 0.08 | Prior to after-ripening |
| | S-13 | 0.20 | Prior to after-ripening |
| D | S-2 | 0.20 | Subsequently to after-ripening |
| | S-3 | 0.05 | Subsequently to after-ripening |
| | S-8 | 0.08 | Prior to after-ripening |
| | S-13 | 0.25 | Prior to after-ripening |
| E | S-1 | 0.01 | Prior to after-ripening |
| | S-2 | 0.25 | Prior to after-ripening |
| | S-8 | 0.05 | Prior to after-ripening |
| | S-13 | 0.25 | Subsequently to after-ripening |
| F | S-2 | 0.25 | Prior to after-ripening |
| | S-3 | 0.02 | Prior to after-ripening |
| | S-8 | 0.05 | Prior to after-ripening |

TABLE 7

(continued from Table 6)

| Emulsion | Added sensitizing dye | Addition amount (g) per mol of silver halide | Addition timing of sensitizing dye |
|---|---|---|---|
| G | S-4 | 0.33 | Subsequently to after-ripening |
| | S-5 | 0.01 | Subsequently to after-ripening |
| | S-12 | 0.10 | Subsequently to after-ripening |
| H | S-4 | 0.25 | Prior to after-ripening |
| | S-5 | 0.01 | Subsequently to after-ripening |
| | S-9 | 0.02 | Prior to after-ripening |
| | S-14 | 0.02 | Subsequently to after-ripening |
| I | S-4 | 0.3 | Prior to after-ripening |
| | S-9 | 0.2 | Prior to after-ripening |
| | S-12 | 0.1 | Prior to after-ripening |
| J | S-4 | 0.35 | Prior to after-ripening |
| | S-5 | 0.05 | Subsequently to after-ripening |
| | S-12 | 0.1 | Prior to after-ripening |
| K | S-4 | 0.3 | Prior to after-ripening |
| | S-9 | 0.05 | Prior to after-ripening |
| | S-12 | 0.1 | Prior to after-ripening |
| | S-14 | 0.02 | Prior to after-ripening |
| L, M | S-6 | 0.1 | Subsequently to after-ripening |
| | S-10 | 0.2 | Subsequently to after-ripening |
| | S-11 | 0.05 | Subsequently to after-ripening |
| N | S-6 | 0.05 | Subsequently to after-ripening |
| | S-7 | 0.05 | Subsequently to after-ripening |
| | S-10 | 0.25 | Subsequently to after-ripening |
| | S-11 | 0.05 | Subsequently to after-ripening |

TABLE 8

(continued from Table 6)

| Emulsion | Added sensitizing dye | Addition amount (g) per mol of silver halide | Addition timing of sensitizing dye |
|---|---|---|---|
| O | S-10 | 0.4 | Subsequently to after-ripening |
| | S-11 | 0.15 | Subsequently to after-ripening |
| P | S-6 | 0.05 | Subsequently to after-ripening |
| | S-7 | 0.05 | Subsequently to after-ripening |
| | S-10 | 0.3 | Prior to after-ripening |
| | S-11 | 0.1 | Prior to after-ripening |
| Q | S-6 | 0.05 | Prior to after-ripening |
| | S-7 | 0.05 | Prior to after-ripening |
| | S-10 | 0.2 | Prior to after-ripening |
| | S-11 | 0.25 | Prior to after-ripening |
| R | S-15 | 0.35 | Subsequently to after-ripening |
| | S-4 | 0.15 | Subsequently to after-ripening |
| S | S-15 | 0.30 | Subsequently to after-ripening |
| | S-4 | 0.20 | Subsequently to after-ripening |
| | S-10 | 0.05 | Prior to after-ripening |
| T | S-15 | 0.40 | Prior to after-ripening |
| | S-4 | 0.25 | Prior to after-ripening |
| | S-10 | 0.06 | Prior to after-ripening |
| U | S-2 | 0.50 | Prior to after-ripening |
| | S-13 | 0.01 | Prior to after-ripening |
| V | S-6 | 0.05 | Prior to after-ripening |
| | S-10 | 0.30 | Prior to after-ripening |

TABLE 9

(continued from Table 6)

| Emulsion | Added sensitizing dye | Addition amount (g) per mol of silver halide | Addition timing of sensitizing dye |
|---|---|---|---|
| A' | S-1 | 0.01 | Subsequently to after-ripening |
| | S-2 | 0.27 | Prior to after-ripening |
| | S-3 | 0.02 | Prior to after-ripening |
| | S-8 | 0.01 | Prior to after-ripening |
| | S-13 | 0.01 | Prior to after-ripening |
| B' | S-2 | 0.27 | Prior to after-ripening |
| | S-8 | 0.01 | Prior to after-ripening |
| | S-13 | 0.05 | Prior to after-ripening |
| | S-14 | 0.01 | Prior to after-ripening |
| C' | S-2 | 0.27 | Prior to after-ripening |
| | S-8 | 0.01 | Prior to after-ripening |
| | S-13 | 0.20 | Prior to after-ripening |
| D' | S-2 | 0.27 | Subsequently to after-ripening |
| | S-3 | 0.05 | Subsequently to after-ripening |
| | S-8 | 0.01 | Prior to after |
| | S-13 | 0.25 | Prior to after |
| E' | S-1 | 0.01 | Prior to after-ripening |
| | S-2 | 0.30 | Prior to after-ripening |
| | S-8 | 0.00 | Prior to after-ripening |
| | S-13 | 0.25 | Subsequently to after-ripening |
| F' | S-2 | 0.29 | Prior to after-ripening |
| | S-3 | 0.02 | Prior to after-ripening |
| | S-8 | 0.01 | Prior to after-ripening |

C-1

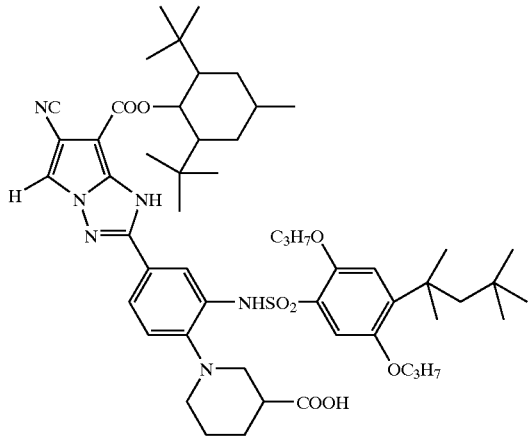

C-2

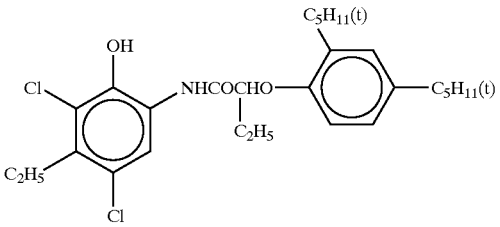

C-3

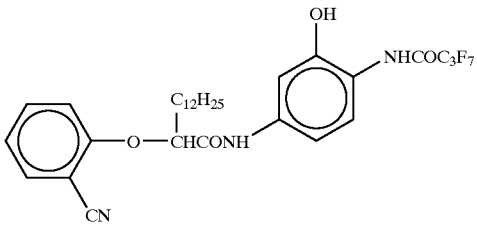

C-4

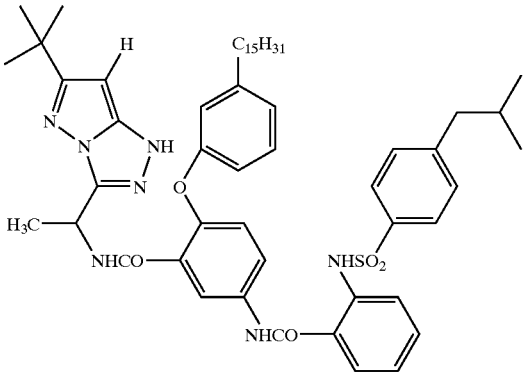

-continued
C-5
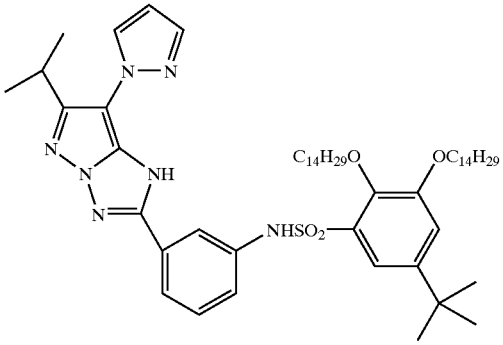
C-6
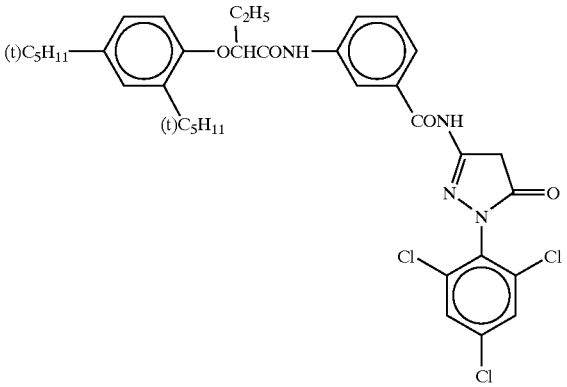
C-7
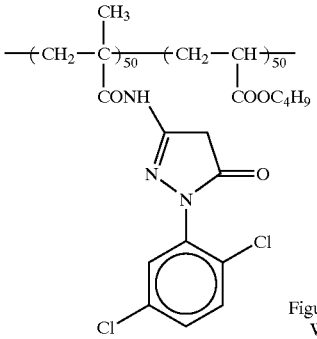
Figures mean mass %
Weight-average
molecular weight: about 25,000
C-8
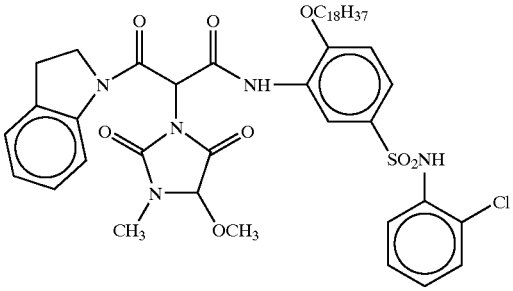
C-9
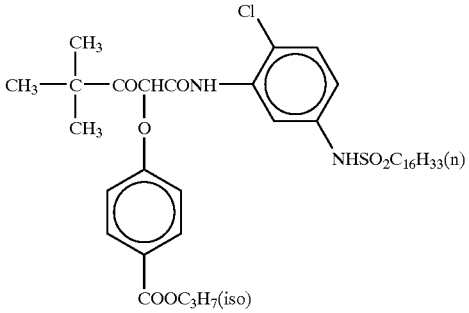
C-10
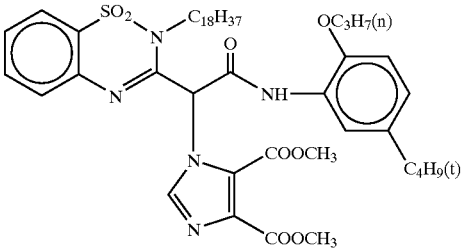
Oil-1
Tri-n-hexyl phosphate
Oil-2
Tricresyl phosphate
Oil-3
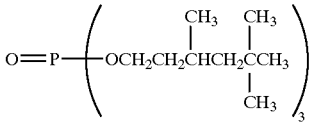
Oil-4
Tricyclohexyl phosphate
Oil-5
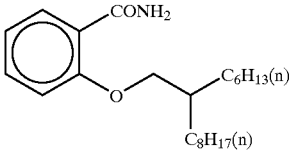
Oil-6
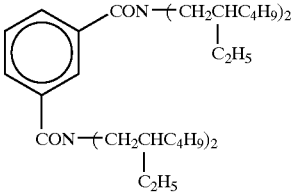
Oil-7
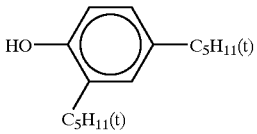
Oil-8
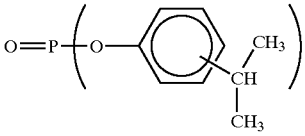
A mixture of isomers -continued
Oil-9
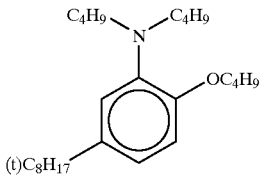
Oil-10
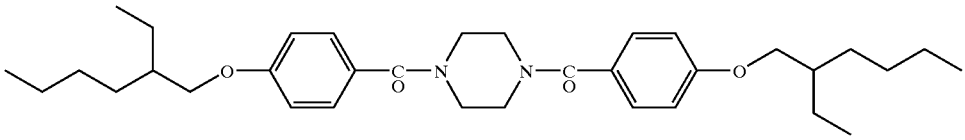
Cpd-A
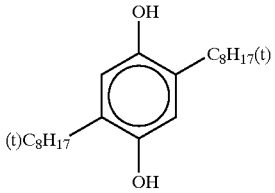
Cpd-B
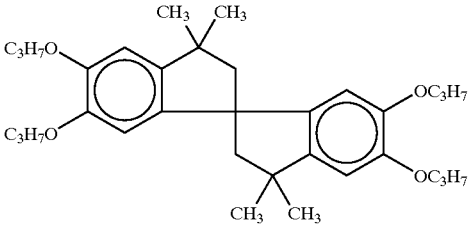
Cpd-C
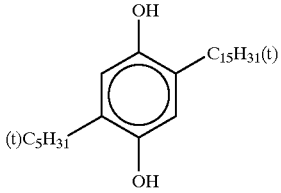
Cpd-D
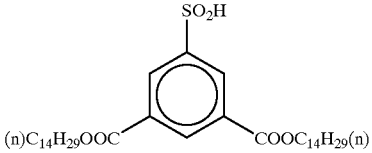
Cpd-E
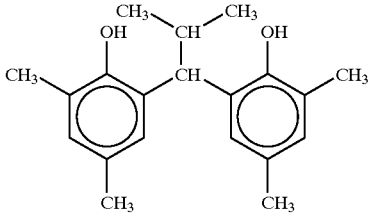
Cpd-F
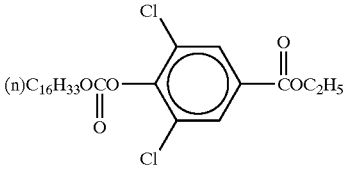
Cpd-G
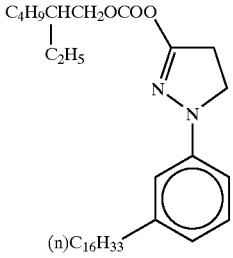
Cpd-H
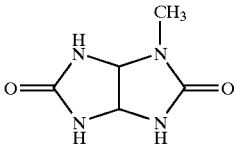
Cpd-I
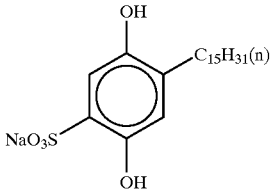
Cpd-J
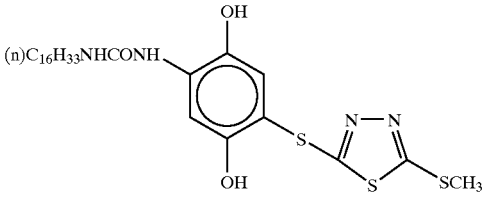

-continued
Cpd-K
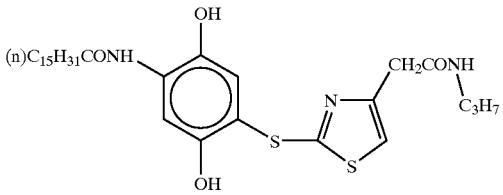
Cpd-L
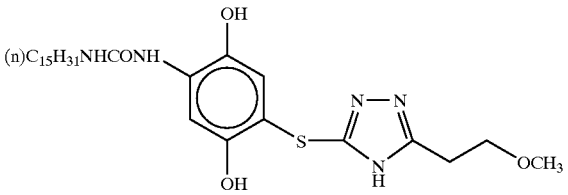
Cpd-M
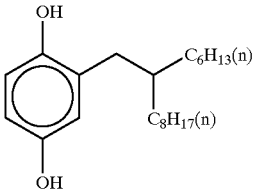
Cpd-N
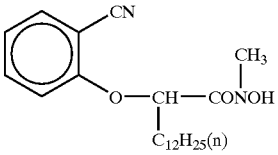
Cpd-O
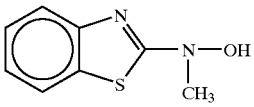
Cpd-P
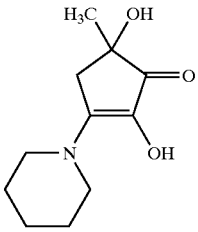
Cpd-Q
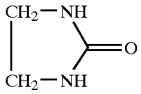
Cpd-R
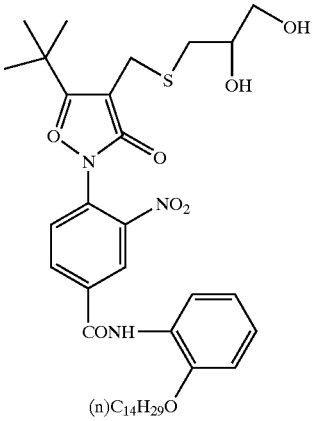
Cpd-S
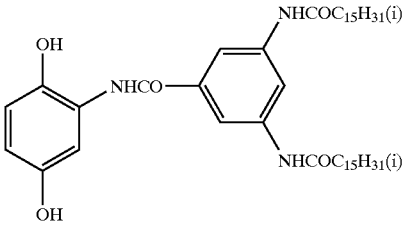
Cpd-T
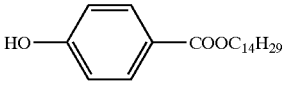
Cpd-U
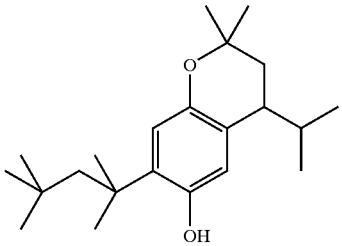
U-1
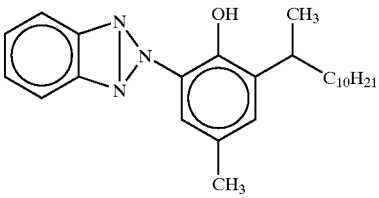

-continued
U-2
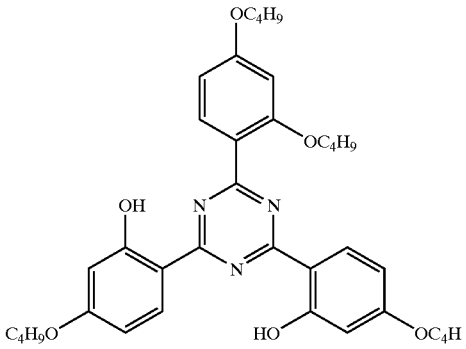
U-3
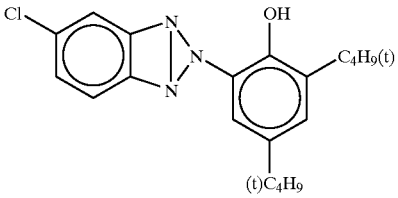
U-4
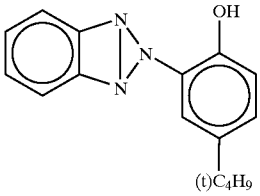
U-5
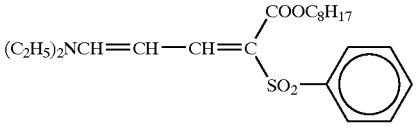
U-6
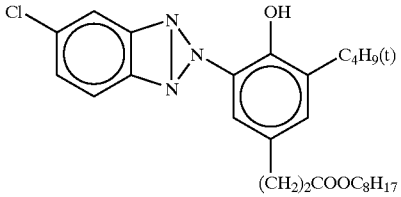
S-1
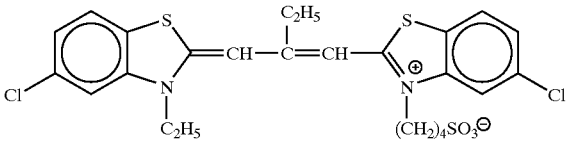
S-2
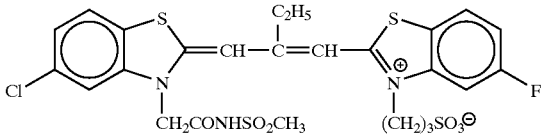
S-3
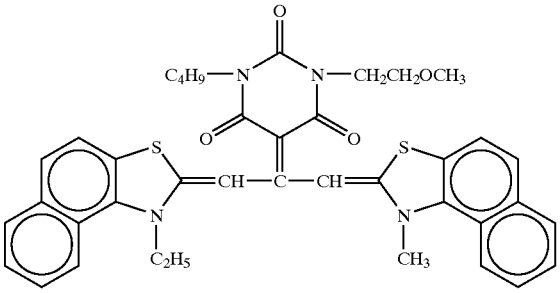
S-4
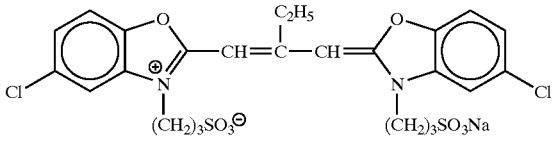
S-5
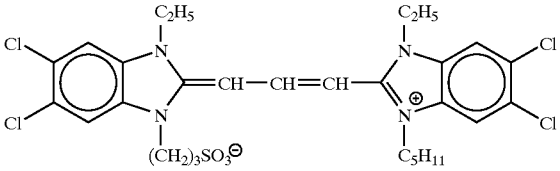
S-6
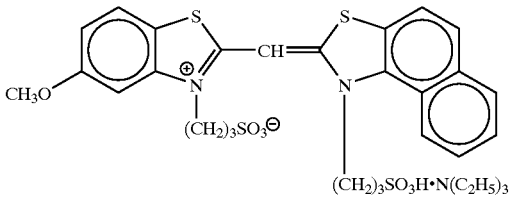
S-7
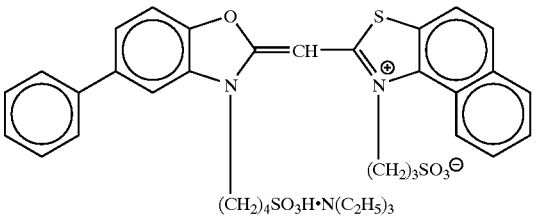

-continued
S-8
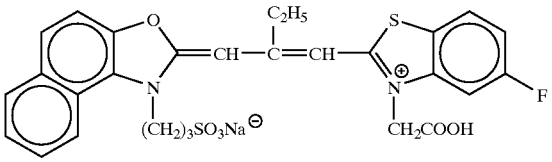
S-9
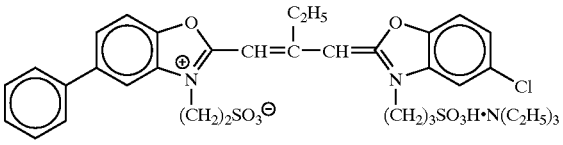
S-10
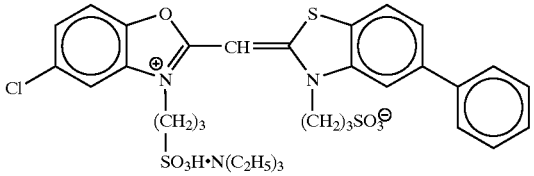
S-11
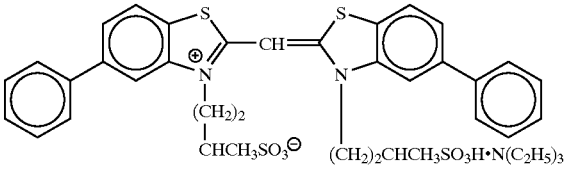
S-12
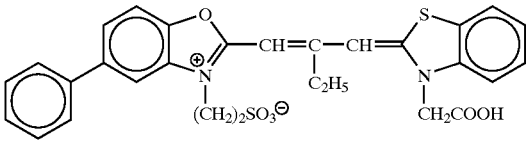
S-13
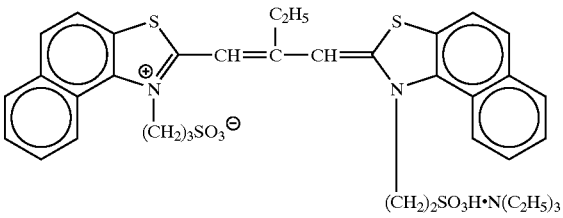
S-14
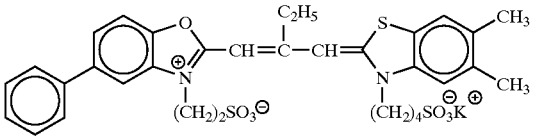
S-15
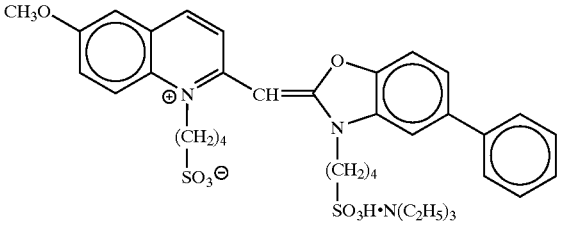
SO-1
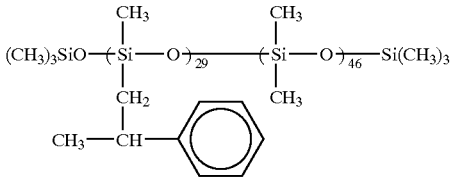
D-1
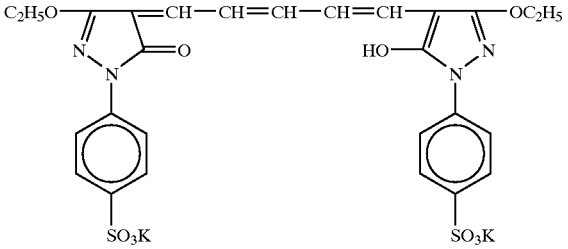
D-2
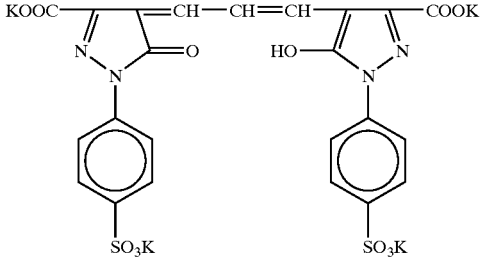
D-3
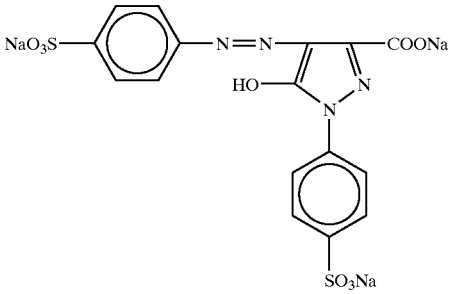

-continued
D-4
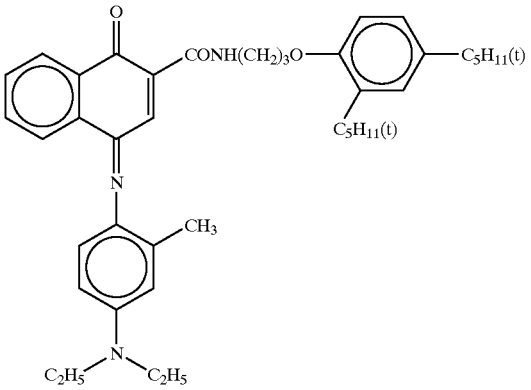
D-5
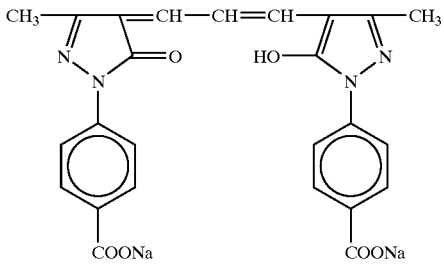
D-6
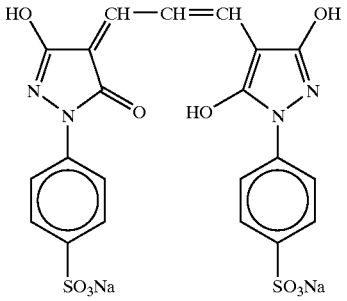
D-7
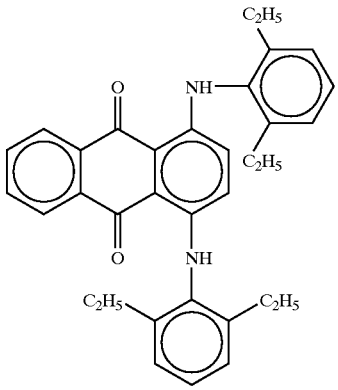
D-8
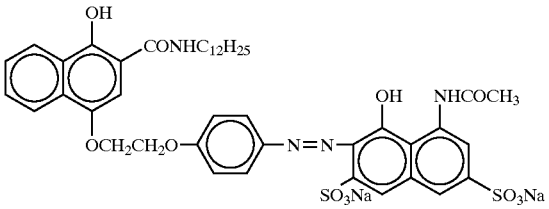
D-9
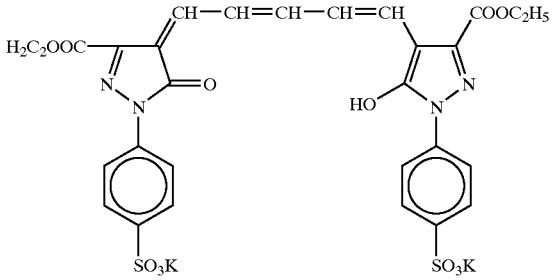
D-10
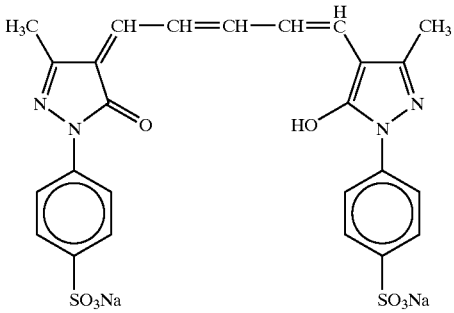
E-1
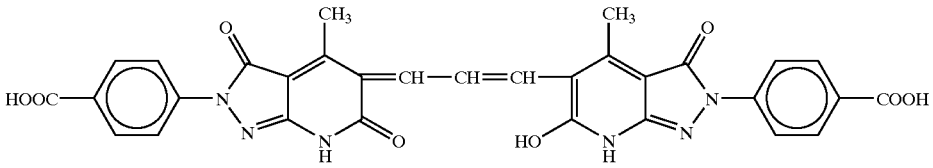

-continued
E-2
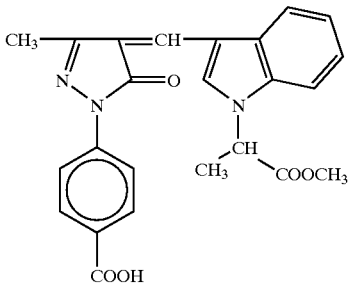
H-1
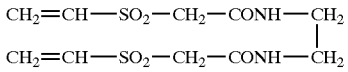
W-1
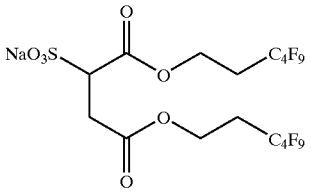
W-2
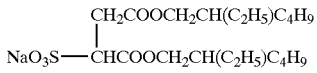
W-3
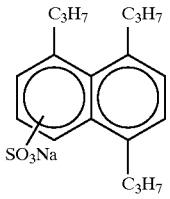
W-4
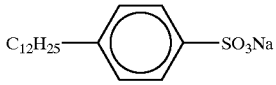
P-1
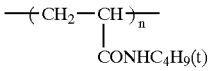
(n = 100 to 1000)
P-2
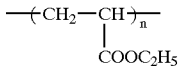
(n = 100 to 1000)
P-3
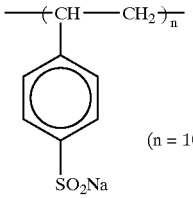
(n = 100 to 1000)
F-1
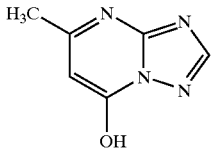
F-2
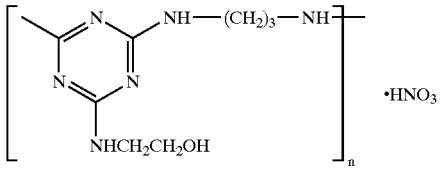
(n = 3 to 4)
F-3
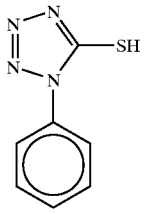
F-4
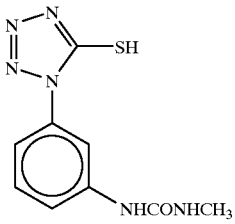
F-5
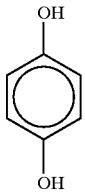

-continued

F-6

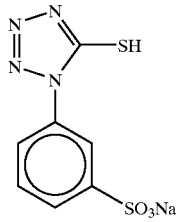

F-7

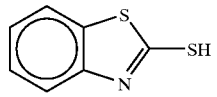

F-8

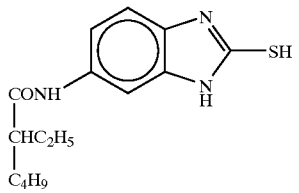

F-9

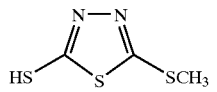

Fine-crystal Solid Dispersion

Preparation of dispersions of organic solid disperse dyes (Preparation of Fine-Crystal Solid Dispersion of Dye E-1)

100 g of Pluronic F88 (an ethylene oxide-propylene oxide block copolymer) manufactured by BASF CORP. and water were added to a wet cake of the dye E-1 (the net weight of E-1 was 270 g), and the resultant material was stirred to make 4,000 g. Next, the Ultra Visco Mill (UVM-2) manufactured by Imex K.K. was filled with 1,700 mL of zirconia beads with an average grain size of 0.5 mm, and the slurry was milled through the UVM-2 at a peripheral speed of approximately 10 m/sec and a discharge rate of 0.5 L/min for 2 hrs. The beads were filtered out, and water was added to dilute the material to a dye concentration of 3%. After that, the material was heated to 90° C. for 10 hrs for stabilization. The average grain size of the obtained fine dye grains was 0.30 $\mu$m, and the grain size distribution (grain size standard deviation×100/average grain size) was 20%.

(Preparation of Fine-Crystal Solid Dispersion of Dye E-2)

Water and 270 g of W-3 were added to 1,400 g of a wet cake of E-2 containing 30 mass % of water, and the resultant material was stirred to form a slurry having an E-2 concentration of 40 mass %. Next, the Ultra Visco Mill (UVM-2) manufactured by Imex K.K. was filled with 1,700 mL of zirconia beads with an average grain size of 0.5 mm, and the slurry was milled through the UVM-2 at a peripheral speed of approximately 10 m/sec and a discharge rate of 0.5 L/min for 8 hr. This dispersion was diluted to 20 mass % by ion exchange water to obtain a fine-crystal solid dispersion. The average grain size was 0.15 $\mu$m.

A part of sample 101 was cut into strips, which were subjected to sensito-metry through the above-mentioned developing treatment A according to the method described in the text. Thus, the weight-averaged wavelengths of the spectral sensitivity distributions of the red-, green- and blue-sensitive emulsion layers were measured to be 619 nm, 548 nm and 443 nm, respectively. Regarding each of the third layer: a short-wavelength green-sensitive interimage effect imparting layer and the fourth layer: a red-sensitive interimage effect imparting layer, a single layer was applied and the weight-averaged wavelength of the spectral sensitivity distribution was determined based on the silver development density. As a result, the weight-averaged wavelengths of the short-wavelength green-sensitive interimage effect imparting layer and the red-sensitive interimage effect imparting layer were 522 nm and 652 nm, respectively. The silver development is a developing treatment in which following the first washing in developing treatment A, the treating process from the fixing is conducted while skipping the intervening steps.

(2) Sample 102 (Comparative Example)

Preparation of a sample excluding a red-sensitive interimage effect imparting layer Sample 102 was prepared by deleting the fourth layer, which is the red-sensitive interimage effect imparting layer, from sample 101 and correcting the changes in gradation and color balance caused by the deletion based on the proportions of the emulsions in each silver halide emulsion layer.

(3) Sample 103 (Comparative Example)

Preparation of a sample excluding a short-wavelength green-sensitive interimage effect imparting layer Sample 103 was prepared by deleting the third layer, which is the short-wavelength green-sensitive interimage effect imparting layer, from sample 101 and correcting the changes in gradation and color balance caused by the deletion in the same procedure as that used for sample 102.

(4) Sample 104 (Comparative Example)

Preparation of a sample excluding both a red- and short-wavelength green-sensitive interimage effect imparting layers Sample 104 was prepared by deleting the third layer, which is the short-wavelength green-sensitive interimage effect imparting layer, the fourth layer, which is the red-sensitive interimage effect imparting layer, and the fifth layer, which is an intermediate layer, from sample 101 and correcting the changes in gradation and color balance caused by the deletion in the same procedure as that used for sample 102.

(5) Sample 105 (Present Invention)

Preparation of a sample in which spectral sensitivities of a red- and green-sensitive silver halide emulsion layers are changed Silver halide emulsions A' to F' were prepared by changing the proportions of the spectral sensitizing dyes S-2 and S-8 employed in red-sensitive silver halide emulsions A to F used for sample 101. Emulsions A to F were replaced by emulsions A' to F', respectively.

Furthermore, the amount of the emulsion of the third layer, a short-wavelength green-sensitive interimage effect imparting layer, was changed in the manner described below and the resulting changes in gradation and color balance were corrected based on the proportions of the emulsions of each silver halide emulsion layer, thereby obtaining sample 105. 3th layer: short-wavelength green-sensitive interimage effect imparting layer

| | | |
|---|---|---|
| Emulsion R | silver | 0.01 g |
| Emulsion s | silver | 0.015 g |
| Emulsion T | silver | 0.08 g |
| Silver iodide fine grain emulsion (average equivalent-sphere diameter 0.05 μm) | silver | 0.005 g |
| Gelatin | | 0.5 g |
| Compound Cpd-M | | 0.030 g |
| High-boiling organic solvent Oil-6 | | 0.030 g |
| High-boiling organic solvent Oil-7 | | 5.0 mg |
| Dye D-7 | | 4.0 mg |

(6) Sample 106 (Comparative Example)

Preparation of a sample excluding a red-sensitive interimage effect imparting layer Sample 106 was prepared by deleting the fourth layer, which is the red-sensitive interimage effect imparting layer, from sample 105 and correcting the changes in gradation and color balance caused by the deletion based on the proportions of the emulsions in each silver halide emulsion layer.

(7) Sample 107 (Comparative Example)

Preparation of a sample excluding a short-wavelength green-sensitive interimage effect imparting layer Sample 107 was prepared by deleting the third layer, which is the short-wavelength green-sensitive interimage effect imparting layer, from sample 105 and correcting the changes in gradation and color balance caused by the deletion in the same procedure as that used for sample 106.

(8) Sample 108 (Comparative Example)

Preparation of a sample excluding both a red- and short-wavelength green-sensitive interimage effect imparting layers Sample 108 was prepared by deleting the third layer, which is the short-wavelength green-sensitive interimage effect imparting layer, the fourth layer, which is the red-sensitive interimage effect imparting layer, and the fifth layer, which is an intermediate layer, from sample 105 and correcting the changes in gradation and color balance caused by the deletion in the same procedure as that used for sample 106.

(9) Sample 109 (Present Invention)

Preparation of a sample introducing a short-wavelength blue-sensitive interimage effect imparting layer Sample 109 was prepared by putting the following short-wavelength blue-sensitive interimage effect imparting layer between the 14th layer, which is the yellow filter layer, and the 15th layer, which is the low-speed blue-sensitive emulsion layer, of sample 101 and correcting the changes in gradation and color balance caused by the deletion in the same procedure as that used for sample 102.

The weight-averaged wavelength of spectral sensitivity of the short-wavelength blue-sensitive interimage effect imparting layer was 430 nm. Short-wavelength blue-sensitive interimage effect imparting layer

| | | |
|---|---|---|
| Emulsion V | silver | 0.20 g |
| Gelatin | | 0.40 g |
| Coupler C-1 | | 5.0 mg |
| Coupler C-2 | | 0.5 mg |
| High-boiling organic solvent Oil-5 | | 2.0 mg |
| Compound Cpd-Q | | 0.20 g |
| Dye D-6 | | 4.0 mg |

The characteristics of samples 101 to 109 are showed in Table 11 in a lump.

(Evaluation of Samples)

The above-described samples 101 to 109 were cut into strips and were subjected to sensitometry in the manner described below.

The spectral distribution under the standard illumination of each of the colors (relative spectral luminance) was calculated from the spectral reflectances of "gray" and "skin color," as shown in the above-mentioned Tables 1 and 2, multiplied by the spectral distribution of an ISO sensitometric daylight source (D55). The spectral distribution was generated by a spectro-sensitometer device that is able to produce any of the spectral distributions by using an intensity modulating-type mask formed by arranging liquid crystal panels in the stripe form, and further by electrically controlling the transmittance of each of the liquid crystal segments. The spectro-sensitometer device that is able to generate the above-described spectral distribution was prepared with reference to the reports presented by Enomoto et al. in the Annual Meeting of SPSTJ (Nihon Shashin Gakkai) '90. As illustrated in FIG. 1, a xenon arc lamp having a high luminance was used as a light source, and in addition, a cylindrical lens was used in the optical system, thereby obtaining a long slit light extended to the grating direction of a diffraction grating. A light separated by a transmission-type diffraction grating acts as a spectral face having a wavelength region of from 400 nm to 700 nm at the dispersion face. Onto this spectral face, were placed liquid crystal panels composed of 60 segments, in which 1 segment was 5 nm, and transmittance was controlled at intervals of 5 nm, thereby obtaining an objective spectral distribution. A color-mixed slit light was formed on the surface of exposure to light, and the exposure to light was performed by scanning the samples 101 to 109 of the present invention and commercially available color reversal film articles, designated Articles A to D, on each of which an optical wedge was placed, at an orthogonal direction to the slit light.

These samples thus exposed to light, each having a spectral distribution of "gray" and "skin color," were subjected to the above-described processing (processing A), to obtain an image. Densitometry of the thus-obtained image was carried out, respectively. The measurement of "skin color," which is reproduced by each of these samples, was carried out under the observational condition based on an isochromatic test in which twice sight (2-degree calorimetric observation) was adopted at the 1931 CIE (Commission International de I'Eclairage) Conference. Further, to calculate CIE Lab values, the CIE 976 (L*, a*, b*) isometric perceptive color space calculations were used. For a more detailed explanation of the above-mentioned calculations, reference can be made to, for example, New-Edition Color Science Handbook, edited by the publication party of Tokyo University (1980), Chapter 4. When the C* value of the "gray" image is 0.5 or more at L*=40, color correction was made by exposing to "gray" or "skin color" light passed through a commercially available color compensating filter.

Based on the calculated values of L*, a* and b*, a chroma $C^*_{70}$ at L*=70, a chroma $C^*_{50}$ at L*=50 and a chroma $C^*_{20}$ at L*=20 were determined, thereby calculating ratios ($C^*_{70}/C^*_{50}$) and ($C^*_{20}/C^*_{50}$).

In addition, the hue angle H=tan-1(a*/b*) was determined L* was determined in the range of L*=20 to 70 in increments of L*=1. Then, its standard deviation σh was calculated.

Moreover, determined was the maximum of C* value of the "gray" image in the CIE Lab color system in the range of L*=20 to 70.

Figure 2:
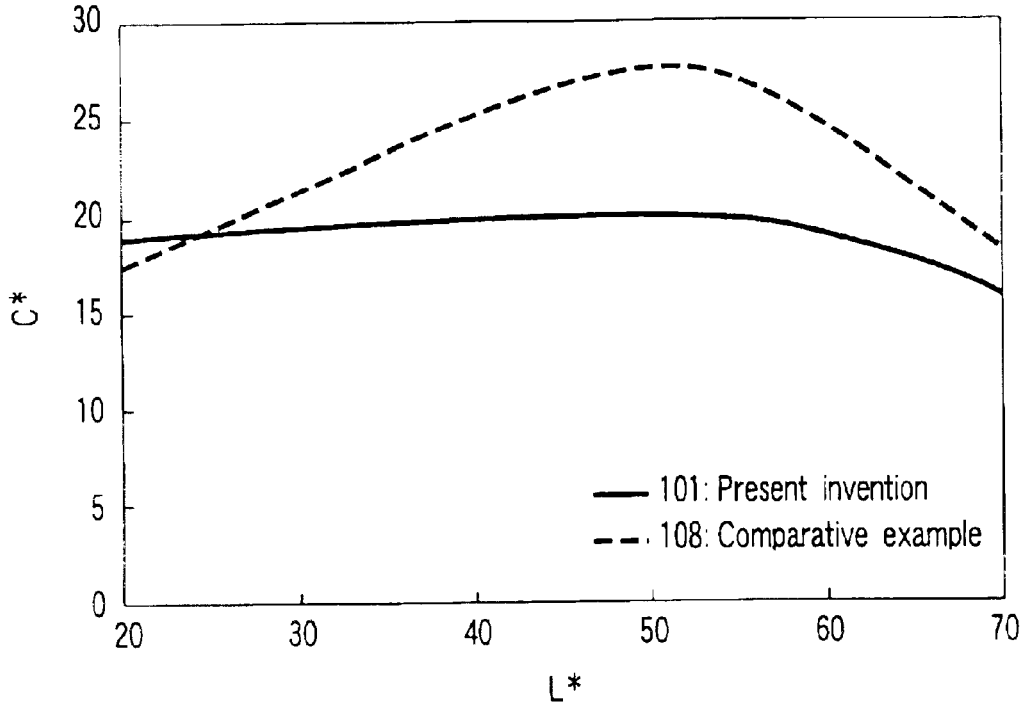
FIG. 2 is a graph showing changes in chroma C* to brightness L* in the range of L*=20 to 70 with respect to sample 101 of the present invention and sample 108 of a comparative example.
Figure 3:
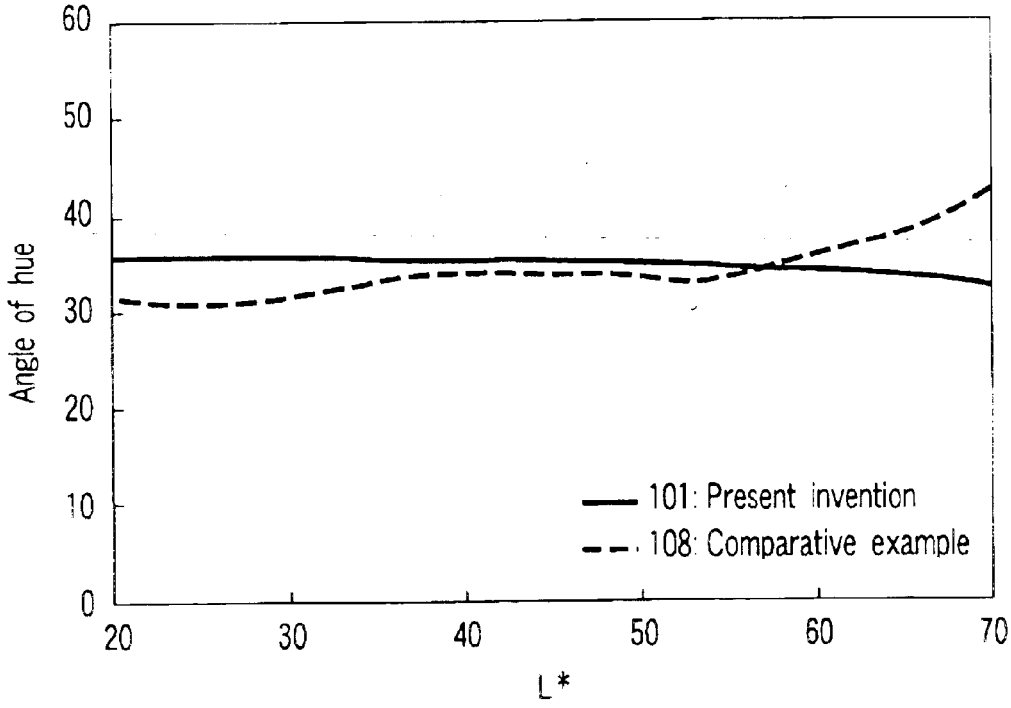
FIG. 3 is a graph showing changes in hue angle H to brightness L* in the range of L*=20 to 70 with respect to sample 101 of the present invention and sample 108 of a comparative example.

As examples, for sample 101 of the present invention and sample 108 of a comparative example, CIE Lab values were determined for the images obtained by subjecting the samples to wedge exposure at a spectral distribution of "skin color" and treatment. The changes in chroma C* in the range of brightness L*=20 to 70 and the changes in hue angle H are shown in FIGS. 2 and 3, respectively. It is apparent that the sample of the present invention exhibits smaller changes in chroma C* and in hue angle H with respect to brightness L* than those of the comparative example.

(Skin Color Photographing Under Normal Conditions)

Further, the above-described samples were each cut and processed into 60 mm width Brownie size patches of size and were loaded to a camera. Then, pictures of a white (Caucasian) man and woman, and a Japanese man and woman (the yellow race), as models, were taken indoor under a large scale stroboscopic light (color temperature of 4950K) through a diffuser, followed by the above-mentioned processing of development. Photographic properties of each processed sample were evaluated by visual sensitive evaluation. At this time, a picture of a color chip (gray 5) of Macbeth color chip No. 22 was simultaneously taken. When the C* value was not less than 0.5, a commercially available color compensating filter was inserted for each sample, to correct so that the C* value was not more than 0.5, in the same manner as the evaluation of a spectrosensitometer. The evaluation was performed by ten (10) testers. The "skin color reproduction", the "chroma of the skin color", and the "red shift in the skin color" were evaluated in accordance with the following three evaluation grades; "poor" as 0 point, "normal" as 1 point, and "very good" as 2 points. The evaluation values were represented by average values of the marks given by the ten (10) testers.

(Skin Color Photographing Under Shade)

Similarly to the skin color photographing described above, pictures of the same female models as the skin color photographing with a color chip of Macbeth color chip No. 22 were taken outdoors under clear skies in the shade of a building while employing the same color correcting filter conditions as the skin color photographing. The color temperature employed during the photographing was 8500K. Following the development described above, a visual evaluation was conducted.

The evaluation was performed by ten (10) testers. The "degree of blue fog" was evaluated in accordance with the following three evaluation grades; "poor" as 0 point, "normal" as 1 point, and "very good" as 2 points. The evaluation values of shade photographing were represented by average values of the marks given by the ten (10) testers.

(Photographing Under Fluorescent Lamp)

Similarly to the skin color photographing described above, pictures of the same female models as the skin color photographing with a color chip (gray 5) of Macbeth color chip No. 22 were taken indoors under a white fluorescent lamp (FLR40S·W/M-X, mfd. by National) or a three band fluorescent lamp (FLR40S·EX-D/M, mfd. by National) while employing the same color correcting filter conditions as the skin color photographing. Following the same development as above, a visual evaluation was conducted.

The evaluation was performed by ten (10) testers. The "degree of green fog" was evaluated in accordance with the following three evaluation grades; "poor" as 0 point, "normal" as 1 point, and "very good" as 2 points. The evaluation values of fluorescent light photographing were represented by average values of the marks given by the ten (10) testers.

(Photographing of Color Chart)

The 40 color chips the spectral reflectances of which are shown in Table 10, and gray charts of Macbeth color chip Nos. 19 to 24 were photographed simultaneously under normal photographing conditions, followed by developing treatment A as described above. For frames having a Macbeth color chip No. 22 density of 0.8±0.03 in the resulting images, the spectral absorption spectrum was measured with respect to all 40 colors by the method described above, thereby calculating CIE Lab values. From a hue angle Hi (i is a number of a color chip: 1 to 40) calculated from the values of a* and b* determined above and an original hue angle Hoi (i=1 to 40) obtained by measuring the Lab values of an original color chip in the same way, ΔH was calculated which indicates the faithfulness of the color reproduction. ΔH is represented by the following formulas.

$$\Delta H=\Sigma\sqrt{(\mathrm{Hi-Hio})}\ 2/40$$

$$\mathrm{Hi}=\tan^{-1}(a^*i/b^*i)\quad i=1\text{ to }40$$

$$\mathrm{Hoi}=\tan^{-1}(a^*0i/b^*0i)\quad i=1\text{ to }40$$

A ΔH value closer to 0 indicates that the original hue is reproduced more faithfully.

TABLE 10

| Spectral reflectance of 40 color chips Wavelength No | | | | | | | |
|---|---|---|---|---|---|---|---|
| nm | 1 | 2 | 3 | 4 | 5 | 6 | 7 |
| 380 | 0.1199 | 0.0441 | 0.0564 | 0.0523 | 0.0495 | 0.0447 | 0.0485 |
| 385 | 0.1494 | 0.0474 | 0.0625 | 0.0574 | 0.0541 | 0.0472 | 0.0515 |
| 390 | 0.2008 | 0.0506 | 0.0684 | 0.0622 | 0.0585 | 0.0495 | 0.0535 |
| 395 | 0.2696 | 0.0520 | 0.0733 | 0.0648 | 0.0612 | 0.0505 | 0.0550 |
| 400 | 0.3565 | 0.0528 | 0.0759 | 0.0659 | 0.0623 | 0.0509 | 0.0556 |
| 405 | 0.4533 | 0.0519 | 0.0754 | 0.0650 | 0.0615 | 0.0506 | 0.0544 |
| 410 | 0.5244 | 0.0504 | 0.0740 | 0.0635 | 0.0601 | 0.0496 | 0.0529 |
| 415 | 0.5678 | 0.0490 | 0.0722 | 0.0626 | 0.0590 | 0.0486 | 0.0517 |
| 420 | 0.5879 | 0.0471 | 0.0705 | 0.0617 | 0.0575 | 0.0477 | 0.0502 |
| 425 | 0.5971 | 0.0458 | 0.0688 | 0.0608 | 0.0561 | 0.0472 | 0.0489 |
| 430 | 0.6014 | 0.0442 | 0.0670 | 0.0596 | 0.0548 | 0.0465 | 0.0476 |
| 435 | 0.6024 | 0.0427 | 0.0653 | 0.0587 | 0.0537 | 0.0455 | 0.0467 |
| 440 | 0.6039 | 0.0411 | 0.0637 | 0.0579 | 0.0525 | 0.0447 | 0.0463 |
| 445 | 0.6065 | 0.0398 | 0.0621 | 0.0572 | 0.0517 | 0.0444 | 0.0460 |
| 450 | 0.6077 | 0.0384 | 0.0604 | 0.0563 | 0.0509 | 0.0442 | 0.0456 |
| 455 | 0.6070 | 0.0373 | 0.0588 | 0.0555 | 0.0505 | 0.0438 | 0.0454 |
| 460 | 0.6066 | 0.0362 | 0.0571 | 0.0548 | 0.0501 | 0.0435 | 0.0458 |
| 465 | 0.6071 | 0.0352 | 0.0554 | 0.0540 | 0.0496 | 0.0437 | 0.0462 |
| 470 | 0.6067 | 0.0343 | 0.0537 | 0.0533 | 0.0492 | 0.0440 | 0.0469 |
| 475 | 0.6064 | 0.0333 | 0.0522 | 0.0523 | 0.0486 | 0.0447 | 0.0478 |
| 480 | 0.6063 | 0.0324 | 0.0507 | 0.0512 | 0.0481 | 0.0455 | 0.0487 |
| 485 | 0.6043 | 0.0317 | 0.0497 | 0.0505 | 0.0480 | 0.0472 | 0.0495 |
| 490 | 0.6019 | 0.0306 | 0.0487 | 0.0503 | 0.0479 | 0.0493 | 0.0505 |
| 495 | 0.6030 | 0.0300 | 0.0479 | 0.0506 | 0.0481 | 0.0517 | 0.0521 |
| 500 | 0.6042 | 0.0291 | 0.0469 | 0.0508 | 0.0487 | 0.0549 | 0.0547 |
| 505 | 0.6039 | 0.0281 | 0.0457 | 0.0504 | 0.0490 | 0.0583 | 0.0585 |
| 510 | 0.6042 | 0.0270 | 0.0445 | 0.0491 | 0.0495 | 0.0638 | 0.0652 |
| 515 | 0.6049 | 0.0262 | 0.0437 | 0.0480 | 0.0506 | 0.0712 | 0.0743 |
| 520 | 0.6054 | 0.0254 | 0.0433 | 0.0475 | 0.0526 | 0.0802 | 0.0865 |
| 525 | 0.6043 | 0.0251 | 0.0432 | 0.0484 | 0.0559 | 0.0893 | 0.1015 |
| 530 | 0.6041 | 0.0255 | 0.0433 | 0.0507 | 0.0601 | 0.0960 | 0.1149 |
| 535 | 0.6038 | 0.0256 | 0.0434 | 0.0537 | 0.0640 | 0.1003 | 0.1264 |
| 540 | 0.6030 | 0.0257 | 0.0438 | 0.0575 | 0.0684 | 0.1044 | 0.1385 |
| 545 | 0.6017 | 0.0261 | 0.0444 | 0.0639 | 0.0755 | 0.1118 | 0.1580 |
| 550 | 0.6014 | 0.0270 | 0.0468 | 0.0743 | 0.0892 | 0.1269 | 0.1930 |
| 555 | 0.6022 | 0.0286 | 0.0531 | 0.0879 | 0.1115 | 0.1512 | 0.2444 |
| 560 | 0.6025 | 0.0309 | 0.0644 | 0.1046 | 0.1431 | 0.1855 | 0.3082 |
| 565 | 0.6040 | 0.0346 | 0.0834 | 0.1288 | 0.1883 | 0.2340 | 0.3860 |
| 570 | 0.6047 | 0.0396 | 0.1127 | 0.1638 | 0.2481 | 0.2963 | 0.4728 |
| 575 | 0.6027 | 0.0465 | 0.1579 | 0.2171 | 0.3266 | 0.3758 | 0.5666 |
| 580 | 0.6023 | 0.0552 | 0.2132 | 0.2803 | 0.4068 | 0.4565 | 0.6426 |
| 585 | 0.6022 | 0.0690 | 0.2837 | 0.3561 | 0.4920 | 0.5402 | 0.7054 |
| 590 | 0.6010 | 0.0947 | 0.3756 | 0.4460 | 0.5815 | 0.6239 | 0.7560 |
| 595 | 0.6014 | 0.1340 | 0.4688 | 0.5278 | 0.6519 | 0.6877 | 0.7908 |
| 600 | 0.6012 | 0.1945 | 0.5608 | 0.6017 | 0.7071 | 0.7355 | 0.8155 |
| 605 | 0.6003 | 0.2872 | 0.6469 | 0.6657 | 0.7495 | 0.7686 | 0.8335 |
| 610 | 0.5991 | 0.3874 | 0.7060 | 0.7079 | 0.7745 | 0.7867 | 0.8436 |
| 615 | 0.5971 | 0.4869 | 0.7465 | 0.7365 | 0.7896 | 0.7966 | 0.8501 |

TABLE 10-continued

| Spectral reflectance of 40 color chips Wavelength No | | | | | | | |
|---|---|---|---|---|---|---|---|
| 620 | 0.5971 | 0.5831 | 0.7778 | 0.7605 | 0.8036 | 0.8063 | 0.8601 |
| 625 | 0.5958 | 0.6495 | 0.7965 | 0.7750 | 0.8123 | 0.8126 | 0.8667 |
| 630 | 0.5930 | 0.6993 | 0.8101 | 0.7844 | 0.8172 | 0.8144 | 0.8700 |
| 635 | 0.5927 | 0.7305 | 0.8231 | 0.7932 | 0.8215 | 0.8170 | 0.8745 |
| 640 | 0.5928 | 0.7514 | 0.8343 | 0.7995 | 0.8245 | 0.8202 | 0.8788 |
| 645 | 0.5909 | 0.7661 | 0.8433 | 0.8025 | 0.8253 | 0.8224 | 0.8812 |
| 650 | 0.5907 | 0.7756 | 0.8512 | 0.8054 | 0.8271 | 0.8243 | 0.8841 |
| 655 | 0.5918 | 0.7870 | 0.8631 | 0.8127 | 0.8318 | 0.8284 | 0.8897 |
| 660 | 0.5895 | 0.7925 | 0.8692 | 0.8176 | 0.8328 | 0.8317 | 0.8919 |
| 665 | 0.5880 | 0.7973 | 0.8745 | 0.8203 | 0.8328 | 0.8339 | 0.8943 |
| 670 | 0.5873 | 0.8019 | 0.8809 | 0.8226 | 0.8336 | 0.8371 | 0.8974 |
| 675 | 0.5859 | 0.8031 | 0.8834 | 0.8233 | 0.8329 | 0.8379 | 0.8975 |
| 680 | 0.5850 | 0.8046 | 0.8855 | 0.8253 | 0.8337 | 0.8389 | 0.8971 |
| 685 | 0.5838 | 0.8065 | 0.8882 | 0.8288 | 0.8348 | 0.8416 | 0.8987 |
| 690 | 0.5824 | 0.8077 | 0.8891 | 0.8323 | 0.8364 | 0.8447 | 0.9009 |
| 695 | 0.5816 | 0.8115 | 0.8926 | 0.8358 | 0.8385 | 0.8492 | 0.9035 |
| 700 | 0.5800 | 0.8179 | 0.8983 | 0.8427 | 0.8409 | 0.8576 | 0.9081 |
| 705 | 0.5792 | 0.8214 | 0.9008 | 0.8470 | 0.8419 | 0.8620 | 0.9121 |
| 710 | 0.5764 | 0.8237 | 0.9032 | 0.8499 | 0.8410 | 0.8639 | 0.9129 |
| 715 | 0.5765 | 0.8287 | 0.9074 | 0.8551 | 0.8442 | 0.8674 | 0.9173 |
| 720 | 0.5761 | 0.8326 | 0.9093 | 0.8580 | 0.8474 | 0.8707 | 0.9191 |
| 725 | 0.5740 | 0.8345 | 0.9092 | 0.8603 | 0.8475 | 0.8727 | 0.9174 |
| 730 | 0.5714 | 0.8381 | 0.9086 | 0.8657 | 0.8488 | 0.8765 | 0.9182 |
| 735 | 0.5693 | 0.8388 | 0.9105 | 0.8674 | 0.8496 | 0.8797 | 0.9211 |
| 740 | 0.5692 | 0.8430 | 0.9152 | 0.8704 | 0.8532 | 0.8855 | 0.9276 |
| 745 | 0.5671 | 0.8459 | 0.9124 | 0.8717 | 0.8511 | 0.8880 | 0.9245 |
| 750 | 0.5665 | 0.8485 | 0.9151 | 0.8739 | 0.8513 | 0.8910 | 0.9241 |
| 755 | 0.5666 | 0.8517 | 0.9186 | 0.8780 | 0.8523 | 0.8942 | 0.9284 |
| 760 | 0.5643 | 0.8527 | 0.9169 | 0.8781 | 0.8541 | 0.8943 | 0.9312 |
| 765 | 0.5593 | 0.8494 | 0.9133 | 0.8736 | 0.8529 | 0.8910 | 0.9270 |
| 770 | 0.5553 | 0.8508 | 0.9111 | 0.8732 | 0.8505 | 0.8917 | 0.9235 |
| 775 | 0.5523 | 0.8543 | 0.9114 | 0.8751 | 0.8535 | 0.8918 | 0.9258 |
| 780 | 0.5567 | 0.8614 | 0.9186 | 0.8826 | 0.8574 | 0.8967 | 0.9337 |

| nm | 8 | 9 | 10 | 11 | 12 | 13 | 14 |
|---|---|---|---|---|---|---|---|
| 380 | 0.0476 | 0.0605 | 0.0380 | 0.0391 | 0.0315 | 0.0242 | 0.0515 |
| 385 | 0.0507 | 0.0643 | 0.0379 | 0.0409 | 0.0312 | 0.0236 | 0.0532 |
| 390 | 0.0528 | 0.0670 | 0.0379 | 0.0415 | 0.0305 | 0.0228 | 0.0544 |
| 395 | 0.0538 | 0.0685 | 0.0383 | 0.0420 | 0.0299 | 0.0227 | 0.0557 |
| 400 | 0.0544 | 0.0686 | 0.0387 | 0.0421 | 0.0300 | 0.0228 | 0.0566 |
| 405 | 0.0537 | 0.0667 | 0.0381 | 0.0415 | 0.0296 | 0.0228 | 0.0564 |
| 410 | 0.0528 | 0.0642 | 0.0374 | 0.0411 | 0.0290 | 0.0232 | 0.0560 |
| 415 | 0.0523 | 0.0621 | 0.0376 | 0.0407 | 0.0291 | 0.0237 | 0.0560 |
| 420 | 0.0510 | 0.0602 | 0.0373 | 0.0398 | 0.0289 | 0.0243 | 0.0559 |
| 425 | 0.0502 | 0.0578 | 0.0375 | 0.0393 | 0.0289 | 0.0251 | 0.0561 |
| 430 | 0.0490 | 0.0553 | 0.0377 | 0.0387 | 0.0295 | 0.0269 | 0.0561 |
| 435 | 0.0477 | 0.0530 | 0.0377 | 0.0381 | 0.0295 | 0.0286 | 0.0564 |
| 440 | 0.0471 | 0.0510 | 0.0383 | 0.0377 | 0.0299 | 0.0305 | 0.0576 |
| 445 | 0.0469 | 0.0500 | 0.0396 | 0.0377 | 0.0308 | 0.0331 | 0.0596 |
| 450 | 0.0470 | 0.0490 | 0.0409 | 0.0381 | 0.0321 | 0.0372 | 0.0631 |
| 455 | 0.0473 | 0.0478 | 0.0424 | 0.0389 | 0.0342 | 0.0419 | 0.0683 |
| 460 | 0.0469 | 0.0470 | 0.0449 | 0.0401 | 0.0375 | 0.0492 | 0.0783 |
| 465 | 0.0463 | 0.0464 | 0.0473 | 0.0414 | 0.0408 | 0.0581 | 0.0925 |
| 470 | 0.0461 | 0.0458 | 0.0508 | 0.0437 | 0.0459 | 0.0698 | 0.1129 |
| 475 | 0.0457 | 0.0455 | 0.0553 | 0.0477 | 0.0540 | 0.0882 | 0.1435 |
| 480 | 0.0455 | 0.0450 | 0.0603 | 0.0529 | 0.0642 | 0.1103 | 0.1778 |
| 485 | 0.0463 | 0.0445 | 0.0670 | 0.0605 | 0.0788 | 0.1385 | 0.2196 |
| 490 | 0.0479 | 0.0445 | 0.0749 | 0.0715 | 0.1007 | 0.1764 | 0.2740 |
| 495 | 0.0494 | 0.0454 | 0.0823 | 0.0846 | 0.1286 | 0.2182 | 0.3329 |
| 500 | 0.0509 | 0.0478 | 0.0910 | 0.1020 | 0.1689 | 0.2730 | 0.4063 |
| 505 | 0.0523 | 0.0523 | 0.0986 | 0.1201 | 0.2148 | 0.3303 | 0.4749 |
| 510 | 0.0552 | 0.0625 | 0.1081 | 0.1440 | 0.2788 | 0.4024 | 0.5475 |
| 515 | 0.0603 | 0.0821 | 0.1207 | 0.1748 | 0.3549 | 0.4745 | 0.6091 |
| 520 | 0.0699 | 0.1176 | 0.1405 | 0.2199 | 0.4493 | 0.5445 | 0.6637 |
| 525 | 0.0889 | 0.1773 | 0.1771 | 0.2925 | 0.5592 | 0.6049 | 0.7099 |
| 530 | 0.1161 | 0.2480 | 0.2306 | 0.3857 | 0.6500 | 0.6452 | 0.7429 |
| 535 | 0.1471 | 0.3148 | 0.2963 | 0.4862 | 0.7152 | 0.6712 | 0.7648 |
| 540 | 0.1813 | 0.3748 | 0.3750 | 0.5864 | 0.7606 | 0.6891 | 0.7807 |
| 545 | 0.2263 | 0.4324 | 0.4775 | 0.6844 | 0.7943 | 0.7035 | 0.7938 |
| 550 | 0.2860 | 0.4817 | 0.5828 | 0.7524 | 0.8164 | 0.7153 | 0.8019 |
| 555 | 0.3596 | 0.5209 | 0.6638 | 0.7878 | 0.8303 | 0.7235 | 0.8066 |
| 560 | 0.4408 | 0.5494 | 0.7177 | 0.8049 | 0.8369 | 0.7278 | 0.8065 |
| 565 | 0.5288 | 0.5744 | 0.7575 | 0.8173 | 0.8427 | 0.7338 | 0.8067 |
| 570 | 0.6097 | 0.6002 | 0.7846 | 0.8260 | 0.8485 | 0.7394 | 0.8070 |
| 575 | 0.6752 | 0.6358 | 0.8005 | 0.8287 | 0.8501 | 0.7412 | 0.8033 |
| 580 | 0.7159 | 0.6857 | 0.8096 | 0.8303 | 0.8517 | 0.7432 | 0.7984 |

TABLE 10-continued

| Spectral reflectance of 40 color chips Wavelength No | | | | | | | |
|---|---|---|---|---|---|---|---|
| 585 | 0.7436 | 0.7489 | 0.8169 | 0.8327 | 0.8545 | 0.7451 | 0.7931 |
| 590 | 0.7612 | 0.8137 | 0.8222 | 0.8339 | 0.8546 | 0.7430 | 0.7836 |
| 595 | 0.7731 | 0.8594 | 0.8272 | 0.8367 | 0.8570 | 0.7411 | 0.7739 |
| 600 | 0.7811 | 0.8892 | 0.8310 | 0.8396 | 0.8602 | 0.7391 | 0.7625 |
| 605 | 0.7862 | 0.9080 | 0.8333 | 0.8415 | 0.8622 | 0.7358 | 0.7494 |
| 610 | 0.7888 | 0.9173 | 0.8350 | 0.8415 | 0.8630 | 0.7327 | 0.7386 |
| 615 | 0.7903 | 0.9221 | 0.8362 | 0.8409 | 0.8623 | 0.7297 | 0.7284 |
| 620 | 0.7956 | 0.9288 | 0.8404 | 0.8448 | 0.8658 | 0.7314 | 0.7221 |
| 625 | 0.7986 | 0.9335 | 0.8437 | 0.8484 | 0.8692 | 0.7331 | 0.7184 |
| 630 | 0.7995 | 0.9363 | 0.8459 | 0.8499 | 0.8717 | 0.7333 | 0.7141 |
| 635 | 0.8020 | 0.9395 | 0.8497 | 0.8528 | 0.8741 | 0.7366 | 0.7128 |
| 640 | 0.8049 | 0.9431 | 0.8529 | 0.8565 | 0.8763 | 0.7404 | 0.7123 |
| 645 | 0.8058 | 0.9442 | 0.8535 | 0.8575 | 0.8771 | 0.7410 | 0.7095 |
| 650 | 0.8069 | 0.9456 | 0.8554 | 0.8597 | 0.8785 | 0.7432 | 0.7086 |
| 655 | 0.8115 | 0.9502 | 0.8599 | 0.8657 | 0.8839 | 0.7495 | 0.7111 |
| 660 | 0.8135 | 0.9519 | 0.8618 | 0.8676 | 0.8852 | 0.7539 | 0.7140 |
| 665 | 0.8141 | 0.9533 | 0.8637 | 0.8680 | 0.8856 | 0.7576 | 0.7193 |
| 670 | 0.8159 | 0.9546 | 0.8661 | 0.8712 | 0.8867 | 0.7651 | 0.7273 |
| 675 | 0.8158 | 0.9537 | 0.8643 | 0.8720 | 0.8851 | 0.7707 | 0.7324 |
| 680 | 0.8156 | 0.9548 | 0.8625 | 0.8723 | 0.8838 | 0.7763 | 0.7391 |
| 685 | 0.8162 | 0.9555 | 0.8622 | 0.8749 | 0.8847 | 0.7832 | 0.7472 |
| 690 | 0.8169 | 0.9562 | 0.8628 | 0.8770 | 0.8845 | 0.7905 | 0.7542 |
| 695 | 0.8201 | 0.9590 | 0.8659 | 0.8796 | 0.8865 | 0.7963 | 0.7618 |
| 700 | 0.8266 | 0.9629 | 0.8736 | 0.8853 | 0.8948 | 0.8049 | 0.7724 |
| 705 | 0.8288 | 0.9657 | 0.8772 | 0.8878 | 0.8965 | 0.8079 | 0.7764 |
| 710 | 0.8299 | 0.9667 | 0.8785 | 0.8901 | 0.8962 | 0.8078 | 0.7761 |
| 715 | 0.8330 | 0.9698 | 0.8835 | 0.8941 | 0.8985 | 0.8106 | 0.7750 |
| 720 | 0.8349 | 0.9716 | 0.8867 | 0.8977 | 0.9015 | 0.8127 | 0.7755 |
| 725 | 0.8361 | 0.9720 | 0.8864 | 0.8991 | 0.9020 | 0.8124 | 0.7734 |
| 730 | 0.8400 | 0.9736 | 0.8866 | 0.9001 | 0.9025 | 0.8155 | 0.7766 |
| 735 | 0.8421 | 0.9731 | 0.8894 | 0.9007 | 0.9036 | 0.8194 | 0.7836 |
| 740 | 0.8462 | 0.9789 | 0.8938 | 0.9050 | 0.9071 | 0.8278 | 0.7953 |
| 745 | 0.8481 | 0.9789 | 0.8928 | 0.9028 | 0.9060 | 0.8328 | 0.8041 |
| 750 | 0.8514 | 0.9818 | 0.8948 | 0.9036 | 0.9068 | 0.8350 | 0.8126 |
| 755 | 0.8526 | 0.9876 | 0.8988 | 0.9078 | 0.9094 | 0.8401 | 0.8230 |
| 760 | 0.8531 | 0.9821 | 0.8986 | 0.9084 | 0.9086 | 0.8421 | 0.8308 |
| 765 | 0.8515 | 0.9787 | 0.8946 | 0.9071 | 0.9071 | 0.8419 | 0.8335 |
| 770 | 0.8513 | 0.9820 | 0.8962 | 0.9091 | 0.9088 | 0.8440 | 0.8347 |
| 775 | 0.8535 | 0.9786 | 0.8964 | 0.9099 | 0.9057 | 0.8439 | 0.8389 |
| 780 | 0.8599 | 0.9821 | 0.8972 | 0.9127 | 0.9086 | 0.8487 | 0.8486 |

| nm | 15 | 16 | 17 | 18 | 19 | 20 | 21 |
|---|---|---|---|---|---|---|---|
| 380 | 0.0474 | 0.0470 | 0.0360 | 0.0509 | 0.0556 | 0.0586 | 0.0539 |
| 385 | 0.0506 | 0.0506 | 0.0390 | 0.0552 | 0.0628 | 0.0667 | 0.0626 |
| 390 | 0.0539 | 0.0546 | 0.0419 | 0.0590 | 0.0701 | 0.0763 | 0.0711 |
| 395 | 0.0561 | 0.0577 | 0.0435 | 0.0619 | 0.0761 | 0.0836 | 0.0782 |
| 400 | 0.0575 | 0.0592 | 0.0454 | 0.0646 | 0.0810 | 0.0889 | 0.0837 |
| 405 | 0.0581 | 0.0597 | 0.0467 | 0.0654 | 0.0837 | 0.0921 | 0.0865 |
| 410 | 0.0583 | 0.0602 | 0.0473 | 0.0654 | 0.0846 | 0.0933 | 0.0879 |
| 415 | 0.0585 | 0.0609 | 0.0485 | 0.0656 | 0.0850 | 0.0945 | 0.0889 |
| 420 | 0.0586 | 0.0613 | 0.0499 | 0.0657 | 0.0855 | 0.0952 | 0.0898 |
| 425 | 0.0591 | 0.0615 | 0.0516 | 0.0660 | 0.0863 | 0.0957 | 0.0911 |
| 430 | 0.0599 | 0.0622 | 0.0543 | 0.0665 | 0.0875 | 0.0977 | 0.0927 |
| 435 | 0.0607 | 0.0629 | 0.0571 | 0.0672 | 0.0893 | 0.0996 | 0.0948 |
| 440 | 0.0624 | 0.0644 | 0.0610 | 0.0687 | 0.0921 | 0.1020 | 0.0984 |
| 445 | 0.0652 | 0.0674 | 0.0661 | 0.0710 | 0.0959 | 0.1060 | 0.1025 |
| 450 | 0.0696 | 0.0714 | 0.0736 | 0.0746 | 0.1009 | 0.1115 | 0.1081 |
| 455 | 0.0751 | 0.0757 | 0.0829 | 0.0794 | 0.1072 | 0.1175 | 0.1156 |
| 460 | 0.0836 | 0.0829 | 0.0967 | 0.0867 | 0.1164 | 0.1276 | 0.1266 |
| 465 | 0.0944 | 0.0922 | 0.1128 | 0.0954 | 0.1272 | 0.1397 | 0.1399 |
| 470 | 0.1094 | 0.1045 | 0.1325 | 0.1069 | 0.1411 | 0.1550 | 0.1584 |
| 475 | 0.1310 | 0.1226 | 0.1579 | 0.1245 | 0.1610 | 0.1769 | 0.1846 |
| 480 | 0.1558 | 0.1435 | 0.1837 | 0.1449 | 0.1847 | 0.2023 | 0.2139 |
| 485 | 0.1872 | 0.1696 | 0.2111 | 0.1710 | 0.2141 | 0.2344 | 0.2487 |
| 490 | 0.2307 | 0.2050 | 0.2430 | 0.2079 | 0.2541 | 0.2789 | 0.2929 |
| 495 | 0.2801 | 0.2445 | 0.2745 | 0.2501 | 0.2980 | 0.3285 | 0.3402 |
| 500 | 0.3447 | 0.2951 | 0.3137 | 0.3047 | 0.3529 | 0.3917 | 0.3954 |
| 505 | 0.4084 | 0.3453 | 0.3562 | 0.3590 | 0.4066 | 0.4513 | 0.4402 |
| 510 | 0.4827 | 0.4061 | 0.4141 | 0.4206 | 0.4683 | 0.5133 | 0.4773 |
| 515 | 0.5559 | 0.4711 | 0.4770 | 0.4787 | 0.5275 | 0.5643 | 0.4979 |
| 520 | 0.6305 | 0.5464 | 0.5421 | 0.5369 | 0.5873 | 0.6050 | 0.5054 |
| 525 | 0.7035 | 0.6294 | 0.6002 | 0.5917 | 0.6431 | 0.6302 | 0.4995 |
| 530 | 0.7594 | 0.6947 | 0.6371 | 0.6300 | 0.6775 | 0.6368 | 0.4878 |
| 535 | 0.7972 | 0.7377 | 0.6577 | 0.6513 | 0.6901 | 0.6310 | 0.4731 |
| 540 | 0.8224 | 0.7656 | 0.6680 | 0.6612 | 0.6892 | 0.6168 | 0.4551 |
| 545 | 0.8389 | 0.7819 | 0.6702 | 0.6614 | 0.6742 | 0.5911 | 0.4292 |

TABLE 10-continued

Spectral reflectance of 40 color chips Wavelength No

| | | | | | | | |
|---|---|---|---|---|---|---|---|
| 550 | 0.8478 | 0.7871 | 0.6656 | 0.6516 | 0.6478 | 0.5572 | 0.3973 |
| 555 | 0.8491 | 0.7852 | 0.6556 | 0.6350 | 0.6179 | 0.5231 | 0.3661 |
| 560 | 0.8432 | 0.7761 | 0.6422 | 0.6149 | 0.5865 | 0.4894 | 0.3368 |
| 565 | 0.8382 | 0.7650 | 0.6279 | 0.5939 | 0.5550 | 0.4572 | 0.3087 |
| 570 | 0.8308 | 0.7503 | 0.6114 | 0.5716 | 0.5230 | 0.4258 | 0.2824 |
| 575 | 0.8161 | 0.7278 | 0.5894 | 0.5432 | 0.4842 | 0.3898 | 0.2548 |
| 580 | 0.8017 | 0.7064 | 0.5675 | 0.5162 | 0.4494 | 0.3577 | 0.2305 |
| 585 | 0.7850 | 0.6816 | 0.5442 | 0.4875 | 0.4156 | 0.3270 | 0.2066 |
| 590 | 0.7601 | 0.6483 | 0.5159 | 0.4528 | 0.3775 | 0.2931 | 0.1805 |
| 595 | 0.7351 | 0.6166 | 0.4903 | 0.4211 | 0.3452 | 0.2653 | 0.1581 |
| 600 | 0.7072 | 0.5827 | 0.4666 | 0.3899 | 0.3173 | 0.2398 | 0.1376 |
| 605 | 0.6732 | 0.5456 | 0.4437 | 0.3566 | 0.2918 | 0.2156 | 0.1186 |
| 610 | 0.6435 | 0.5157 | 0.4268 | 0.3302 | 0.2734 | 0.1987 | 0.1050 |
| 615 | 0.6172 | 0.4902 | 0.4143 | 0.3084 | 0.2595 | 0.1858 | 0.0944 |
| 620 | 0.5970 | 0.4712 | 0.4068 | 0.2914 | 0.2498 | 0.1770 | 0.0865 |
| 625 | 0.5831 | 0.4583 | 0.4022 | 0.2803 | 0.2436 | 0.1710 | 0.0816 |
| 630 | 0.5688 | 0.4455 | 0.3976 | 0.2700 | 0.2381 | 0.1651 | 0.0774 |
| 635 | 0.5591 | 0.4364 | 0.3946 | 0.2617 | 0.2345 | 0.1610 | 0.0742 |
| 640 | 0.5507 | 0.4275 | 0.3927 | 0.2539 | 0.2310 | 0.1578 | 0.0715 |
| 645 | 0.5389 | 0.4180 | 0.3909 | 0.2456 | 0.2273 | 0.1540 | 0.0685 |
| 650 | 0.5315 | 0.4132 | 0.3912 | 0.2405 | 0.2257 | 0.1519 | 0.0665 |
| 655 | 0.5267 | 0.4095 | 0.3946 | 0.2367 | 0.2260 | 0.1505 | 0.0648 |
| 660 | 0.5237 | 0.4069 | 0.4005 | 0.2338 | 0.2282 | 0.1498 | 0.0635 |
| 665 | 0.5248 | 0.4072 | 0.4086 | 0.2324 | 0.2317 | 0.1509 | 0.0630 |
| 670 | 0.5314 | 0.4117 | 0.4208 | 0.2336 | 0.2389 | 0.1547 | 0.0632 |
| 675 | 0.5390 | 0.4180 | 0.4320 | 0.2365 | 0.2469 | 0.1592 | 0.0642 |
| 680 | 0.5487 | 0.4277 | 0.4435 | 0.2415 | 0.2549 | 0.1638 | 0.0657 |
| 685 | 0.5613 | 0.4391 | 0.4558 | 0.2478 | 0.2631 | 0.1690 | 0.0675 |
| 690 | 0.5769 | 0.4523 | 0.4682 | 0.2552 | 0.2720 | 0.1756 | 0.0704 |
| 695 | 0.5924 | 0.4659 | 0.4786 | 0.2634 | 0.2802 | 0.1818 | 0.0738 |
| 700 | 0.6173 | 0.4875 | 0.4916 | 0.2763 | 0.2933 | 0.1913 | 0.0789 |
| 705 | 0.6255 | 0.4953 | 0.4946 | 0.2803 | 0.2966 | 0.1945 | 0.0807 |
| 710 | 0.6298 | 0.4981 | 0.4953 | 0.2814 | 0.2962 | 0.1953 | 0.0818 |
| 715 | 0.6310 | 0.4980 | 0.4948 | 0.2805 | 0.2941 | 0.1940 | 0.0815 |
| 720 | 0.6284 | 0.4944 | 0.4939 | 0.2777 | 0.2904 | 0.1909 | 0.0795 |
| 725 | 0.6247 | 0.4913 | 0.4940 | 0.2747 | 0.2885 | 0.1883 | 0.0783 |
| 730 | 0.6249 | 0.4917 | 0.5000 | 0.2735 | 0.2924 | 0.1879 | 0.0777 |
| 735 | 0.6312 | 0.4979 | 0.5119 | 0.2759 | 0.3022 | 0.1927 | 0.0791 |
| 740 | 0.6467 | 0.5133 | 0.5341 | 0.2834 | 0.3183 | 0.2015 | 0.0822 |
| 745 | 0.6643 | 0.5314 | 0.5548 | 0.2919 | 0.3353 | 0.2110 | 0.0865 |
| 750 | 0.6799 | 0.5459 | 0.5725 | 0.2990 | 0.3484 | 0.2185 | 0.0890 |
| 755 | 0.6974 | 0.5612 | 0.5963 | 0.3098 | 0.3655 | 0.2278 | 0.0943 |
| 760 | 0.7081 | 0.5736 | 0.6101 | 0.3186 | 0.3779 | 0.2366 | 0.0992 |
| 765 | 0.7182 | 0.5870 | 0.6163 | 0.3289 | 0.3875 | 0.2435 | 0.1031 |
| 770 | 0.7327 | 0.6025 | 0.6255 | 0.3427 | 0.3975 | 0.2509 | 0.1095 |
| 775 | 0.7524 | 0.6235 | 0.6330 | 0.3583 | 0.4061 | 0.2612 | 0.1191 |
| 780 | 0.7768 | 0.6485 | 0.6427 | 0.3785 | 0.4179 | 0.2749 | 0.1293 |

| nm | 22 | 23 | 24 | 25 | 26 | 27 | 28 |
|---|---|---|---|---|---|---|---|
| 380 | 0.0559 | 0.0591 | 0.0668 | 0.0617 | 0.0707 | 0.0691 | 0.0654 |
| 385 | 0.0646 | 0.0711 | 0.0813 | 0.0754 | 0.0873 | 0.0862 | 0.0836 |
| 390 | 0.0750 | 0.0856 | 0.0992 | 0.0927 | 0.1088 | 0.1089 | 0.1066 |
| 395 | 0.0835 | 0.0985 | 0.1140 | 0.1085 | 0.1295 | 0.1307 | 0.1297 |
| 400 | 0.0895 | 0.1084 | 0.1259 | 0.1226 | 0.1476 | 0.1508 | 0.1516 |
| 405 | 0.0934 | 0.1151 | 0.1346 | 0.1341 | 0.1617 | 0.1672 | 0.1688 |
| 410 | 0.0951 | 0.1187 | 0.1398 | 0.1419 | 0.1705 | 0.1773 | 0.1802 |
| 415 | 0.0969 | 0.1216 | 0.1437 | 0.1488 | 0.1764 | 0.1858 | 0.1896 |
| 420 | 0.0983 | 0.1248 | 0.1462 | 0.1553 | 0.1813 | 0.1937 | 0.1979 |
| 425 | 0.0994 | 0.1277 | 0.1486 | 0.1633 | 0.1876 | 0.2029 | 0.2070 |
| 430 | 0.1019 | 0.1310 | 0.1526 | 0.1733 | 0.1961 | 0.2142 | 0.2182 |
| 435 | 0.1042 | 0.1345 | 0.1570 | 0.1824 | 0.2031 | 0.2247 | 0.2294 |
| 440 | 0.1080 | 0.1406 | 0.1633 | 0.1943 | 0.2131 | 0.2384 | 0.2436 |
| 445 | 0.1127 | 0.1477 | 0.1706 | 0.2083 | 0.2243 | 0.2543 | 0.2591 |
| 450 | 0.1187 | 0.1566 | 0.1802 | 0.2276 | 0.2378 | 0.2764 | 0.2784 |
| 455 | 0.1265 | 0.1664 | 0.1896 | 0.2504 | 0.2531 | 0.3006 | 0.2987 |
| 460 | 0.1387 | 0.1813 | 0.2043 | 0.2840 | 0.2758 | 0.3345 | 0.3263 |
| 465 | 0.1547 | 0.2025 | 0.2249 | 0.3213 | 0.3000 | 0.3713 | 0.3548 |
| 470 | 0.1773 | 0.2317 | 0.2536 | 0.3613 | 0.3251 | 0.4096 | 0.3831 |
| 475 | 0.2096 | 0.2720 | 0.2911 | 0.4039 | 0.3531 | 0.4496 | 0.4100 |
| 480 | 0.2438 | 0.3127 | 0.3252 | 0.4395 | 0.3776 | 0.4816 | 0.4293 |
| 485 | 0.2822 | 0.3526 | 0.3568 | 0.4695 | 0.3997 | 0.5074 | 0.4438 |
| 490 | 0.3256 | 0.3919 | 0.3856 | 0.4909 | 0.4177 | 0.5251 | 0.4525 |
| 495 | 0.3663 | 0.4241 | 0.4059 | 0.5019 | 0.4299 | 0.5322 | 0.4548 |
| 500 | 0.4078 | 0.4506 | 0.4196 | 0.5043 | 0.4376 | 0.5293 | 0.4519 |
| 505 | 0.4349 | 0.4614 | 0.4231 | 0.4984 | 0.4388 | 0.5176 | 0.4445 |
| 510 | 0.4508 | 0.4603 | 0.4180 | 0.4859 | 0.4348 | 0.4968 | 0.4304 |

TABLE 10-continued

Spectral reflectance of 40 color chips Wavelength No

| | | | | | | | |
|---|---|---|---|---|---|---|---|
| 515 | 0.4535 | 0.4505 | 0.4057 | 0.4699 | 0.4261 | 0.4722 | 0.4127 |
| 520 | 0.4468 | 0.4334 | 0.3883 | 0.4506 | 0.4109 | 0.4440 | 0.3897 |
| 525 | 0.4318 | 0.4083 | 0.3643 | 0.4241 | 0.3862 | 0.4087 | 0.3595 |
| 530 | 0.4153 | 0.3843 | 0.3396 | 0.3974 | 0.3602 | 0.3769 | 0.3309 |
| 535 | 0.3973 | 0.3610 | 0.3162 | 0.3708 | 0.3340 | 0.3476 | 0.3043 |
| 540 | 0.3761 | 0.3363 | 0.2923 | 0.3434 | 0.3063 | 0.3181 | 0.2782 |
| 545 | 0.3473 | 0.3049 | 0.2625 | 0.3093 | 0.2725 | 0.2833 | 0.2467 |
| 550 | 0.3143 | 0.2708 | 0.2309 | 0.2731 | 0.2375 | 0.2470 | 0.2142 |
| 555 | 0.2835 | 0.2403 | 0.2036 | 0.2416 | 0.2078 | 0.2165 | 0.1871 |
| 560 | 0.2560 | 0.2148 | 0.1811 | 0.2139 | 0.1835 | 0.1913 | 0.1652 |
| 565 | 0.2312 | 0.1925 | 0.1622 | 0.1898 | 0.1632 | 0.1697 | 0.1470 |
| 570 | 0.2084 | 0.1728 | 0.1465 | 0.1678 | 0.1466 | 0.1511 | 0.1321 |
| 575 | 0.1841 | 0.1534 | 0.1318 | 0.1447 | 0.1309 | 0.1327 | 0.1182 |
| 580 | 0.1635 | 0.1379 | 0.1209 | 0.1265 | 0.1186 | 0.1190 | 0.1076 |
| 585 | 0.1441 | 0.1238 | 0.1112 | 0.1096 | 0.1079 | 0.1070 | 0.0986 |
| 590 | 0.1237 | 0.1084 | 0.1006 | 0.0928 | 0.0968 | 0.0947 | 0.0897 |
| 595 | 0.1066 | 0.0955 | 0.0915 | 0.0805 | 0.0879 | 0.0850 | 0.0820 |
| 600 | 0.0918 | 0.0839 | 0.0832 | 0.0706 | 0.0803 | 0.0769 | 0.0754 |
| 605 | 0.0786 | 0.0732 | 0.0749 | 0.0625 | 0.0733 | 0.0693 | 0.0697 |
| 610 | 0.0694 | 0.0654 | 0.0686 | 0.0576 | 0.0687 | 0.0645 | 0.0654 |
| 615 | 0.0624 | 0.0597 | 0.0637 | 0.0539 | 0.0652 | 0.0612 | 0.0623 |
| 620 | 0.0572 | 0.0554 | 0.0601 | 0.0516 | 0.0626 | 0.0589 | 0.0604 |
| 625 | 0.0540 | 0.0523 | 0.0577 | 0.0503 | 0.0612 | 0.0574 | 0.0592 |
| 630 | 0.0512 | 0.0498 | 0.0554 | 0.0491 | 0.0601 | 0.0561 | 0.0580 |
| 635 | 0.0494 | 0.0483 | 0.0539 | 0.0484 | 0.0590 | 0.0555 | 0.0574 |
| 640 | 0.0475 | 0.0467 | 0.0526 | 0.0475 | 0.0581 | 0.0547 | 0.0568 |
| 645 | 0.0456 | 0.0449 | 0.0511 | 0.0467 | 0.0576 | 0.0542 | 0.0560 |
| 650 | 0.0445 | 0.0441 | 0.0505 | 0.0465 | 0.0576 | 0.0543 | 0.0562 |
| 655 | 0.0436 | 0.0434 | 0.0498 | 0.0469 | 0.0583 | 0.0546 | 0.0568 |
| 660 | 0.0429 | 0.0426 | 0.0489 | 0.0476 | 0.0588 | 0.0556 | 0.0577 |
| 665 | 0.0423 | 0.0422 | 0.0487 | 0.0488 | 0.0602 | 0.0571 | 0.0589 |
| 670 | 0.0425 | 0.0425 | 0.0490 | 0.0513 | 0.0621 | 0.0592 | 0.0604 |
| 675 | 0.0433 | 0.0431 | 0.0491 | 0.0540 | 0.0634 | 0.0608 | 0.0614 |
| 680 | 0.0441 | 0.0442 | 0.0495 | 0.0565 | 0.0647 | 0.0627 | 0.0627 |
| 685 | 0.0454 | 0.0452 | 0.0503 | 0.0590 | 0.0655 | 0.0647 | 0.0640 |
| 690 | 0.0469 | 0.0463 | 0.0514 | 0.0617 | 0.0662 | 0.0660 | 0.0644 |
| 695 | 0.0486 | 0.0477 | 0.0524 | 0.0642 | 0.0667 | 0.0666 | 0.0644 |
| 700 | 0.0513 | 0.0499 | 0.0536 | 0.0677 | 0.0662 | 0.0671 | 0.0637 |
| 705 | 0.0524 | 0.0510 | 0.0542 | 0.0686 | 0.0649 | 0.0666 | 0.0626 |
| 710 | 0.0528 | 0.0515 | 0.0540 | 0.0689 | 0.0645 | 0.0659 | 0.0622 |
| 715 | 0.0528 | 0.0513 | 0.0539 | 0.0672 | 0.0640 | 0.0655 | 0.0621 |
| 720 | 0.0520 | 0.0502 | 0.0537 | 0.0659 | 0.0637 | 0.0656 | 0.0627 |
| 725 | 0.0509 | 0.0498 | 0.0542 | 0.0656 | 0.0653 | 0.0660 | 0.0643 |
| 730 | 0.0504 | 0.0505 | 0.0554 | 0.0675 | 0.0690 | 0.0697 | 0.0678 |
| 735 | 0.0509 | 0.0522 | 0.0579 | 0.0706 | 0.0746 | 0.0750 | 0.0729 |
| 740 | 0.0530 | 0.0548 | 0.0613 | 0.0760 | 0.0840 | 0.0835 | 0.0836 |
| 745 | 0.0556 | 0.0589 | 0.0668 | 0.0830 | 0.0972 | 0.0944 | 0.0996 |
| 750 | 0.0576 | 0.0627 | 0.0718 | 0.0879 | 0.1090 | 0.1043 | 0.1142 |
| 755 | 0.0600 | 0.0671 | 0.0779 | 0.0942 | 0.1241 | 0.1173 | 0.1337 |
| 760 | 0.0626 | 0.0717 | 0.0832 | 0.0990 | 0.1361 | 0.1267 | 0.1503 |
| 765 | 0.0662 | 0.0758 | 0.0877 | 0.1021 | 0.1457 | 0.1339 | 0.1629 |
| 770 | 0.0707 | 0.0795 | 0.0923 | 0.1038 | 0.1519 | 0.1383 | 0.1691 |
| 775 | 0.0761 | 0.0862 | 0.1004 | 0.1052 | 0.1565 | 0.1412 | 0.1742 |
| 780 | 0.0840 | 0.0953 | 0.1105 | 0.1087 | 0.1609 | 0.1462 | 0.1809 |

| nm | 29 | 30 | 31 | 32 | 33 | 34 | 35 |
|---|---|---|---|---|---|---|---|
| 380 | 0.0801 | 0.0765 | 0.0827 | 0.0780 | 0.0666 | 0.0633 | 0.0759 |
| 385 | 0.1014 | 0.0970 | 0.1066 | 0.1035 | 0.0890 | 0.0848 | 0.1013 |
| 390 | 0.1297 | 0.1275 | 0.1417 | 0.1414 | 0.1226 | 0.1170 | 0.1378 |
| 395 | 0.1582 | 0.1589 | 0.1810 | 0.1860 | 0.1618 | 0.1530 | 0.1772 |
| 400 | 0.1849 | 0.1886 | 0.2209 | 0.2354 | 0.2050 | 0.1917 | 0.2181 |
| 405 | 0.2077 | 0.2140 | 0.2574 | 0.2851 | 0.2481 | 0.2300 | 0.2548 |
| 410 | 0.2232 | 0.2303 | 0.2801 | 0.3185 | 0.2800 | 0.2589 | 0.2798 |
| 415 | 0.2346 | 0.2419 | 0.2949 | 0.3387 | 0.3029 | 0.2820 | 0.2973 |
| 420 | 0.2432 | 0.2515 | 0.3063 | 0.3550 | 0.3205 | 0.2991 | 0.3096 |
| 425 | 0.2538 | 0.2628 | 0.3188 | 0.3732 | 0.3400 | 0.3154 | 0.3205 |
| 430 | 0.2674 | 0.2756 | 0.3346 | 0.3942 | 0.3644 | 0.3355 | 0.3312 |
| 435 | 0.2803 | 0.2882 | 0.3506 | 0.4181 | 0.3912 | 0.3553 | 0.3387 |
| 440 | 0.2988 | 0.3063 | 0.3737 | 0.4533 | 0.4313 | 0.3842 | 0.3471 |
| 445 | 0.3190 | 0.3250 | 0.3961 | 0.4835 | 0.4689 | 0.4119 | 0.3520 |
| 450 | 0.3407 | 0.3464 | 0.4164 | 0.5084 | 0.4971 | 0.4321 | 0.3491 |
| 455 | 0.3622 | 0.3672 | 0.4319 | 0.5263 | 0.5116 | 0.4384 | 0.3407 |
| 460 | 0.3888 | 0.3945 | 0.4491 | 0.5440 | 0.5187 | 0.4347 | 0.3271 |
| 465 | 0.4148 | 0.4217 | 0.4639 | 0.5584 | 0.5190 | 0.4245 | 0.3110 |
| 470 | 0.4404 | 0.4462 | 0.4761 | 0.5678 | 0.5139 | 0.4090 | 0.2931 |
| 475 | 0.4630 | 0.4671 | 0.4850 | 0.5702 | 0.5009 | 0.3860 | 0.2708 |

TABLE 10-continued

| Spectral reflectance of 40 color chips Wavelength No | | | | | | | |
|---|---|---|---|---|---|---|---|
| 480 | 0.4778 | 0.4793 | 0.4879 | 0.5649 | 0.4824 | 0.3581 | 0.2466 |
| 485 | 0.4874 | 0.4850 | 0.4875 | 0.5539 | 0.4578 | 0.3245 | 0.2200 |
| 490 | 0.4904 | 0.4833 | 0.4830 | 0.5344 | 0.4252 | 0.2867 | 0.1909 |
| 495 | 0.4896 | 0.4769 | 0.4772 | 0.5138 | 0.3952 | 0.2552 | 0.1678 |
| 500 | 0.4837 | 0.4636 | 0.4674 | 0.4887 | 0.3629 | 0.2247 | 0.1468 |
| 505 | 0.4730 | 0.4462 | 0.4537 | 0.4624 | 0.3330 | 0.2012 | 0.1316 |
| 510 | 0.4563 | 0.4231 | 0.4339 | 0.4298 | 0.2993 | 0.1773 | 0.1164 |
| 515 | 0.4357 | 0.3983 | 0.4113 | 0.3969 | 0.2681 | 0.1563 | 0.1034 |
| 520 | 0.4112 | 0.3712 | 0.3848 | 0.3627 | 0.2371 | 0.1368 | 0.0922 |
| 525 | 0.3802 | 0.3389 | 0.3530 | 0.3251 | 0.2057 | 0.1185 | 0.0822 |
| 530 | 0.3509 | 0.3095 | 0.3244 | 0.2926 | 0.1817 | 0.1061 | 0.0761 |
| 535 | 0.3245 | 0.2836 | 0.2979 | 0.2645 | 0.1622 | 0.0973 | 0.0725 |
| 540 | 0.2980 | 0.2582 | 0.2714 | 0.2382 | 0.1448 | 0.0896 | 0.0701 |
| 545 | 0.2649 | 0.2277 | 0.2409 | 0.2075 | 0.1255 | 0.0807 | 0.0675 |
| 550 | 0.2308 | 0.1970 | 0.2093 | 0.1771 | 0.1068 | 0.0718 | 0.0649 |
| 555 | 0.2018 | 0.1717 | 0.1829 | 0.1527 | 0.0917 | 0.0642 | 0.0617 |
| 560 | 0.1786 | 0.1514 | 0.1614 | 0.1335 | 0.0802 | 0.0577 | 0.0584 |
| 565 | 0.1596 | 0.1349 | 0.1443 | 0.1178 | 0.0715 | 0.0527 | 0.0562 |
| 570 | 0.1440 | 0.1218 | 0.1310 | 0.1060 | 0.0653 | 0.0493 | 0.0553 |
| 575 | 0.1294 | 0.1094 | 0.1186 | 0.0956 | 0.0603 | 0.0469 | 0.0551 |
| 580 | 0.1187 | 0.1003 | 0.1101 | 0.0887 | 0.0571 | 0.0457 | 0.0560 |
| 585 | 0.1098 | 0.0930 | 0.1036 | 0.0837 | 0.0549 | 0.0449 | 0.0579 |
| 590 | 0.1008 | 0.0853 | 0.0967 | 0.0784 | 0.0531 | 0.0443 | 0.0601 |
| 595 | 0.0931 | 0.0792 | 0.0915 | 0.0741 | 0.0516 | 0.0438 | 0.0619 |
| 600 | 0.0861 | 0.0739 | 0.0870 | 0.0706 | 0.0499 | 0.0429 | 0.0627 |
| 605 | 0.0802 | 0.0688 | 0.0821 | 0.0671 | 0.0482 | 0.0421 | 0.0623 |
| 610 | 0.0763 | 0.0656 | 0.0787 | 0.0644 | 0.0469 | 0.0413 | 0.0610 |
| 615 | 0.0729 | 0.0629 | 0.0758 | 0.0622 | 0.0463 | 0.0407 | 0.0592 |
| 620 | 0.0707 | 0.0610 | 0.0736 | 0.0607 | 0.0462 | 0.0410 | 0.0579 |
| 625 | 0.0694 | 0.0596 | 0.0722 | 0.0597 | 0.0466 | 0.0416 | 0.0575 |
| 630 | 0.0678 | 0.0583 | 0.0705 | 0.0589 | 0.0474 | 0.0429 | 0.0587 |
| 635 | 0.0669 | 0.0577 | 0.0696 | 0.0584 | 0.0483 | 0.0451 | 0.0617 |
| 640 | 0.0664 | 0.0571 | 0.0695 | 0.0580 | 0.0496 | 0.0477 | 0.0660 |
| 645 | 0.0659 | 0.0566 | 0.0691 | 0.0579 | 0.0509 | 0.0509 | 0.0723 |
| 650 | 0.0657 | 0.0568 | 0.0692 | 0.0582 | 0.0520 | 0.0532 | 0.0776 |
| 655 | 0.0665 | 0.0572 | 0.0708 | 0.0594 | 0.0537 | 0.0558 | 0.0850 |
| 660 | 0.0675 | 0.0579 | 0.0717 | 0.0605 | 0.0549 | 0.0577 | 0.0920 |
| 665 | 0.0684 | 0.0587 | 0.0725 | 0.0617 | 0.0557 | 0.0588 | 0.0977 |
| 670 | 0.0701 | 0.0596 | 0.0734 | 0.0622 | 0.0554 | 0.0592 | 0.1021 |
| 675 | 0.0712 | 0.0600 | 0.0732 | 0.0617 | 0.0545 | 0.0580 | 0.1039 |
| 680 | 0.0719 | 0.0603 | 0.0721 | 0.0609 | 0.0532 | 0.0557 | 0.1036 |
| 685 | 0.0723 | 0.0606 | 0.0711 | 0.0595 | 0.0515 | 0.0539 | 0.1020 |
| 690 | 0.0717 | 0.0597 | 0.0697 | 0.0579 | 0.0502 | 0.0526 | 0.1007 |
| 695 | 0.0705 | 0.0586 | 0.0678 | 0.0561 | 0.0493 | 0.0517 | 0.1003 |
| 700 | 0.0693 | 0.0571 | 0.0647 | 0.0528 | 0.0483 | 0.0524 | 0.1010 |
| 705 | 0.0682 | 0.0560 | 0.0634 | 0.0516 | 0.0483 | 0.0535 | 0.1029 |
| 710 | 0.0673 | 0.0554 | 0.0623 | 0.0513 | 0.0488 | 0.0559 | 0.1066 |
| 715 | 0.0675 | 0.0555 | 0.0617 | 0.0519 | 0.0502 | 0.0584 | 0.1100 |
| 720 | 0.0682 | 0.0566 | 0.0632 | 0.0532 | 0.0520 | 0.0616 | 0.1142 |
| 725 | 0.0701 | 0.0581 | 0.0652 | 0.0558 | 0.0556 | 0.0647 | 0.1200 |
| 730 | 0.0755 | 0.0624 | 0.0708 | 0.0613 | 0.0619 | 0.0718 | 0.1287 |
| 735 | 0.0813 | 0.0676 | 0.0778 | 0.0683 | 0.0687 | 0.0796 | 0.1385 |
| 740 | 0.0916 | 0.0783 | 0.0904 | 0.0809 | 0.0815 | 0.0918 | 0.1544 |
| 745 | 0.1077 | 0.0937 | 0.1112 | 0.1032 | 0.1018 | 0.1086 | 0.1737 |
| 750 | 0.1229 | 0.1083 | 0.1337 | 0.1276 | 0.1231 | 0.1258 | 0.1917 |
| 755 | 0.1428 | 0.1296 | 0.1688 | 0.1677 | 0.1595 | 0.1541 | 0.2182 |
| 760 | 0.1604 | 0.1470 | 0.2010 | 0.2098 | 0.1991 | 0.1847 | 0.2448 |
| 765 | 0.1738 | 0.1623 | 0.2325 | 0.2525 | 0.2450 | 0.2215 | 0.2736 |
| 770 | 0.1819 | 0.1748 | 0.2566 | 0.2887 | 0.2899 | 0.2588 | 0.3008 |
| 775 | 0.1920 | 0.1828 | 0.2767 | 0.3246 | 0.3406 | 0.3013 | 0.3324 |
| 780 | 0.2016 | 0.1888 | 0.2948 | 0.3532 | 0.3883 | 0.3432 | 0.3619 |

| nm | 36 | 37 | 38 | 39 | 40 |
|---|---|---|---|---|---|
| 380 | 0.0655 | 0.0883 | 0.1017 | 0.0951 | 0.0846 |
| 385 | 0.0864 | 0.1136 | 0.1299 | 0.1235 | 0.1041 |
| 390 | 0.1159 | 0.1513 | 0.1730 | 0.1662 | 0.1292 |
| 395 | 0.1467 | 0.1931 | 0.2239 | 0.2115 | 0.1533 |
| 400 | 0.1761 | 0.2356 | 0.2761 | 0.2550 | 0.1731 |
| 405 | 0.2014 | 0.2691 | 0.3179 | 0.2881 | 0.1842 |
| 410 | 0.2169 | 0.2863 | 0.3385 | 0.3026 | 0.1871 |
| 415 | 0.2283 | 0.2962 | 0.3476 | 0.3055 | 0.1866 |
| 420 | 0.2368 | 0.3010 | 0.3505 | 0.3006 | 0.1845 |
| 425 | 0.2430 | 0.3023 | 0.3482 | 0.2910 | 0.1819 |
| 430 | 0.2471 | 0.2982 | 0.3408 | 0.2777 | 0.1785 |
| 435 | 0.2465 | 0.2902 | 0.3305 | 0.2633 | 0.1734 |
| 440 | 0.2423 | 0.2788 | 0.3160 | 0.2466 | 0.1676 |

TABLE 10-continued

| Spectral reflectance of 40 color chips Wavelength No | | | | | |
|---|---|---|---|---|---|
| 445 | 0.2348 | 0.2670 | 0.3016 | 0.2303 | 0.1620 |
| 450 | 0.2229 | 0.2517 | 0.2848 | 0.2131 | 0.1551 |
| 455 | 0.2104 | 0.2366 | 0.2693 | 0.1997 | 0.1486 |
| 460 | 0.1953 | 0.2205 | 0.2522 | 0.1859 | 0.1415 |
| 465 | 0.1806 | 0.2069 | 0.2373 | 0.1730 | 0.1352 |
| 470 | 0.1650 | 0.1935 | 0.2231 | 0.1592 | 0.1286 |
| 475 | 0.1473 | 0.1773 | 0.2068 | 0.1442 | 0.1213 |
| 480 | 0.1313 | 0.1615 | 0.1910 | 0.1324 | 0.1144 |
| 485 | 0.1152 | 0.1461 | 0.1753 | 0.1233 | 0.1084 |
| 490 | 0.0993 | 0.1302 | 0.1594 | 0.1164 | 0.1029 |
| 495 | 0.0871 | 0.1182 | 0.1479 | 0.1116 | 0.0987 |
| 500 | 0.0760 | 0.1082 | 0.1378 | 0.1053 | 0.0940 |
| 505 | 0.0678 | 0.1001 | 0.1292 | 0.0974 | 0.0892 |
| 510 | 0.0601 | 0.0910 | 0.1195 | 0.0875 | 0.0837 |
| 515 | 0.0537 | 0.0821 | 0.1092 | 0.0792 | 0.0781 |
| 520 | 0.0484 | 0.0731 | 0.0977 | 0.0733 | 0.0728 |
| 525 | 0.0442 | 0.0648 | 0.0863 | 0.0702 | 0.0683 |
| 530 | 0.0419 | 0.0601 | 0.0794 | 0.0706 | 0.0657 |
| 535 | 0.0408 | 0.0576 | 0.0759 | 0.0714 | 0.0643 |
| 540 | 0.0401 | 0.0568 | 0.0748 | 0.0711 | 0.0635 |
| 545 | 0.0395 | 0.0573 | 0.0757 | 0.0683 | 0.0631 |
| 550 | 0.0388 | 0.0586 | 0.0775 | 0.0631 | 0.0629 |
| 555 | 0.0381 | 0.0589 | 0.0782 | 0.0596 | 0.0626 |
| 560 | 0.0379 | 0.0585 | 0.0778 | 0.0601 | 0.0630 |
| 565 | 0.0385 | 0.0589 | 0.0785 | 0.0655 | 0.0658 |
| 570 | 0.0401 | 0.0620 | 0.0829 | 0.0776 | 0.0728 |
| 575 | 0.0426 | 0.0691 | 0.0938 | 0.1002 | 0.0878 |
| 580 | 0.0460 | 0.0801 | 0.1115 | 0.1315 | 0.1114 |
| 585 | 0.0509 | 0.0962 | 0.1381 | 0.1724 | 0.1458 |
| 590 | 0.0570 | 0.1184 | 0.1760 | 0.2253 | 0.1953 |
| 595 | 0.0625 | 0.1410 | 0.2164 | 0.2775 | 0.2481 |
| 600 | 0.0667 | 0.1626 | 0.2596 | 0.3279 | 0.3037 |
| 605 | 0.0683 | 0.1802 | 0.3036 | 0.3741 | 0.3618 |
| 610 | 0.0667 | 0.1881 | 0.3353 | 0.4037 | 0.4096 |
| 615 | 0.0631 | 0.1882 | 0.3573 | 0.4199 | 0.4523 |
| 620 | 0.0592 | 0.1841 | 0.3746 | 0.4289 | 0.4941 |
| 625 | 0.0575 | 0.1819 | 0.3869 | 0.4352 | 0.5256 |
| 630 | 0.0590 | 0.1861 | 0.4022 | 0.4460 | 0.5528 |
| 635 | 0.0634 | 0.1983 | 0.4222 | 0.4626 | 0.5733 |
| 640 | 0.0712 | 0.2186 | 0.4483 | 0.4863 | 0.5900 |
| 645 | 0.0845 | 0.2501 | 0.4842 | 0.5195 | 0.6042 |
| 650 | 0.0975 | 0.2783 | 0.5127 | 0.5463 | 0.6142 |
| 655 | 0.1197 | 0.3226 | 0.5532 | 0.5828 | 0.6279 |
| 660 | 0.1499 | 0.3744 | 0.5956 | 0.6204 | 0.6381 |
| 665 | 0.1869 | 0.4285 | 0.6359 | 0.6554 | 0.6472 |
| 670 | 0.2359 | 0.4890 | 0.6764 | 0.6900 | 0.6584 |
| 675 | 0.2859 | 0.5402 | 0.7072 | 0.7150 | 0.6680 |
| 680 | 0.3406 | 0.5876 | 0.7346 | 0.7364 | 0.6760 |
| 685 | 0.3982 | 0.6307 | 0.7574 | 0.7541 | 0.6835 |
| 690 | 0.4622 | 0.6700 | 0.7781 | 0.7689 | 0.6934 |
| 695 | 0.5183 | 0.7012 | 0.7968 | 0.7823 | 0.7040 |
| 700 | 0.6022 | 0.7456 | 0.8196 | 0.8014 | 0.7219 |
| 705 | 0.6443 | 0.7645 | 0.8310 | 0.8108 | 0.7305 |
| 710 | 0.6780 | 0.7785 | 0.8390 | 0.8191 | 0.7382 |
| 715 | 0.7093 | 0.7909 | 0.8485 | 0.8277 | 0.7484 |
| 720 | 0.7336 | 0.8015 | 0.8553 | 0.8322 | 0.7557 |
| 725 | 0.7512 | 0.8078 | 0.8585 | 0.8351 | 0.7609 |
| 730 | 0.7721 | 0.8149 | 0.8628 | 0.8403 | 0.7672 |
| 735 | 0.7844 | 0.8219 | 0.8677 | 0.8454 | 0.7714 |
| 740 | 0.7970 | 0.8311 | 0.8730 | 0.8523 | 0.7773 |
| 745 | 0.8019 | 0.8319 | 0.8173 | 0.8497 | 0.7778 |
| 750 | 0.8073 | 0.8348 | 0.8735 | 0.8500 | 0.7798 |
| 755 | 0.8111 | 0.8378 | 0.8756 | 0.8557 | 0.7795 |
| 760 | 0.8102 | 0.8368 | 0.8758 | 0.8570 | 0.7784 |
| 765 | 0.8081 | 0.8349 | 0.8743 | 0.8539 | 0.7730 |
| 770 | 0.8080 | 0.8353 | 0.8745 | 0.8529 | 0.7668 |
| 775 | 0.8080 | 0.8337 | 0.8761 | 0.8550 | 0.7627 |
| 780 | 0.8118 | 0.8390 | 0.8818 | 0.8629 | 0.7634 |

The data are summarized in Table 11. The data show that sample 101 of the present invention exhibited smaller difference in chroma throughout a region from high brightness to low brightness in comparison to comparative example samples 102, 103 and 104. In addition, sample 101 showed a smaller hue change. The results of the actual photographing of people show that sample 101 provides a high chroma of skin color and, therefore, is superior in tone reproduction. In addition, the "red-tinged deviation in the skin color," which tends to occur if the chroma of skin color is high, is suppressed well. In this regard, this sample has a superior skin color reproduction.

TABLE 11

Evaluation of photographic characteristic of "chroma of the skin color" sample

| | Sample | | | | | | | | |
|---|---|---|---|---|---|---|---|---|---|
| | 101 Inv. | 102 Comp. | 103 Comp. | 104 Comp. | 105 Inv. | 106 Comp. | 107 Comp. | 108 Comp. | 109 Inv. |
| Presence or absence of short-wavelength green-sensitive interimage effect imparting layer | Presence | Presence | Absence | Absence | Presence | Presence | Absence | Absence | Presence |
| Presence or absence red-sensitive interimage effect imparting layer | Presence | Absence | Presence | Absence | Presence | Absence | Presence | Absence | Presence |
| Presence or absence short-wavelength blue-sensitive interimage effect imparting layer | Absence | Absence | Absence | Absence | Absence | Absence | Absence | Absence | Presence |
| Weight-averaged wavelength of spectral sensitivity of red-sensitive silver halide emulsion layer | 619 nm | 619 nm | 619 nm | 619 nm | 635 nm | 635 nm | 635 nm | 635 nm | 619 nm |
| $(C^*_{70}/C^*_{50})$ | 0.85 | 0.68 | 0.66 | 0.64 | 0.82 | 0.69 | 0.66 | 0.65 | 0.78 |
| $(C^*_{20}/C^*_{50})$ | 0.90 | 0.88 | 0.67 | 0.65 | 0.89 | 0.88 | 0.68 | 0.62 | 0.90 |
| Standard deviation of skin color hue angle σh L* = 20–70 | 1.5 | 2.6 | 3.0 | 3.4 | 2.2 | 2.6 | 2.8 | 3.1 | 1.2 |
| Maximum of C* value of "gray" image in range of L* = 20 to 70 | 8.7 | 9.6 | 10.0 | 10.5 | 8.8 | 9.3 | 10.2 | 10.5 | 8.6 |
| Evaluation value of "skin color reproduction" | 2.0 | 1.5 | 0.5 | 0.3 | 1.9 | 1.4 | 1.0 | 0.5 | 2.0 |
| Evaluation value of "chroma of the skin color" | 2.0 | 1.2 | 0.5 | 0.0 | 1.9 | 1.4 | 1.0 | 0.5 | 2.0 |
| Evaluation value of "red shift in the skin color" | 1.9 | 1.9 | 2.0 | 2.0 | 1.7 | 1.7 | 1.7 | 1.8 | 1.9 |
| Evaluation value of "degree of blue fog under shade" | 2.0 | 2.0 | 2.0 | 2.0 | 1.5 | 1.0 | 1.2 | 1.0 | 2.0 |
| Evaluation value of "degree of green fog under white fluorescent lamp" | 2.0 | 2.0 | 2.0 | 2.0 | 0.5 | 0.5 | 0.5 | 0.5 | 2.0 |
| Evaluation value of "degree of green fog under three band fluorescent lamp" | 2.0 | 2.0 | 2.0 | 2.0 | 0.5 | 0.5 | 0.5 | 0.5 | 0.5 |
| ΔH (Average value of difference to original 40 color chips. | 8.2 | 8.5 | 9.7 | 9.9 | 10.0 | 10.0 | 11.5 | 12.0 | 8.0 |

Moreover, this sample is also characterized by being small in "blue fogging in photographing in shade" and in "green fogging in photographing under fluorescent lamp." In comparison to comparative examples, this sample provides smaller ΔH values obtained by actually evaluating the faithfulness in color reproducibilities with respect to various colors in a color coordinate. This sample, therefore, has a faithful color reproduction. The gray reproduction is also excellent because a nice gray tone is maintained throughout a region from high brightness to low brightness.

It is seen that sample 105 wherein the weight-averaged wavelength of a red-sensitive silver halide emulsion layer is long is inferior to sample 101 in faithfulness in color reproduction, but is excellent in skin color reproduction like sample 101.

It is apparent that sample 109 of the present invention, which has a short-wavelength blue-sensitive interimage effect imparting layer in addition to a short-wavelength green-sensitive interimage effect imparting layer and a red-sensitive interimage effect imparting layer, also has both excellent skin color reproduction and faithful color reproduction like sample 101 of the present invention.

As described above, the color reversal photographic light-sensitive material of the present invention has both excellent skin color reproduction and faithful color reproduction and can minimize the hue change with respect to variations in brightness of objects and exposure. The present invention can provide a color reversal photographic light-sensitive material improved in adaptability for various light sources and in color temperature dependency of light source.

What is claimed is:

1. A silver halide color reversal photographic light-sensitive material having on a transparent support at least one blue-sensitive silver halide emulsion layer containing a yellow-coloring coupler, at least one green-sensitive silver halide emulsion layer containing a magenta-coloring coupler and at least one red-sensitive silver halide emulsion layer containing a cyan-coloring coupler, wherein said photographic light-sensitive material comprising at least one interimage effect imparting layer (a) defined below and at least one interimage effect imparting layer (b) defined below in addition to the blue-, green- and red-sensitive silver halide emulsion layers, wherein, when the photographic light-sensitive material is exposed to light of a "skin color" having the spectral distribution of Table 1 and is then subjected to development, a ratio of the chroma $C^*_{70}$ at a brightness L*=70 represented by CIE Lab color system to the chroma $C^*_{50}$ at a brightness L*=50, $C^*_{70}/C^*_{50}$, is 0.7 or more (a) an interimage effect imparting layer containing a short-wavelength green-sensitive silver halide emulsion having a weight-averaged wavelength of a spectral sensitivity distribution in the range of 500 nm to 560 nm;

(b) an interimage effect imparting layer containing a red-sensitive silver halide emulsion having a weight-averaged wavelength of a spectral sensitivity distribution in the range of 580 nm to 700 nm.

TABLE 1

| Spectral reflectance distribution of skin color | |
|---|---|
| Wave-length (nm) | Spectral reflectance of skin color |
| 400 | 0.1687 |
| 405 | 0.1621 |
| 410 | 0.1611 |
| 415 | 0.1577 |
| 420 | 0.1560 |
| 425 | 0.1570 |
| 430 | 0.1605 |
| 435 | 0.1675 |
| 440 | 0.1809 |
| 445 | 0.1937 |
| 450 | 0.2044 |
| 455 | 0.2105 |
| 460 | 0.2184 |
| 465 | 0.2223 |
| 470 | 0.2279 |
| 475 | 0.2337 |
| 480 | 0.2397 |
| 485 | 0.2439 |
| 490 | 0.2490 |
| 495 | 0.2546 |
| 500 | 0.2625 |
| 505 | 0.2685 |
| 510 | 0.2802 |
| 515 | 0.2853 |
| 520 | 0.2893 |
| 525 | 0.2931 |
| 530 | 0.2932 |
| 535 | 0.2967 |
| 540 | 0.2993 |
| 545 | 0.2994 |
| 550 | 0.2999 |
| 555 | 0.3022 |
| 560 | 0.3041 |
| 565 | 0.3056 |
| 570 | 0.3103 |

TABLE 1-continued

| Spectral reflectance distribution of skin color | |
|---|---|
| Wave-length (nm) | Spectral reflectance of skin color |
| 575 | 0.3095 |
| 580 | 0.3136 |
| 585 | 0.3272 |
| 590 | 0.3450 |
| 595 | 0.3630 |
| 600 | 0.3841 |
| 605 | 0.3970 |
| 610 | 0.4106 |
| 615 | 0.4187 |
| 620 | 0.4273 |
| 625 | 0.4398 |
| 630 | 0.4458 |
| 635 | 0.4548 |
| 640 | 0.4615 |
| 645 | 0.4755 |
| 650 | 0.4796 |
| 655 | 0.4858 |
| 660 | 0.4913 |
| 665 | 0.4988 |
| 670 | 0.5041 |
| 675 | 0.5034 |
| 680 | 0.4991 |
| 685 | 0.5043 |
| 690 | 0.5072 |
| 695 | 0.5163 |
| 700 | 0.5189. |

2. The silver halide color reversal photographic light-sensitive material according to claim 1, wherein a ratio of the chroma $C^*_{20}$ at a brightness L*=20 to the chroma $C^*_{50}$ at a brightness L*=50, $C^*_{20}/C^*_{50}$, is 0.7 or more.

3. The silver halide color reversal photographic light-sensitive material according to claim 1, wherein the standard deviation of the hue angle in the CIE Lab color system of a "skin color" image that is reproduced by the photographic light-sensitive material is within 1.0 in the range of brightness L*=20 to 70.

4. The silver halide color reversal photographic light-sensitive material according to claim 2, wherein the standard deviation of the hue angle in the CIE Lab color system of a "skin color" image that is reproduced by the photographic light-sensitive material is within 1.0 in the range of brightness L*=20 to 70.

5. The silver halide color reversal photographic light-sensitive material according to claim 1, wherein when the photographic light-sensitive material is exposed to light having a "gray" spectral reflectance distribution shown in Table 2 and is then subjected to development, the chroma C* value represented in the CIE Lab color system of a "gray" image that is reproduced by the photographic light-sensitive material, is 0 or more, but 10 or less, in the range of L*=20 to 70.

TABLE 2

| Spectral reflectance distribution of gray | |
|---|---|
| Wave-length (nm) | Spectral reflectance of gray |
| 400 | 0.1719 |
| 405 | 0.1824 |
| 410 | 0.1868 |

TABLE 2-continued

| Spectral reflectance distribution of gray | |
|---|---|
| Wave-length (nm) | Spectral reflectance of gray |
| 415 | 0.1887 |
| 420 | 0.1896 |
| 425 | 0.1906 |
| 430 | 0.1914 |
| 435 | 0.1927 |
| 440 | 0.1937 |
| 445 | 0.1948 |
| 450 | 0.1949 |
| 455 | 0.1948 |
| 460 | 0.1948 |
| 465 | 0.1943 |
| 470 | 0.1944 |
| 475 | 0.1943 |
| 480 | 0.1940 |
| 485 | 0.1938 |
| 490 | 0.1940 |
| 495 | 0.1941 |
| 500 | 0.1946 |
| 505 | 0.1947 |
| 510 | 0.1949 |
| 515 | 0.1950 |
| 520 | 0.1954 |
| 525 | 0.1958 |
| 530 | 0.1959 |
| 535 | 0.1961 |
| 540 | 0.1964 |
| 545 | 0.1965 |
| 550 | 0.1964 |
| 555 | 0.1966 |
| 560 | 0.1967 |
| 565 | 0.1970 |
| 570 | 0.1973 |
| 575 | 0.1977 |
| 580 | 0.1982 |
| 585 | 0.1984 |
| 590 | 0.1983 |
| 595 | 0.1983 |
| 600 | 0.1979 |
| 605 | 0.1974 |
| 610 | 0.1970 |
| 615 | 0.1965 |
| 620 | 0.1961 |
| 625 | 0.1953 |
| 630 | 0.1949 |
| 635 | 0.1943 |
| 640 | 0.1937 |
| 645 | 0.1929 |
| 650 | 0.1924 |
| 655 | 0.1919 |
| 660 | 0.1914 |
| 665 | 0.1908 |
| 670 | 0.1904 |
| 675 | 0.1898 |
| 680 | 0.1893 |
| 685 | 0.1886 |
| 690 | 0.1882 |
| 695 | 0.1878 |
| 700 | 0.1874. |

6. The silver halide color reversal photographic light-sensitive material according to claim 2, wherein when the photographic light-sensitive material is exposed to light having a "gray" spectral reflectance distribution shown in Table 2 and is then subjected to development, the chroma C* value represented in the CIE Lab color system of a "gray" image that is reproduced by the photographic light-sensitive material, is 0 or more, but 10 or less, in the range of L*=20 to 70.

TABLE 2

| Spectral reflectance distribution of gray | |
|---|---|
| Wave-length (nm) | Spectral reflectance of gray |
| 400 | 0.1719 |
| 405 | 0.1824 |
| 410 | 0.1868 |
| 415 | 0.1887 |
| 420 | 0.1896 |
| 425 | 0.1906 |
| 430 | 0.1914 |
| 435 | 0.1927 |
| 440 | 0.1937 |
| 445 | 0.1948 |
| 450 | 0.1949 |
| 455 | 0.1948 |
| 460 | 0.1948 |
| 465 | 0.1943 |
| 470 | 0.1944 |
| 475 | 0.1943 |
| 480 | 0.1940 |
| 485 | 0.1938 |
| 490 | 0.1940 |
| 495 | 0.1941 |
| 500 | 0.1946 |
| 505 | 0.1947 |
| 510 | 0.1949 |
| 515 | 0.1950 |
| 520 | 0.1954 |
| 525 | 0.1958 |
| 530 | 0.1959 |
| 535 | 0.1961 |
| 540 | 0.1964 |
| 545 | 0.1965 |
| 550 | 0.1964 |
| 555 | 0.1966 |
| 560 | 0.1967 |
| 565 | 0.1970 |
| 570 | 0.1973 |
| 575 | 0.1977 |
| 580 | 0.1982 |
| 585 | 0.1984 |
| 590 | 0.1983 |
| 595 | 0.1983 |
| 600 | 0.1979 |
| 605 | 0.1974 |
| 610 | 0.1970 |
| 615 | 0.1965 |
| 620 | 0.1961 |
| 625 | 0.1953 |
| 630 | 0.1949 |
| 635 | 0.1943 |
| 640 | 0.1937 |
| 645 | 0.1929 |
| 650 | 0.1924 |
| 655 | 0.1919 |
| 660 | 0.1914 |
| 665 | 0.1908 |
| 670 | 0.1904 |
| 675 | 0.1898 |
| 680 | 0.1893 |
| 685 | 0.1886 |
| 690 | 0.1882 |
| 695 | 0.1878 |
| 700 | 0.1874. |

7. The silver halide color reversal photographic light-sensitive material according to claim 3, wherein when the photographic light-sensitive material is exposed to light having a "gray" spectral reflectance distribution shown in Table 2 and is then subjected to development, the chroma C* value represented in the CIE Lab color system of a "gray" image that is reproduced by the photographic light-sensitive material, is 0 or more, but 10 or less, in the range of L*=20 to 70.

TABLE 2

| Spectral reflectance distribution of gray | |
|---|---|
| Wave-length (nm) | Spectral reflectance of gray |
| 400 | 0.1719 |
| 405 | 0.1824 |
| 410 | 0.1868 |
| 415 | 0.1887 |
| 420 | 0.1896 |
| 425 | 0.1906 |
| 430 | 0.1914 |
| 435 | 0.1927 |
| 440 | 0.1937 |
| 445 | 0.1948 |
| 450 | 0.1949 |
| 455 | 0.1948 |
| 460 | 0.1948 |
| 465 | 0.1943 |
| 470 | 0.1944 |
| 475 | 0.1943 |
| 480 | 0.1940 |
| 485 | 0.1938 |
| 490 | 0.1940 |
| 495 | 0.1941 |
| 500 | 0.1946 |
| 505 | 0.1947 |
| 510 | 0.1949 |
| 515 | 0.1950 |
| 520 | 0.1954 |
| 525 | 0.1958 |
| 530 | 0.1959 |
| 535 | 0.1961 |
| 540 | 0.1964 |
| 545 | 0.1965 |
| 550 | 0.1964 |
| 555 | 0.1966 |
| 560 | 0.1967 |
| 565 | 0.1970 |
| 570 | 0.1973 |
| 575 | 0.1977 |
| 580 | 0.1982 |
| 585 | 0.1984 |
| 590 | 0.1983 |
| 595 | 0.1983 |
| 600 | 0.1979 |
| 605 | 0.1974 |
| 610 | 0.1970 |
| 615 | 0.1965 |
| 620 | 0.1961 |
| 625 | 0.1953 |
| 630 | 0.1949 |
| 635 | 0.1943 |
| 640 | 0.1937 |
| 645 | 0.1929 |
| 650 | 0.1924 |
| 655 | 0.1919 |
| 660 | 0.1914 |
| 665 | 0.1908 |
| 670 | 0.1904 |
| 675 | 0.1898 |
| 680 | 0.1893 |
| 685 | 0.1886 |
| 690 | 0.1882 |
| 695 | 0.1878 |
| 700 | 0.1874. |

8. The silver halide color reversal photographic light-sensitive material according to claim 4, wherein when the photographic light-sensitive material is exposed to light having a "gray" spectral reflectance distribution shown in Table 2 and is then subjected to development, the chroma C* value represented in the CIE Lab color system of a "gray" image that is reproduced by the photographic light-sensitive material, is 0 or more, but 10 or less, in the range of L*=20 to 70.

TABLE 2

| Spectral reflectance distribution of gray | |
|---|---|
| Wave-length (nm) | Spectral reflectance of gray |
| 400 | 0.1719 |
| 405 | 0.1824 |
| 410 | 0.1868 |
| 415 | 0.1887 |
| 420 | 0.1896 |
| 425 | 0.1906 |
| 430 | 0.1914 |
| 435 | 0.1927 |
| 440 | 0.1937 |
| 445 | 0.1948 |
| 450 | 0.1949 |
| 455 | 0.1948 |
| 460 | 0.1948 |
| 465 | 0.1943 |
| 470 | 0.1944 |
| 475 | 0.1943 |
| 480 | 0.1940 |
| 485 | 0.1938 |
| 490 | 0.1940 |
| 495 | 0.1941 |
| 500 | 0.1946 |
| 505 | 0.1947 |
| 510 | 0.1949 |
| 515 | 0.1950 |
| 520 | 0.1954 |
| 525 | 0.1958 |
| 530 | 0.1959 |
| 535 | 0.1961 |
| 540 | 0.1964 |
| 545 | 0.1965 |
| 550 | 0.1964 |
| 555 | 0.1966 |
| 560 | 0.1967 |
| 565 | 0.1970 |
| 570 | 0.1973 |
| 575 | 0.1977 |
| 580 | 0.1982 |
| 585 | 0.1984 |
| 590 | 0.1983 |
| 595 | 0.1983 |
| 600 | 0.1979 |
| 605 | 0.1974 |
| 610 | 0.1970 |
| 615 | 0.1965 |
| 620 | 0.1961 |
| 625 | 0.1953 |
| 630 | 0.1949 |
| 635 | 0.1943 |
| 640 | 0.1937 |
| 645 | 0.1929 |
| 650 | 0.1924 |
| 655 | 0.1919 |
| 660 | 0.1914 |
| 665 | 0.1908 |
| 670 | 0.1904 |
| 675 | 0.1898 |
| 680 | 0.1893 |
| 685 | 0.1886 |
| 690 | 0.1882 |
| 695 | 0.1878 |
| 700 | 0.1874. |

9. The silver halide color reversal photographic light-sensitive material according to claim 1, wherein the weight-averaged wavelength of the spectral sensitivity distribution of the red-sensitive silver halide emulsion layer is 580 nm or more and 630 nm or less and the weight-averaged wavelength of the spectral sensitivity distribution of the green-sensitive silver halide emulsion layer is 520 nm or more and 560 nm or less.

10. The silver halide color reversal photographic light-sensitive material according to claim 2, wherein the weight-averaged wavelength of the spectral sensitivity distribution of the red-sensitive silver halide emulsion layer is 580 nm or more and 630 nm or less and the weight-averaged wavelength of the spectral sensitivity distribution of the green-sensitive silver halide emulsion layer is 520 nm or more and 560 nm or less.

11. The silver halide color reversal photographic light-sensitive material according to claim 3, wherein the weight-averaged wavelength of the spectral sensitivity distribution of the red-sensitive silver halide emulsion layer is 580 nm or more and 630 nm or less and the weight-averaged wavelength of the spectral sensitivity distribution of the green-sensitive silver halide emulsion layer is 520 nm or more and 560 nm or less.

12. The silver halide color reversal photographic light-sensitive material according to claim 4, wherein the weight-averaged wavelength of the spectral sensitivity distribution of the red-sensitive silver halide emulsion layer is 580 nm or more and 630 nm or less and the weight-averaged wavelength of the spectral sensitivity distribution of the green-sensitive silver halide emulsion layer is 520 nm or more and 560 nm or less.

13. The silver halide color reversal photographic light-sensitive material according to claim 5, wherein the weight-averaged wavelength of the spectral sensitivity distribution of the red-sensitive silver halide emulsion layer is 580 nm or more and 630 nm or less and the weight-averaged wavelength of the spectral sensitivity distribution of the green-sensitive silver halide emulsion layer is 520 nm or more and 560 nm or less.

14. The silver halide color reversal photographic light-sensitive material according to claim 6, wherein the weight-averaged wavelength of the spectral sensitivity distribution of the red-sensitive silver halide emulsion layer is 580 nm or more and 630 nm or less and the weight-averaged wavelength of the spectral sensitivity distribution of the green-sensitive silver halide emulsion layer is 520 nm or more and 560 nm or less.

15. The silver halide color reversal photographic light-sensitive material according to claim 7, wherein the weight-averaged wavelength of the spectral sensitivity distribution of the red-sensitive silver halide emulsion layer is 580 nm or more and 630 nm or less and the weight-averaged wavelength of the spectral sensitivity distribution of the green-sensitive silver halide emulsion layer is 520 nm or more and 560 nm or less.

16. The silver halide color reversal photographic light-sensitive material according to claim 8, wherein the weight-averaged wavelength of the spectral sensitivity distribution of the red-sensitive silver halide emulsion layer is 580 nm or more and 630 nm or less and the weight-averaged wavelength of the spectral sensitivity distribution of the green-sensitive silver halide emulsion layer is 520 nm or more and 560 nm or less.

* * * * *